US011560295B2

(12) United States Patent
Harding, IV

(10) Patent No.: US 11,560,295 B2
(45) Date of Patent: Jan. 24, 2023

(54) FLOOR JACK

(71) Applicant: Harry Gottlieb Harding, IV, Alloway, NJ (US)

(72) Inventor: Harry Gottlieb Harding, IV, Alloway, NJ (US)

( * ) Notice: Subject to any disclaimer, the term of this patent is extended or adjusted under 35 U.S.C. 154(b) by 0 days.

(21) Appl. No.: 17/483,850

(22) Filed: Sep. 24, 2021

(65) Prior Publication Data

US 2022/0106172 A1 Apr. 7, 2022

Related U.S. Application Data

(60) Provisional application No. 63/086,607, filed on Oct. 2, 2020.

(51) Int. Cl.
*B66F 5/04* (2006.01)

(52) U.S. Cl.
CPC ..... *B66F 5/04* (2013.01)

(58) Field of Classification Search
CPC ..... B66F 5/04; B66F 5/00; B66F 7/00; B66F 11/00
USPC ..... 245/2 B, 3 B, 4 B, 5 B, 6 B, 8 B, 9 B, 245/10 B, 120, 124, 123; 269/17
See application file for complete search history.

(56) References Cited

U.S. PATENT DOCUMENTS 1,819,378 A * 8/1931 Nilson ..... B66F 5/04 254/2 B
1,852,544 A * 4/1932 Weaver ..... B66F 5/04 254/2 B
1,949,095 A * 2/1934 Walker ..... B66F 5/02 254/6 B
1,990,243 A * 2/1935 Mizer ..... B66F 5/02 254/6 B
2,018,148 A * 10/1935 Pfauser ..... B66F 5/02 254/6 B
2,032,309 A * 2/1936 Rechard ..... B66F 5/04 254/2 B
2,156,543 A * 5/1939 Pfauser ..... B66F 5/04 254/2 B
2,687,873 A * 8/1954 Trautman ..... B66F 5/04 254/93 H
3,967,814 A * 7/1976 Leibundgut ..... B66F 5/04 254/8 B (Continued)

OTHER PUBLICATIONS

Cambridge English Dictionary—arch (Year: 2022).*

*Primary Examiner* — Joseph J Hail
*Assistant Examiner* — Timothy Brady
(74) *Attorney, Agent, or Firm* — Ashok Tankha

(57) ABSTRACT

A floor jack and a frame therefor including a pair of arched side plates, hubs, axles, and spreader bars are provided. A first pair and a second pair of hubs are positioned at front ends and rear ends of the arched side plates respectively. A first axle and a second axle connect the arched side plates to the first pair and the second pair of hubs at the front ends and the rear ends of the arched side plates, respectively, using pairs of adjustable collars that pivot between lower and upper positions. The spreader bars separate the arched side plates along their length. The frame is configured for use in a conventional jack or in a mega jack with increased elevation by fixing the axles to the lower or upper positions of the adjustable collars. A frame is also provided for a fixed height floor jack including non-adjustable collars.

18 Claims, 48 Drawing Sheets

(56) References Cited

U.S. PATENT DOCUMENTS

| | | | | | |
|---|---|---|---|---|---|
| 4,018,421 | A * | 4/1977 | Tallman | B66F 5/04 | 254/8 B |
| 4,131,263 | A * | 12/1978 | John | B66F 3/42 | 254/8 B |
| 4,248,405 | A * | 2/1981 | Kameda | B66F 5/04 | 254/1 OB |
| 4,318,632 | A * | 3/1982 | Fortmeyer | B60P 3/1033 | 405/3 |
| 4,513,950 | A * | 4/1985 | Yamagishi | B66F 5/04 | 254/8 B |
| D286,934 | S * | 11/1986 | Hung | D34/31 | |
| 4,901,980 | A * | 2/1990 | Hansen | B66F 7/08 | 254/90 |
| 6,398,187 | B1 * | 6/2002 | Chang | B66F 5/04 | 254/8 B |
| 8,413,963 | B2 * | 4/2013 | Pacheco, Jr. | B25H 1/0014 | 254/133 R |
| 2005/0236790 | A1 * | 10/2005 | Carter | B66F 5/00 | 280/79.11 |
| 2011/0268505 | A1 * | 11/2011 | Ebbenga | B63C 3/12 | 405/3 |
| 2013/0187108 | A1 * | 7/2013 | Coccaro | B66F 5/04 | 254/93 R |
| 2019/0169004 | A1 * | 6/2019 | Su | B60C 7/00 | |
| 2020/0156910 | A1 * | 5/2020 | Tijerina | B66F 5/04 | |

* cited by examiner

PARTS LEGEND

1a, 1b - 0.375" THICK METAL SIDE PLATES (POWDER COAT)

2a, 2b - 1.00" OUTER DIAMETER (O.D.) 1018 COLD ROLLED METAL SHAFTS

3a, 3b, 3c, 3d, and 3e - 1.00" O.D. METAL SPREADER BARS (POWDER COAT)

15, 16, 17, and 18 - 0.50" THICK METAL TEAR DROP ADJUSTABLE SHAFT COLLARS - (POWDER COAT)

5, 6, 7, and 8 – HUBS

5a, 6a, 7a, and 8a - 1" FOUR-BOLT FLANGE BEARINGS UCF205-16

5b, 6b, 7b, and 8b - 1.00" THICK METAL SPACER PLATES

5c, 6c, 7c, and 8c - 0.25" THICK METAL END PLATES (POWDER COAT)

9a, 9b, 9c, and 9d - LOWER AXLE HOLES

13a, 13b, and 13c - THREADED HOLES ON BOTH ENDS OF THE SPREADER BARS

14a, 14b, 14c, and 14d - UPPER AXLE HOLES

15, 16, 17, and 18 - TEAR DROP ADJUSTABLE SHAFT COLLARS

FIG. 1

| | | | |
|---|---|---|---|
| WHEEL SIZE 3-1/2" to 25-1/2" – 4 on 4 Inch | | | |
| FINISH: POWDER COATED – LIME SQUEEZE | | | |
| | 3 TON ALUMINUM FLOOR JACK<br>WITH<br>ADJUSTABLE ARCHED SIDE PLATE | | |

PARTS LEGEND

21a and 21b - 0.375" THICK METAL SIDE PLATES (POWDER COAT)

22a and 22b - 1.00" OUTER DIAMETER (O.D.) 1018 COLD ROLLED METAL SHAFTS

23a, 23b, and 23c - 1.00" O.D. METAL SPREADER BARS (POWDER COAT)

210a, 211a, 212a, and 213a - 1" FOUR-BOLT FLANGE BEARINGS UCF205-16

210b, 211b, 212b, and 213b - 1.00" THICK METAL SPACER PLATES

210c, 211c, 212c, and 213c - 0.25" THICK METAL END PLATES (POWDER COAT

29c and 29d - LOWER AXLE HOLES

25, 26, 27, and 28 - 1" METAL SHAFT COLLARS – McMaster-Carr Part# 9946K24 (POWDER COAT)

FIG. 20

| | | | |
|---|---|---|---|
| TIRE SIZE 5.70 – 8 Load Range C 910 lbs | | | |
| WHEEL SIZE 8" – 4 on 4 Inch | | | |
| FINISH: POWDER COATED – LIME SQUEEZE | | | |

3 TON ALUMINUM FLOOR JACK
STD. ARCHED SIDE PLATE MODIFICATIONS

FIG. 32

PARTS LEGEND

31a and 31b - 0.375" THICK METAL SIDE PLATES (POWDER COAT)

32a and 32b - 1.00" OUTER DIAMETER (O.D.) 1018 COLD ROLLED METAL SHAFTS

34a, 34b, and 34c - 1.00" O.D. METAL SPREADER BARS (POWDER COAT)

310a, 311a, 312a, and 313a - 1" FOUR-BOLT FLANGE BEARINGS UCF205-16

310b, 311b, 312b, and 313b - 1.00" THICK METAL SPACER PLATES

310c, 311c, 312c, and 313c - 0.25" THICK METAL END PLATES (POWDER COAT)

39c and 39d - LOWER AXLE HOLES

35, 36, 37, and 38 - 1" METAL SHAFT COLLARS – McMaster-Carr Part# 9946K24 (POWDER COAT)

FIG. 33

| | | | |
|---|---|---|---|
| TIRE SIZE 175/80-13 Load Range C 1360 lbs | | | |
| WHEEL SIZE 13" - 4 on 4 Inch | | | |
| FINISH: POWDER COATED - LIME SQUEEZE | | | |

3 TON ALUMINUM FLOOR JACK
MEGA ARCHED SIDE PLATE MODIFICATIONS

FIG. 45

FLOOR JACK

CROSS-REFERENCE TO RELATED APPLICATIONS

This application claims priority to and the benefit of the provisional patent application titled "Structure For A Floor Jack", application No. 63/086,607, filed in the United States Patent and Trademark Office on Oct. 2, 2020. The specification of the above referenced patent application is incorporated herein by reference in its entirety.

BACKGROUND

The apparatus disclosed herein, in general, relates to a floor jack. More particularly, the apparatus disclosed herein relates to a floor jack and a frame therefor that allows a lifting pad of the floor jack to be elevated, for example, to about 40 inches above a substantially horizontal surface on which the floor jack is positioned, without the aid of an add-on extension.

The structures of side plates, hubs, axles, and spreader bars, and the type of tires and wheels attached to the hubs, determine the height to which the lifting pad of the floor jack can be elevated above a substantially horizontal surface on which the floor jack is positioned, and the weight that the floor jack can support.

There is a long felt need for a floor jack and a frame therefor that allows the lifting pad of the floor jack to be raised to an elevation more than the elevation that lifting pads can be raised with conventional floor jacks.

SUMMARY

This summary is provided to introduce a selection of concepts in a simplified form that are further disclosed in the detailed description. This summary is not intended to determine the scope of the claimed subject matter.

The apparatus disclosed herein addresses the above-recited need for a floor jack and a frame therefor that allows a lifting pad of the floor jack to be raised to an elevation more than the elevation that lifting pads can be raised with conventional floor jacks. The frame disclosed herein comprises a pair of arched side plates, a first pair of hubs, a second pair of hubs, a first axle, a second axle, and a set of spreader bars. Each of the arches side plates comprises a front end and a rear end. In an embodiment, the pair of arched side plates is made of metal and is powder coated. The first pair of hubs is positioned at the front end of the pair of arched side plates. The second pair of hubs is positioned at the rear ends of the pair of arched side plates. In an embodiment, each hub of the first pair of hubs and the second pair of hubs comprises a four-bolt flange bearing, a spacer plate, and an end plate coaxially positioned on either end of the first axle and the second axle respectively.

The first axle connects the pair of arched side plates to the first pair of hubs at the front ends using a first pair of adjustable collars. The second axle connects the pair of arched side plates to the second pair of hubs at the rear ends using a second pair of adjustable collars. In an embodiment, the first pair of adjustable collars and the second pair of adjustable collars are teardrop-shaped adjustable shaft collars. The teardrop-shaped adjustable shaft collars are configured to adjust an elevation of a lifting pad of the floor jack, above a substantially horizontal surface on which the floor jack is positioned, between a lowered position and a fully extended position. Each of the teardrop-shaped adjustable shaft collars pivots about a pivot point to switch between a lower position and an upper position, to adjust the elevation of the lifting pad of the floor jack. Each of the arched side plates comprises upper axle holes and lower axle holes corresponding to the upper position and the lower position of the teardrop-shaped adjustable shaft collars respectively, to allow adjustment of the elevation of the lifting pad of the floor jack. The set of spreader bars separate the pair of arched side plates along a length of the pair of arched side plates.

In an embodiment, the frame disclosed herein further comprises a set of tire-wheel assemblies. One of the tire-wheel assemblies is connected to each hub of the first pair of hubs and the second pair of hubs to provide mobility to the floor jack when the floor jack is assembled.

The teardrop-shaped adjustable shaft collars allow the lifting pad to be raised, for example, to about 10½ inches above the substantially horizontal surface on which the floor jack is positioned. The diameter of a wheel on the floor jack ranges, for example, from about 3½ inches to about 25½ inches. The minimum height the lifting pad with a 3½-inch diameter wheel can be elevated is, for example, about 14¼ inches above the substantially horizontal surface on which the floor jack is positioned, and the maximum height the lifting pad can be elevated is, for example, about 29¾ inches, when the lifting pad is in a retracted position. For example, with a 25½-inch diameter wheel, the minimum elevation of the lifting pad, above the substantially horizontal surface on which the floor jack is positioned, is about 25¼ inches, and the maximum elevation of the lifting pad, above the substantially horizontal surface on which the floor jack is positioned, is about 40¾ inches. In both the configurations, the lifting pad is in a retracted position.

In an embodiment, a frame is provided for a fixed height floor jack. In this embodiment, non-adjustable fixed shaft collars are used in lieu of the adjustable shaft collars. In this embodiment, the frame comprises a pair of arched side plates, a first pair of hubs, a second pair of hubs, a first axle, a second axle, and a set of spreader bars as disclosed above. In this embodiment, the pair of arched side plates is made of thick metal and is powder coated. In this embodiment, the first axle connects the pair of arched side plates to the first pair of hubs at the front ends using a first pair of non-adjustable collars, while the second axle connects the pair of arched side plates to the second pair of hubs at the rear ends using a second pair of non-adjustable collars.

The floor jack in the above embodiments comprises a lifting mechanism. The lifting mechanism comprises a lifting pad positioned between the pair of arched side plates. The lifting mechanism further comprises a handle operably connected to the pair of arched side plates and configured to raise the lifting pad to an extended position or lower the lifting pad to a lowered position or a retracted position.

BRIEF DESCRIPTION OF THE DRAWINGS

The foregoing summary, as well as the following detailed description, is better understood when read in conjunction with the appended drawings. For illustrating the embodiments herein, exemplary constructions of the embodiments are shown in the drawings. However, the embodiments herein are not limited to the specific structures and components disclosed herein. The description of a structure or a component referenced by a numeral in a drawing is applicable to the description of that structure or component shown by that same numeral in any subsequent drawing herein.

FIG. 1 is a tabulation of different parts of a frame for a floor jack, according to a first embodiment herein.

FIG. 20 is a tabulation of different parts of the frame of the floor jack, according to a second embodiment herein.

FIG. 32 indicates exemplary sizes of a tire-wheel assembly of the frame of the floor jack, according to the second embodiment herein.

FIG. 33 is a tabulation of different parts of the frame of the floor jack, according to a third embodiment herein.

FIG. 45 indicates exemplary sizes of a tire-wheel assembly of the frame of the floor jack, according to the third embodiment herein.

DETAILED DESCRIPTION

Figure 9A:
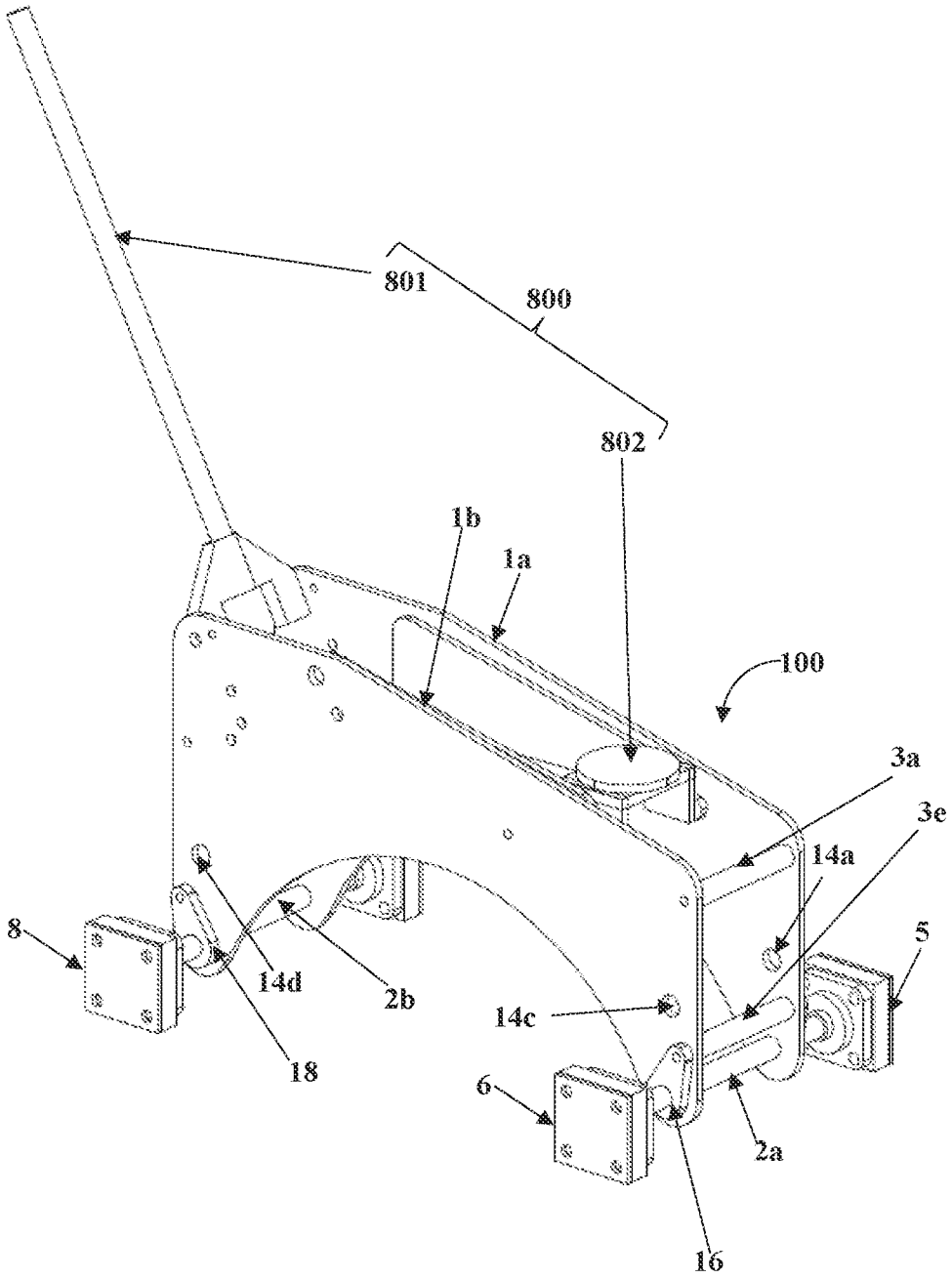
FIG. 9A exemplarily illustrates a perspective view of the frame of the floor jack in the lower position, showing the lifting mechanism, according to the first embodiment herein.
Figure 9B:
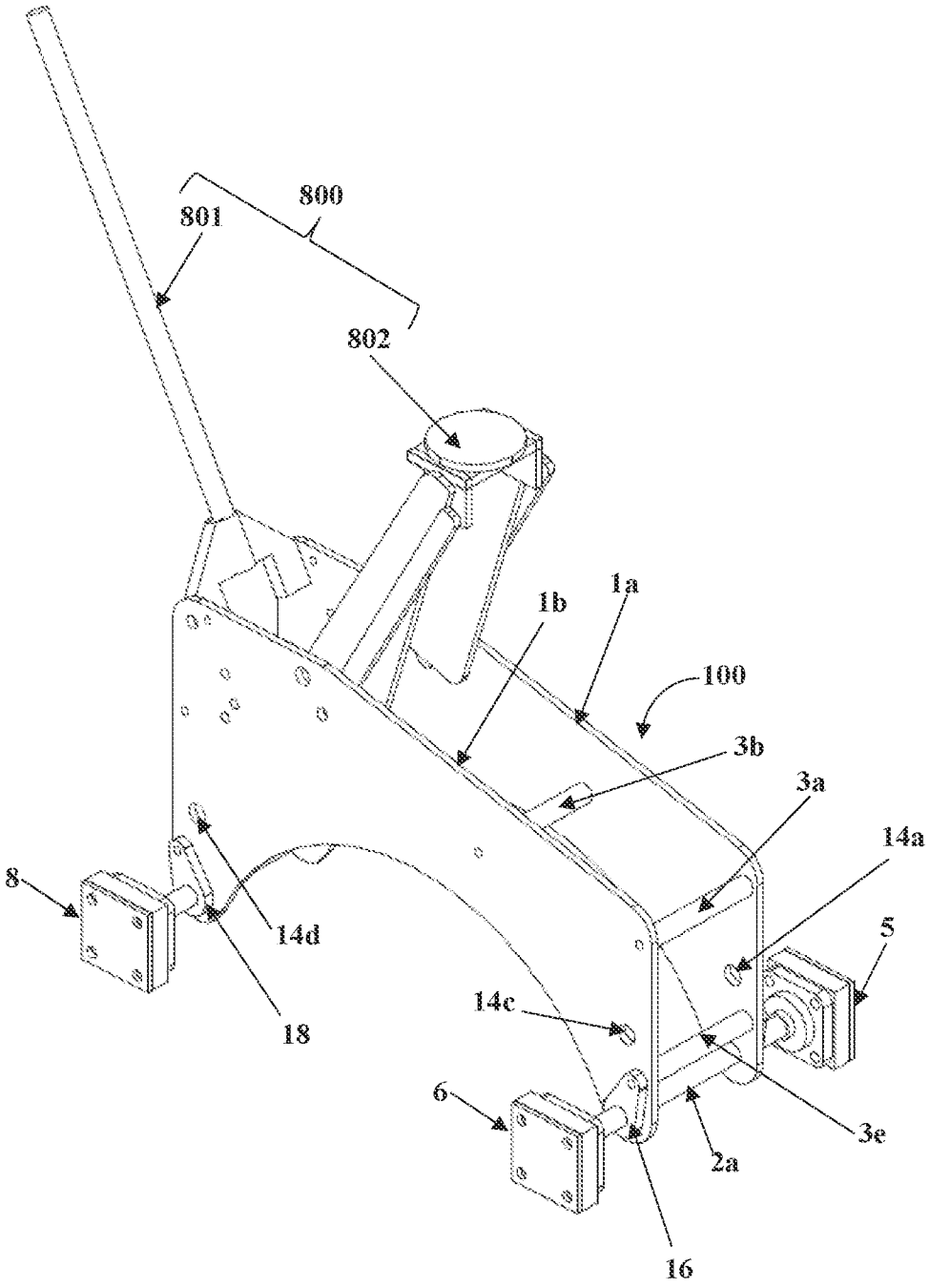
FIG. 9B exemplarily illustrates a perspective view of the frame of the floor jack shown in FIG. 9A, showing the lifting mechanism in an extended position, according to the first embodiment herein.
Figure 10A:
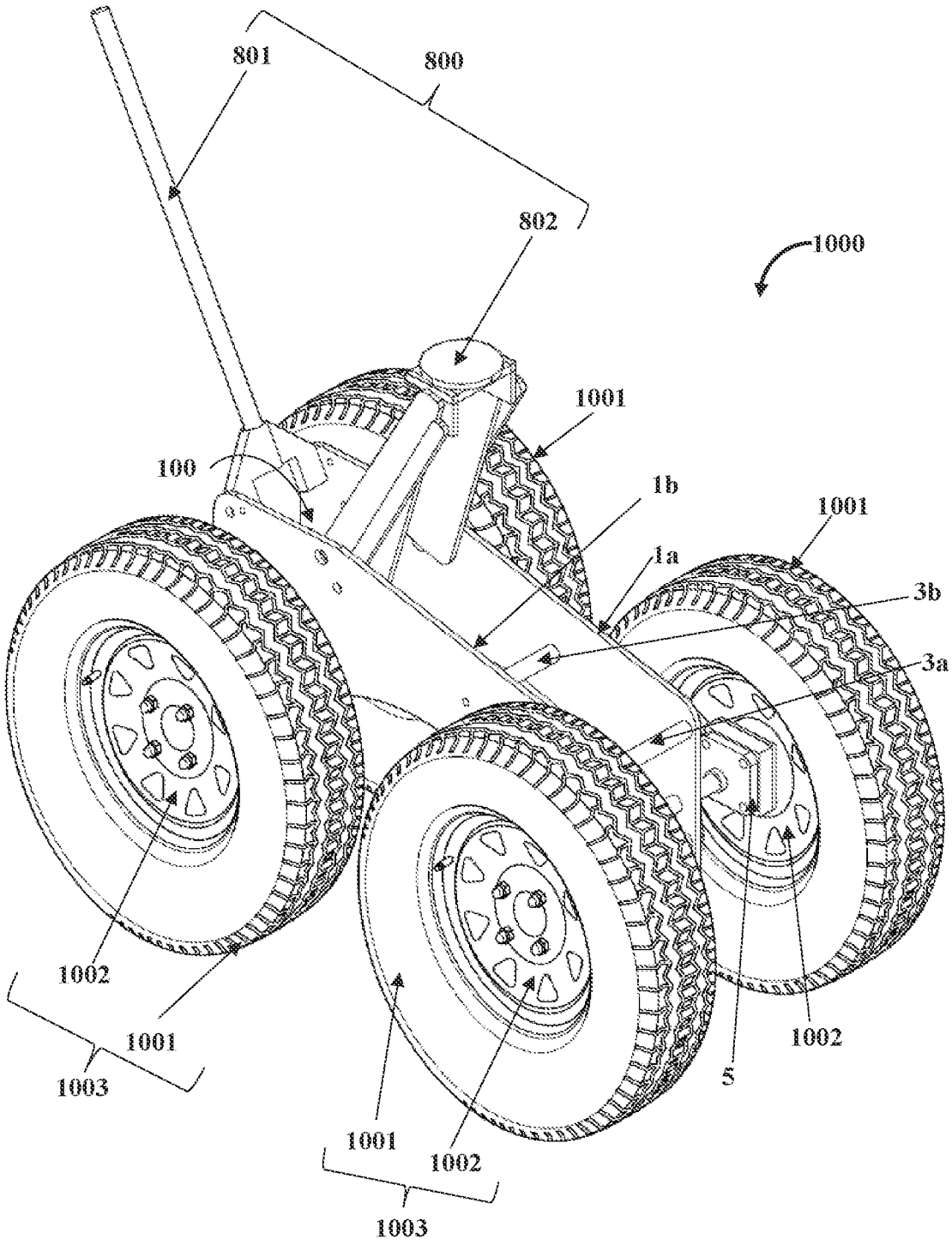
FIG. 10A exemplarily illustrates a front perspective view of the floor jack comprising the frame, the lifting mechanism, and tire-wheel assemblies, according to the first embodiment herein.
Figure 10B:
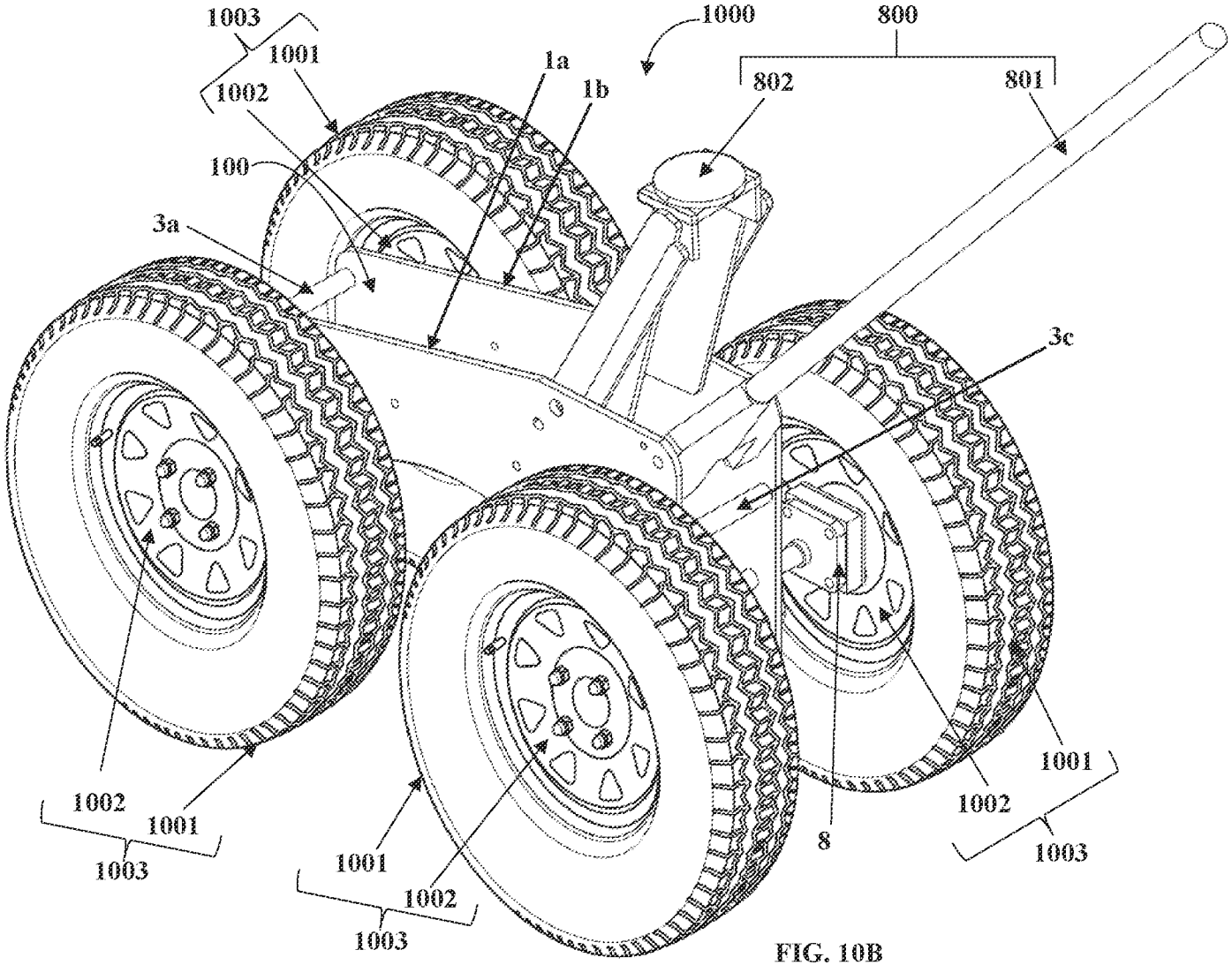
FIG. 10B exemplarily illustrates a rear perspective view of the floor jack comprising the frame, the lifting mechanism, and tire-wheel assemblies, according to the first embodiment herein.
Figure 11:
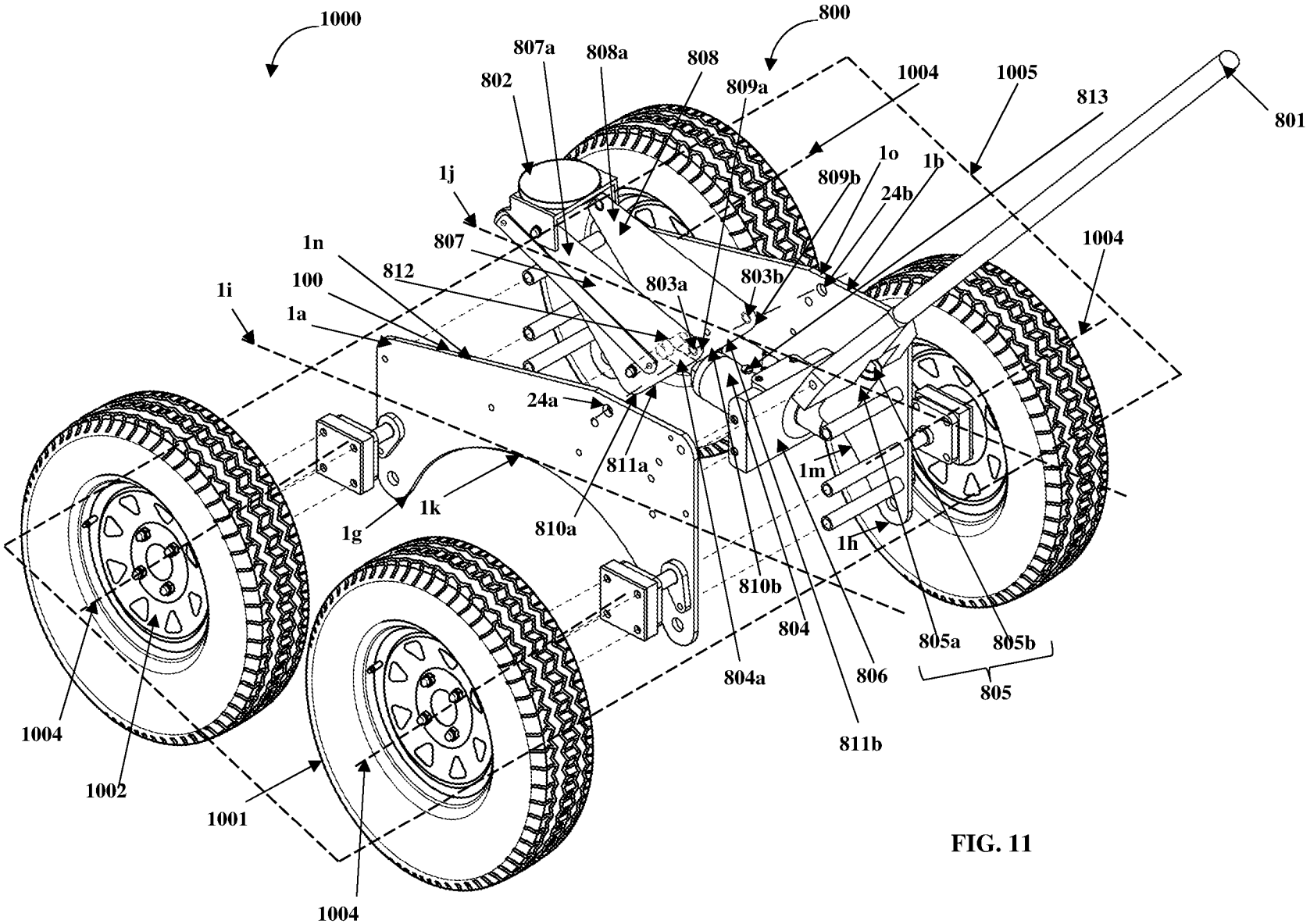
FIG. 11 exemplarily illustrates an exploded view of the floor jack, showing integration of the lifting mechanism in the frame of the floor jack, according to the first embodiment herein.

FIGS. 1-19 exemplarily illustrate a first embodiment of a frame 100 of a floor jack 1000 shown in FIGS. 10A-10B and FIG. 11. FIG. 1 is a tabulation of the different parts of the frame 100 for the floor jack 1000 illustrated in FIGS. 10A-10B and FIG. 11, according to the first embodiment herein.

Figure 2:
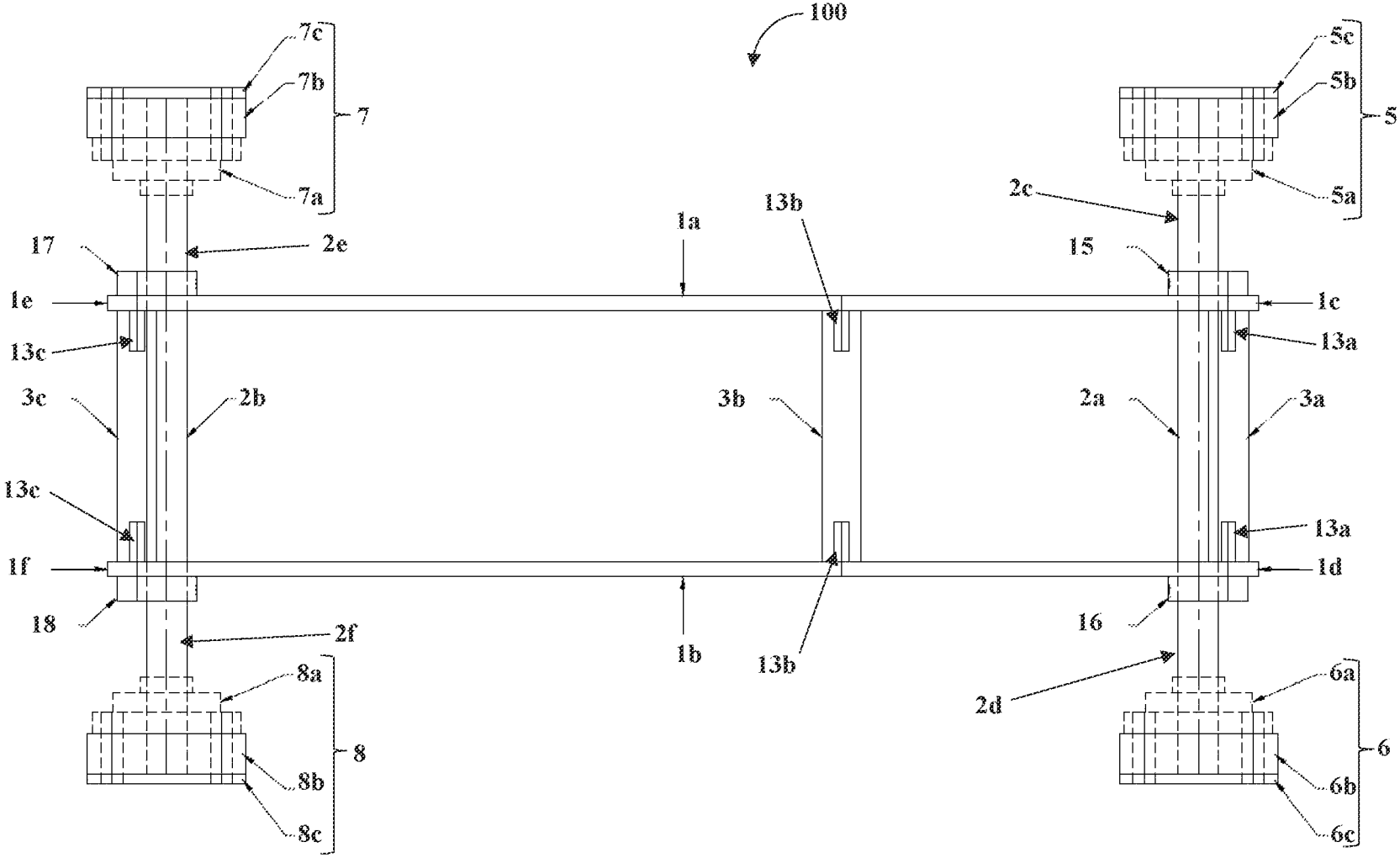
FIG. 2 exemplarily illustrates a top view of the frame of the floor jack, according to the first embodiment herein.

FIG. 2 exemplarily illustrates a top view of the frame 100 of the floor jack 1000 shown in FIGS. 10A-10B and FIG. 11, according to the first embodiment herein. The frame 100 comprises a pair of arched side plates 1*a* and 1*b*, a first pair of hubs 5 and 6, a second pair of hubs 7 and 8, a first axle 2*a*, a second axle 2*b*, and a set of spreader bars 3*a*, 3*b*, 3*c*, 3*d*, and 3*e* as exemplarily illustrated in FIGS. 2-3. The arched side plates 1*a* and 1*b* are made of metal and are powder coated. For example, the arched side plates 1*a* and 1*b* are powder coated, thick aluminum plates. The thickness of each of the arched side plates 1*a* and 1*b* is, for example, about 0.375 inches. The arched side plate 1*a* comprises a front end 1*c* and a rear end 1*e*. The arched side plate 1*b* comprises a front end 1*d* and a rear end 1*f*. The first pair of hubs 5 and 6 is positioned at the front ends 1*c* and 1*d* of the pair of arched side plates 1*a* and 1*b* respectively. The arched side plates 1*a* and 1*b* are connected to the hubs 5 and 6 at the front ends 1*c* and 1*d* respectively, via the first axle 2*a*. The second pair of hubs 7 and 8 is positioned at the rear ends 1*e* and 1*f* of the pair of arched side plates 1*a* and 1*b* respectively. The arched side plates 1*a* and 1*b* are connected to the hubs 7 and 8 at the rear ends 1*e* and 1*f* respectively, via the second axle 2*b*. The first axle 2*a* connects the pair of arched side plates 1*a* and 1*b* to the first pair of hubs 5 and 6 at the front ends 1*c* and 1*d* respectively using a first pair of adjustable collars 15 and 16. The second axle 2*b* connects the pair of arched side plates 1*a* and 1*b* to the second pair of hubs 7 and 8 at the rear ends 1*e* and 1*f* respectively, using a second pair of adjustable collars 17 and 18. In the first embodiment, the first pair of adjustable collars 15 and 16 and the second pair of adjustable collars 17 and 18 are teardrop-shaped adjustable shaft collars as exemplarily illustrated in FIGS. 5-7. The teardrop-shaped adjustable shaft collars 15, 16, 17, and 18 are connected between the hubs 5, 6, 7, and 8 and the two arched side plates 1*a* and 1*b*. The teardrop-shaped adjustable shaft collars 15, 16, 17, and 18 are made of metal, for example, aluminum. The diameter of each of the teardrop-shaped adjustable shaft collars 15, 16, 17, and 18 is, for example, about 0.5 inches. In an embodiment, the teardrop-shaped adjustable shaft collars 15, 16, 17, and 18 are powder coated.

Figure 14:
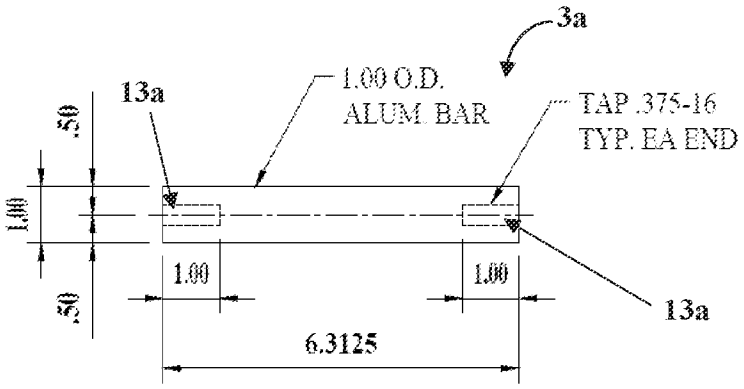
FIG. 14 exemplarily illustrates a dimensional drawing of a spreader bar of the frame of the floor jack, according to the first embodiment herein.

The spreader bars 3*a*, 3*b*, 3*c*, 3*d*, and 3*e* separate the pair of arched side plates 1*a* and 1*b* along a length of the pair of arched side plates 1*a* and 1*b*. The spreader bars 3*a*, 3*b*, 3*c*, 3*d*, and 3*e* are made of metal, for example, aluminum. The outer diameter of each of the spreader bars 3*a*, 3*b*, 3*c*, 3*d*, and 3*e* is, for example, about 1 inch. In an embodiment, the spreader bars 3*a*, 3*b*, 3*c*, 3*d*, and 3*e* are powder coated. In an embodiment, each of the spreader bars 3*a*, 3*b*, 3*c*, 3*d*, and 3*e* comprises threaded holes 13*a* on both its ends as exemplarily illustrated in FIG. 14. FIG. 14 exemplarily illustrates the spreader bar 3*a*; the structure and the function of each of the spreader bars 3*b*, 3*c*, 3*d*, and 3*e* are identical to the structure and the characteristics of the spreader bar 3*a*. The spreader bars 3*a*, 3*b*, 3*c*, 3*d*, and 3*e* and the arched side plates 1*a* and 1*b* are secured to each other using fasteners 11, for example, threaded screws, threaded bolts, etc., exemplarily illustrated in FIG. 3. As exemplarily illustrated in FIG. 3 and FIGS. 5-7, the arched side plate 1*a* comprises through holes 19*a*, 19*b*, 19*c*, 19*d*, and 19*e*, and the arched side plate 1*b* comprises through holes 20*a*, 20*b*, 20*c*, 20*d*, and 20*e*, for securing the spreader bars 3*a*, 3*b*, 3*c*, 3*d*, and 3*e* to the arched side plates 1*a* and 1*b* using the fasteners 11. For example, the arched side plate 1*a* is aligned parallel to the arched side plate 1*b* such that the through hole 19*a* in the arched side plate 1*a* is aligned with the corresponding through hole 20*a* in the arched side plate 1*b*. The spreader bar 3*a* is inserted between the arched side plates 1*a* and 1*b*, such that the threaded hole 13*a* on one end of the spreader bar 3*a* aligns with the through hole 19*a*, and the threaded hole 13*a* on other end of the spreader bar 3*a* aligns with the through hole 20*a*. Fasteners, for example, 11, are used to fasten the arched side plates 1*a* and 1*b* to the spreader bar 3*a* by inserting the fasteners 11 into the threaded holes 13*a* on both ends of the spreader bar 3*a* via the through holes 19*a* and 20*a*. Similarly, the through holes 19*b*, 19*c*, and 19*d* of the arched side plate 1*a* are aligned with the through holes 20*b*, 20*c*, and 20*d* of the arched side plate 1*b* respectively, and the opposing ends of the spreader bars 3*b*, 3*c*, and 3*d* are fastened to the arched side plates 1*a* and 1*b* by inserting fasteners 11 into their respective threaded holes 13*b*, 13*c*, and 13*d* on both ends of the spreader bars 3*b*, 3*c*, and 3*d* via the through holes 19*b*, 19*c*, and 19*d* and 20*b*, 20*c*, and 20*d*. Furthermore, the through hole 19*e* of the arched side plate 1*a* is aligned with the through hole 20*e* of the arched side plate 1*b*, and the opposing ends of the spreader bar 3*e* exemplarily illustrated in FIG. 3, are fastened to the arched side plates 1*a* and 1*b* by inserting fasteners 11 into its threaded holes (not shown) on both ends of the spreader bar 3*e* via the through holes 19*e* and 20*e*.

As exemplarily illustrated in FIG. 2, the first axle 2*a* connects the two arched side plates 1*a* and 1*b* to the first pair of hubs 5 and 6 at the front ends 1*c* and 1*d* of the arched side plates 1*a* and 1*b*, respectively. The second axle 2*b* connects the two arched side plates 1*a* and 1*b* to the second pair of hubs 7 and 8 at the rear ends 1*e* and 1*f* of the arched side plates 1*a* and 1*b*, respectively. Both the first and second axles 2*a* and 2*b* are rotatably engaged with the arched side plates 1*a* and 1*b*. The four hubs 5, 6, 7, and 8 are secured to the axles 2*a* and 2*b* using set screws 1600*a* and 1600*b* exemplarily illustrated in FIG. 16, where each of the set screws 1600*a* and 1600*b* is inserted into an individual tapped hole (not shown) in each of four-bolt flange bearings 5*a*, 6*a*, 7*a*, and 8*a* of the four hubs 5, 6, 7, and 8 respectively as disclosed in the detailed description of FIG. 16. The structure and the function of the second axle 2*b* is identical to the structure and the function of the first axle 2*a* exemplarily illustrated in FIG. 13. In an embodiment, the front hub 5 and the front hub 6 are each attached to one of the ends of the first axle 2*a*. For example, the front hub 5 is attached to an end 2*c* of the first axle 2*a* that is adjacent to the first arched side plate 1*a*, and the front hub 6 is attached to another end 2*d* of the first axle 2*a* that is adjacent to the second arched side plate 1*b*. In an embodiment, the rear hub 7 and the rear hub 8 are each attached to one of the ends of the second axle 2*b*. For example, the rear hub 7 is attached to an end 2*e* of the second axle 2*b* that is adjacent to the first arched side plate 1*a*, and the rear hub 8 is attached to another end 2*f* of the second axle 2*b* that is adjacent to the second arched side plate 1*b*. In an embodiment, the axles 2*a* and 2*b* have an outer diameter of, for example, about 1 inch. In an example, the axles 2*a* and 2*b* are configured as 1018 cold rolled metal shafts. In an embodiment, each of the hubs 5, 6, 7, and 8 comprises a set of four parts coaxially positioned on either end of the first axle 2*a* and the second axle 2*b* respectively. The four parts of each of the hubs 5, 6, 7, and 8 are a four-bolt flange bearing 5*a*, 6*a*, 7*a*, and 8*a*, a thick metal spacer plate 5*b*, 6*b*, 7*b*, and 8*b*, and a thick metal end plate 5*c*, 6*c*, 7*c*, and 8*c* as exemplarily illustrated in FIG. 7. The diameter of each of the four-bolt flange bearings 5*a*, 6*a*, 7*a*, and 8*a* is, for example, about 1 inch. An example of the four-bolt flange bearing 5*a*, 6*a*, 7*a*, and 8*a* is UCF205-16. In an example, the thick metal spacer plates 5*b*, 6*b*, 7*b*, and 8*b* and the thick metal end plates 5*c*, 6*c*, 7*c*, and 8*c* are made of aluminum. The diameter of each of the thick metal spacer plates 5*b*, 6*b*, 7*b*, and 8*b* is, for example, about 1 inch. In an embodiment, each of the thick metal end plates 5*c*, 6*c*, 7*c*, and 8*c* is powder coated. The diameter of each of the thick metal end plates 5*c*, 6*c*, 7*c*, and 8*c* is, for example, about 0.25 inches.

Figures 18, 19:
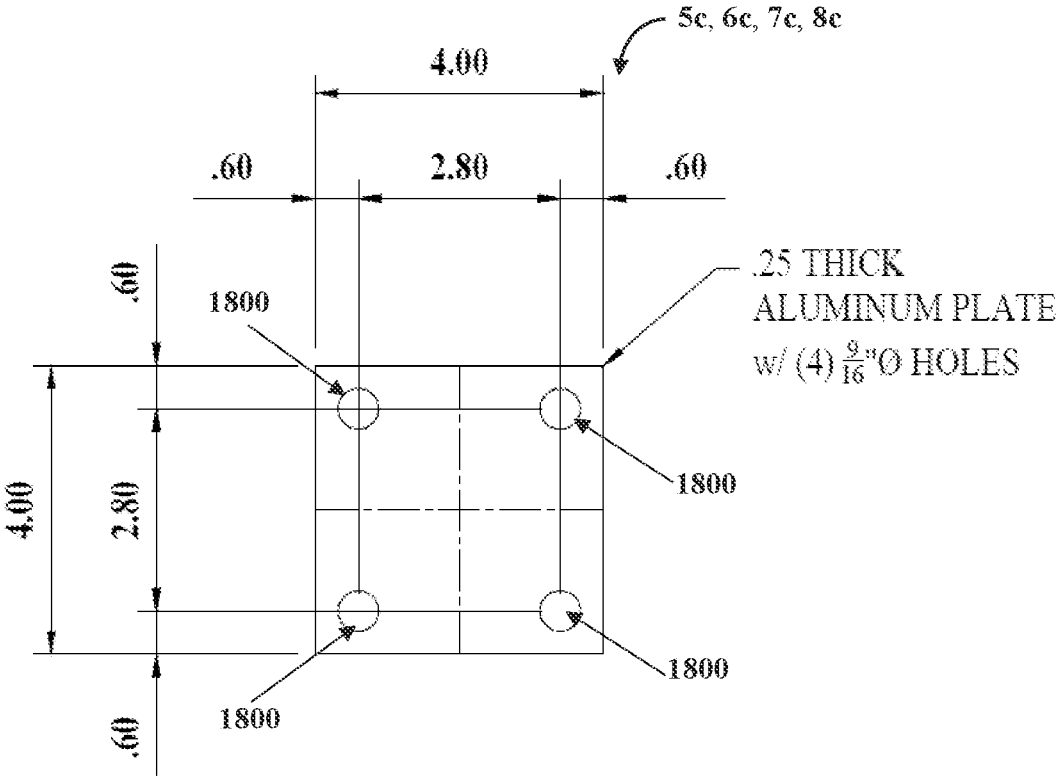
FIG. 18 exemplarily illustrates a dimensional drawing of an end plate of each hub of the frame of the floor jack, according to the first embodiment herein.
FIG. 19 indicates exemplary sizes of a tire-wheel assembly of the frame of the floor jack, according to the first embodiment herein.

In the first embodiment of the frame 100 as exemplarily illustrated in FIGS. 2-7, FIGS. 8A-8B, and FIGS. 9A-9B, the teardrop-shaped adjustable shaft collars 15, 16, 17, and 18 secure the arched side plates 1*a* and 1*b* to the axles 2*a* and 2*b* and to the hubs 5, 6, 7, and 8 at the front ends 1*c* and 1*d* and the rear ends 1*e* and 1*f* of the arched side plates 1*a* and 1*b*. The teardrop-shaped adjustable shaft collars 15, 16, 17, and 18 are configured to adjust an elevation of a lifting pad 802 of the floor jack 1000 exemplarily illustrated in FIGS. 8A-10B, above a substantially horizontal surface on which the floor jack 1000 is positioned, between a lowered position and a fully extended position. The elevation of the lifting pad 802, above the substantially horizontal surface on which the floor jack 1000 is positioned, is adjustable between a lowered position and a fully extended position by adjusting the position of the teardrop-shaped adjustable shaft collars 15, 16, 17, and 18. The teardrop-shaped adjustable shaft collars 15, 16, 17, and 18 and appropriate tire-wheel assembly 1003 comprising tires 1001 and wheels 1002 as exemplarily illustrated in FIGS. 10A-10B and FIG. 11, allow the lifting pad 802 to be elevated up to a height of, for example, about 10½ inches, or set to a lower elevation above the substantially horizontal surface on which the floor jack 1000 is positioned. The diameter of a wheel 1002 in each tire-wheel assembly 1003 ranges, for example, from about 3½ inches up to about 25½ inches as indicated in FIG. 19. The lifting pad 802 with about a 3½-inch diameter wheel 1002 is configured to be raised, for example, to about 14¼ inches and about 29¾ inches, above the substantially horizontal surface on which the floor jack 1000 is positioned. In an example, with about a 25½-inch diameter wheel 1002, the minimum elevation to which the lifting pad 802 can be raised, above the substantially horizontal surface on which the floor jack 1000 is positioned, is about 25¼ inches, and the maximum elevation to which the lifting pad 802 can be raised, above the substantially horizontal surface on which the floor jack 1000 is positioned, is about 40¾ inches. In both the configurations, the lifting pad 802 is in a retracted position. Therefore, by using wheels 1002 of various sizes and the teardrop-shaped adjustable shaft collars 15, 16, 17, and 18, the lifting pad 802 can be raised over a range, for example, from about 14'/a inches to about 40¾ inches above the substantially horizontal surface on which the floor jack 1000 is positioned.

Figure 3:
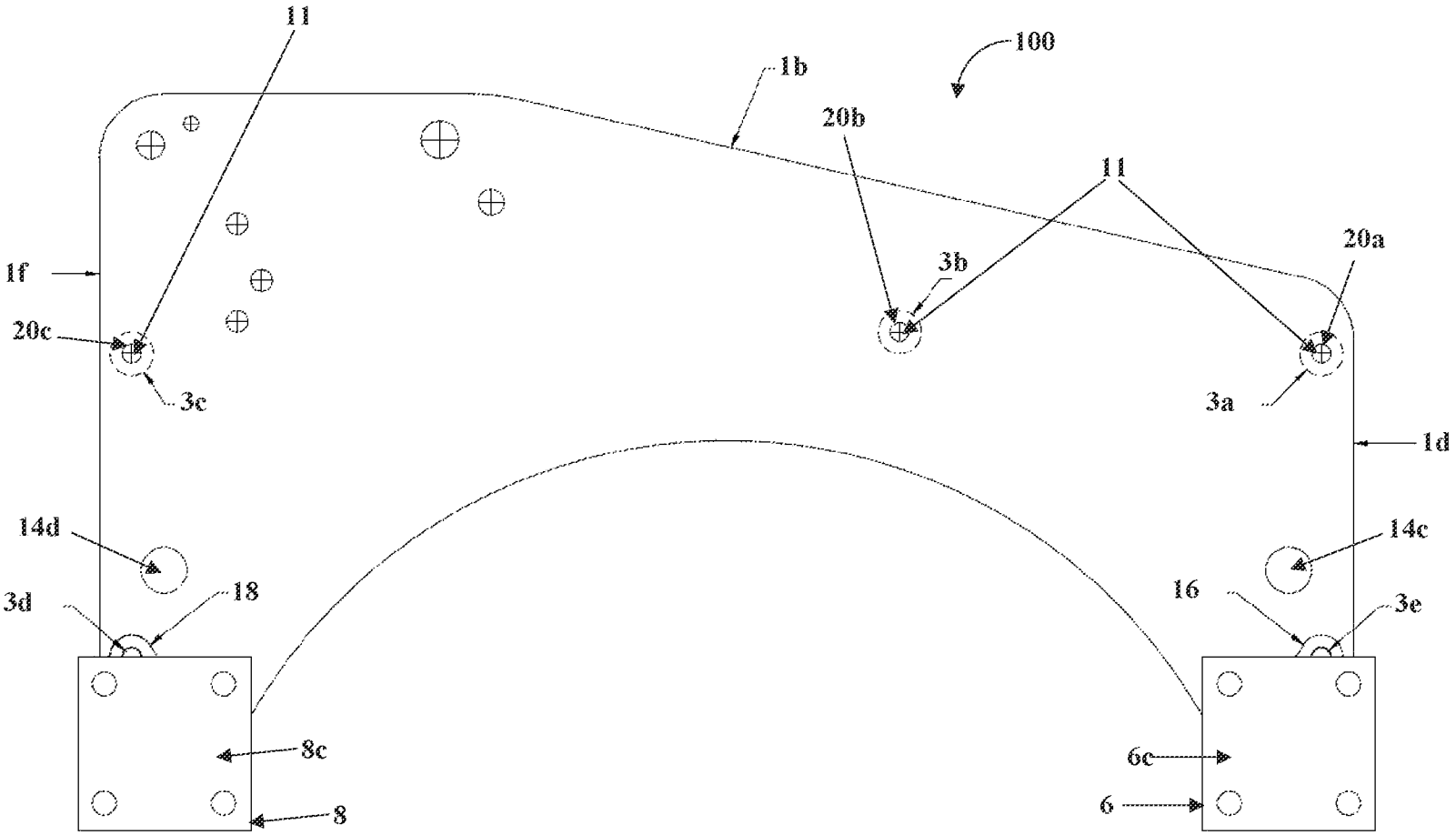
FIG. 3 exemplarily illustrates a side view of the frame of the floor jack, according to the first embodiment herein.

FIG. 3 exemplarily illustrates a side view of the frame 100 of the floor jack 1000 shown in FIGS. 10A-10B and FIG. 11, according to the first embodiment herein. Each of the arched side plates 1*a* and 1*b* has an arch structure as exemplarily illustrated by the arched side plate 1*b* in FIG. 3. Also illustrated in FIG. 3, are the two hubs 6 and 8, one each from the front pair of hubs 5 and 6 and the rear pair of hubs 7 and 8 exemplarily illustrated in FIG. 2. In an example, the length of each of the arched side plates 1*a* and 1*b* is about 29 inches. Also illustrated in the side view are upper axle holes 14*c* and 14*d* configured on the arched side plate 1*b* for configuring the floor jack 1000 as a mega jack. The frame 300 configured for a mega jack is disclosed in the detailed descriptions of FIGS. 33-45. The upper axle holes 14*a* and 14*b* on the arched side plate 1*a* are exemplarily illustrated in FIG. 7. Also illustrated in FIG. 3 are the through holes, for example, 20*a*, 20*b*, 20*c*, etc., used for inserting the fasteners 11 and connecting the spreader bars, for example, 3*a*, 3*b*, 3*c*, etc., between the arched side plates 1*a* and 1*b*. Also illustrated in FIG. 3 is one of each pair of adjustable collars, for example, 16 and 18, used by the first axle 2*a* and the second axle 2*b* for connecting the arched side plates 1*a* and 1*b* to their respective hubs 6 and 8. The other of each pair of adjustable collars, for example, 15 and 17, is used by the first axle 2*a* and the second axle 2*b* for connecting the arched side plates 1*a* and 1*b* to their respective hubs 5 and 7 are exemplarily illustrated in FIG. 2.

Figure 4:
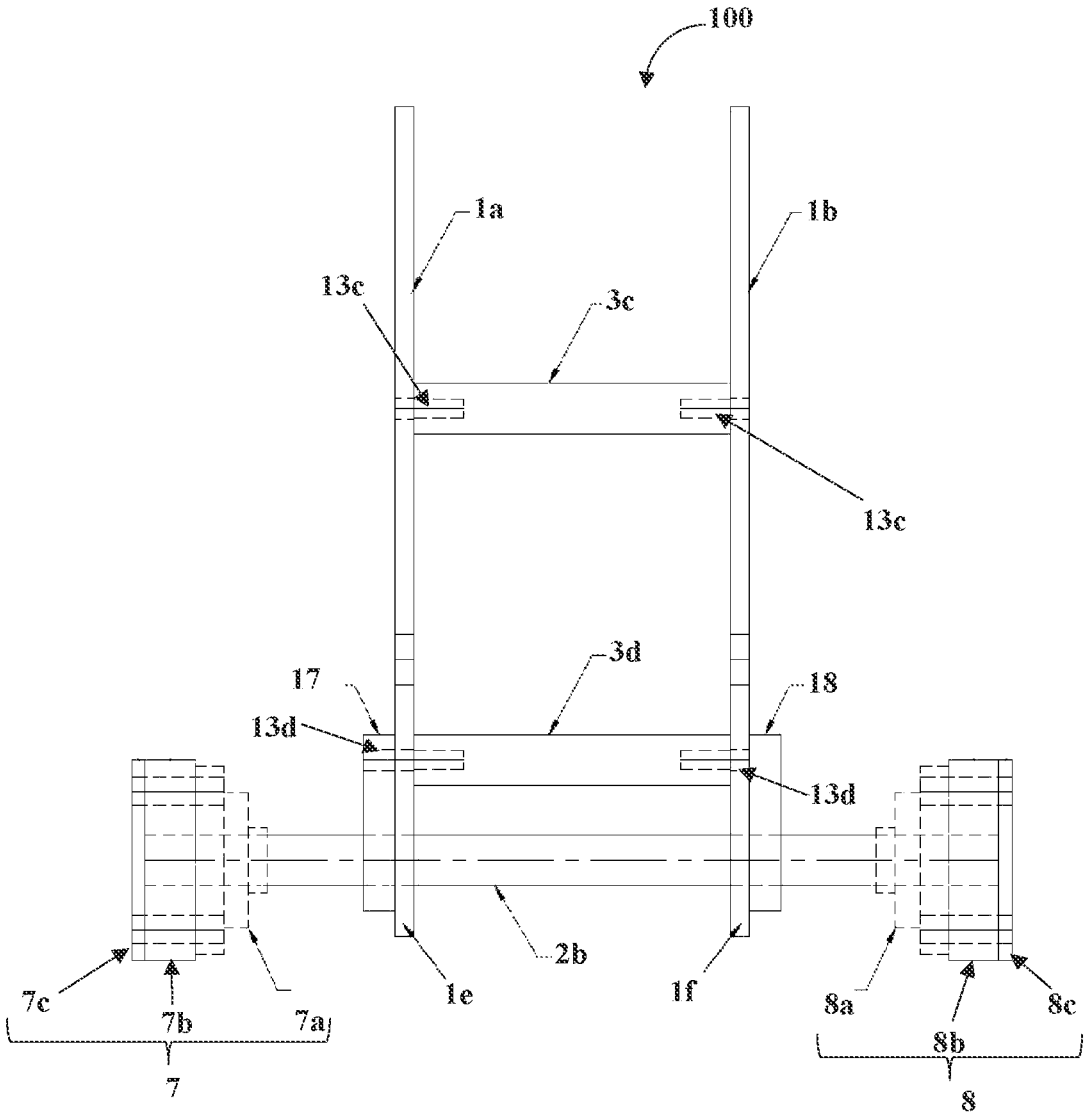
FIG. 4 exemplarily illustrates a rear view of the frame of the floor jack, according to the first embodiment herein.

FIG. 4 exemplarily illustrates a rear view of the frame 100 of the floor jack 1000 shown in FIGS. 10A-10B and FIG. 11, according to the first embodiment herein. The rear view illustrates the pair of arched side plates 1*a* and 1*b* connected to the hubs 7 and 8 via the second axle 2*b* at the rear ends 1*e* and 1*f* of the two arched side plates 1*a* and 1*b* respectively. The arched side plates 1*a* and 1*b* are secured to the hubs 7 and 8 using the teardrop-shaped adjustable shaft collars 17 and 18 respectively. Also illustrated in FIG. 4, is the second axle 2*b* connected to the hubs 7 and 8 at the rear ends 1*e* and 1*f* of the arched side plates 1*a* and 1*b* respectively. Also illustrated in FIG. 4, are two spreader bars 3*c* and 3*d* that separate the two arched side plates 1*a* and 1*b* along a width of the arched side plates 1*a* and 1*b*. As exemplarily illustrated in FIG. 4, the spreader bar 3*c* is an upper spreader bar and the spreader bar 3*d* is a lower spreader bar. The lower spreader bar 3*d* connects the pivot points 1502 of the two metal, teardrop-shaped adjustable shaft collars 17 and 18 at the rear ends 1*e* and 1*f* of the arched side plates 1*a* and 1*b*. The pivot point 1502 of each of the metal teardrop-shaped adjustable shaft collars 17 and 18 is exemplarily illustrated in FIG. 5 and FIGS. 15A-15B.

Figure 5:
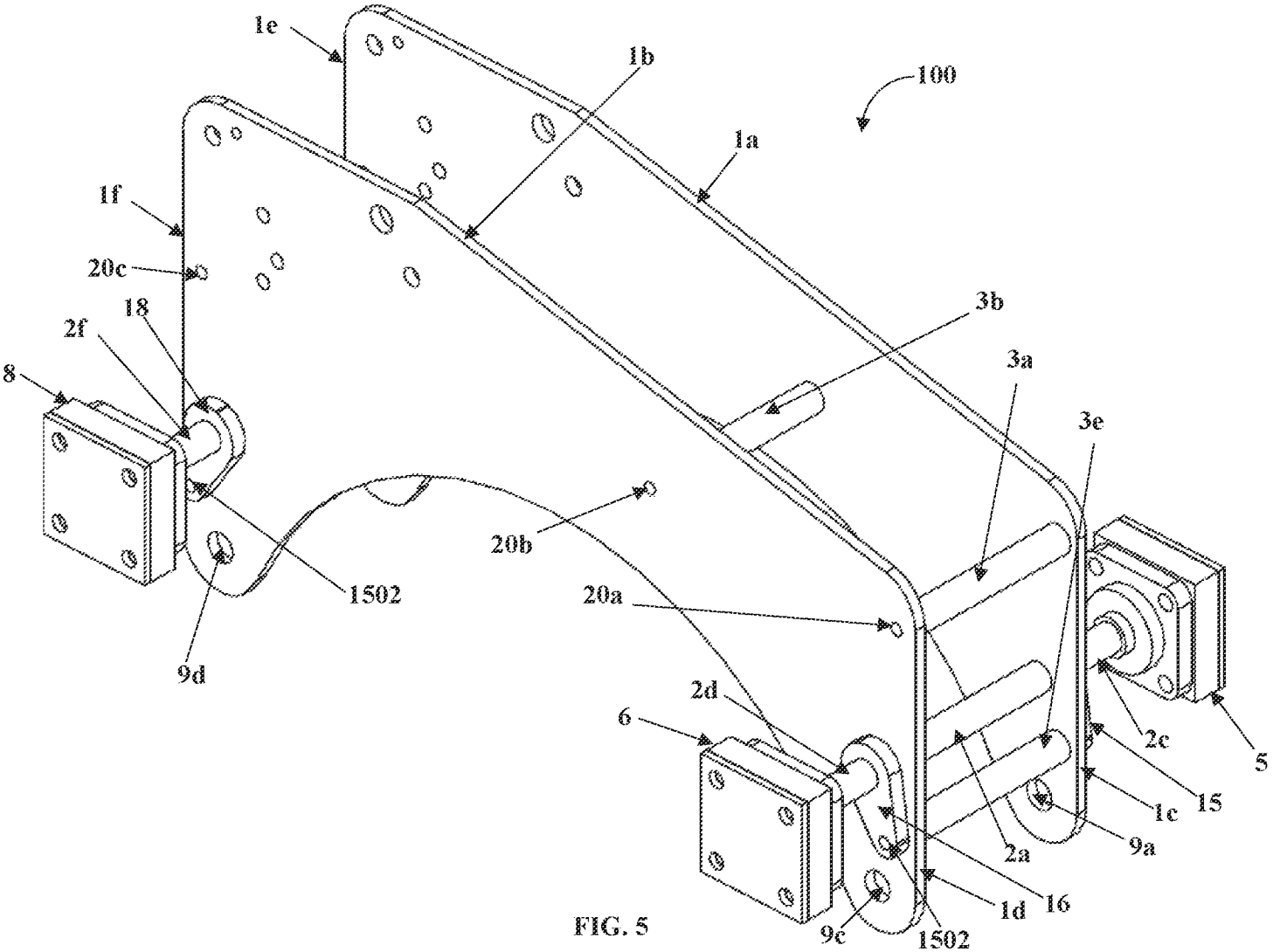
FIG. 5 exemplarily illustrates a perspective view of the frame of the floor jack configured in an upper position, according to the first embodiment herein.

FIG. 5 exemplarily illustrates a perspective view of the frame 100 of the floor jack 1000 shown in FIGS. 10A-10B and FIG. 11, configured in an upper position, according to the first embodiment herein. The assembled frame 100 forms the backbone of the floor jack 1000. The elevation of the frame 100 of the floor jack 1000 is in an upper position when the teardrop-shaped adjustable shaft collars 15, 16, 17, and 18 are in an upper position 1503 as exemplarily illustrated in FIG. 5 and FIG. 15B. The teardrop-shaped adjustable shaft collars 15 and 17 pivot on a plane of the arched side plate 1*a* about the pivot point 1502 as exemplarily illustrated in FIGS. 5-6 and FIG. 15B. Similarly, the teardrop-shaped adjustable shaft collars 16 and 18 pivot on a plane of the arched side plate 1*b* about the pivot point 1502 as exemplarily illustrated in FIGS. 5-6 and FIG. 15B. To configure the frame 100 of the floor jack 1000 in the upper position, the teardrop-shaped adjustable shaft collars 15 and 17 are pivoted about the pivot point 1502 to position them in the upper position 1503 as exemplarily illustrated in FIG. 5 and FIG. 15B. The first axle 2*a* is inserted into a hole 15*a* of the teardrop-shaped adjustable shaft collar 15 exemplarily illustrated in FIG. 15A, then through the upper axle holes 14*a* and 14*c* exemplarily illustrated in FIG. 3 and FIGS. 6-7, and then the first axle 2*a* exits out of the hole 16*a* of the teardrop-shaped adjustable shaft collar 16 exemplarily illustrated in FIG. 15A. The first axle 2*a* rotatably engages with the arched side plates 1*a* and 1*b*. The ends 2*c* and 2*d* of the first axle 2*a* extend out through the upper axle holes 14*a* and 14*c* respectively as exemplarily illustrated in FIG. 2 and FIGS. 5-7. The teardrop-shaped adjustable shaft collars 16 and 18 are then pivoted about the pivot point 1502 to position them in the upper position 1503 illustrated in FIG. 15B. The second axle 2*b* is inserted into a hole 17*a* of the teardrop-shaped adjustable shaft collar 17 exemplarily illustrated in FIG. 15A, then through the upper axle holes 14*b* and 14*d* exemplarily illustrated in FIG. 3 and FIGS. 6-7, and then the second axle 2*b* exits out of the hole 18*a* of the teardrop-shaped adjustable shaft collar 18 exemplarily illustrated in FIG. 15A. The second axle 2*b* rotatably engages with the arched side plates 1*a* and 1*b*. The ends 2*e* and 2*f* of the second axle 2*b* extend out through the upper axle holes 14*b* and 14*d* respectively as exemplarily illustrated in FIG. 2 and FIGS. 6-7. In an embodiment, each of the teardrop-shaped adjustable shaft collars 15, 16, 17 and 18 comprises a tapped hole 1500 exemplarily illustrated in FIG. 15A, for accommodating a set screw (not shown). The set screw is used to secure the teardrop-shaped adjustable shaft collars 15 and 16 against the first axle 2*a*, and to secure the teardrop-shaped adjustable shaft collars 17 and 18 against the second axle 2*b*. In an embodiment, securing the teardrop-shaped adjustable shaft collars 15 and 16 against the first axle 2*a*, and securing the teardrop-shaped adjustable shaft collars 17 and 18 against the second axle 2*b* prevent the axles 2*a* and 2*b* from rotating with respect to the arched side plates 1*a* and 1*b*.

Figure 6:
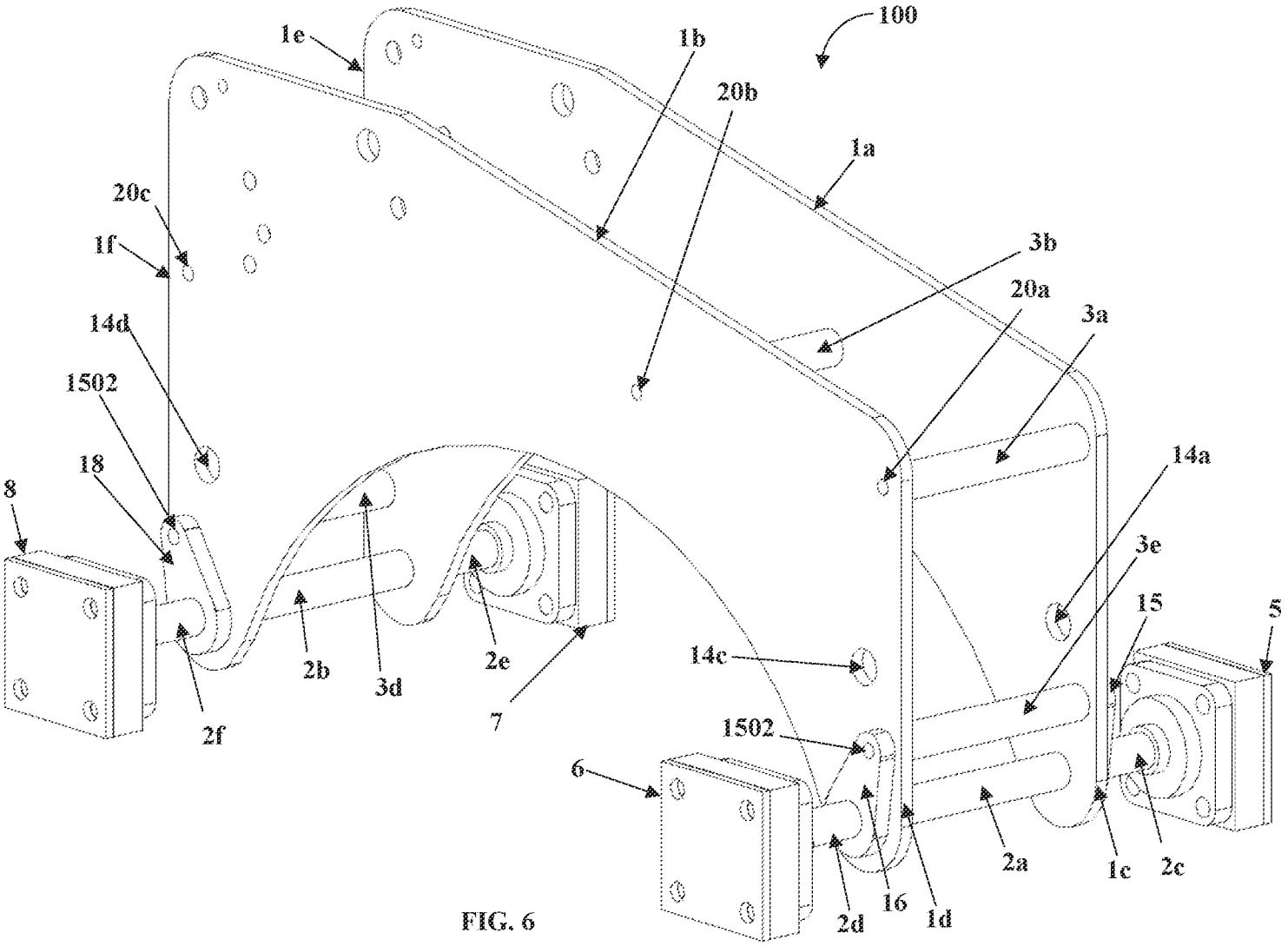
FIG. 6 exemplarily illustrates a perspective view of the frame of the floor jack configured in a lower position, according to the first embodiment herein.

FIG. 6 exemplarily illustrates a perspective view of the frame 100 of the floor jack 1000 shown in FIGS. 10A-10B and FIG. 11, configured in a lower position, according to the first embodiment herein. The elevation of the frame 100 of the floor jack 1000 is configured to be in a lowered position when the teardrop-shaped adjustable shaft collars 15, 16, 17, and 18 are in the lower position 1501 as exemplarily illustrated in FIG. 6 and FIG. 15B. To configure the frame 100 of the floor jack 1000 in a lowered position, the teardrop-shaped adjustable shaft collars 15 and 17 are pivoted about the pivot point 1502 to position them in the lower position 1501 as exemplarily illustrated in FIG. 6 and FIG. 15B. The first axle 2*a* is inserted into the hole 15*a* of the teardrop-shaped adjustable shaft collar 15 exemplarily illustrated in FIG. 15A, then through the lower axle holes 9*a* and 9*c* exemplarily illustrated in FIG. 5 and FIG. 7, and then the first axle 2*a* exits out of hole 16*a* of the teardrop-shaped adjustable shaft collar 16 exemplarily illustrated in FIG. 15A. The first axle 2*a* rotatably engages with the arched side plates 1*a* and 1*b*. The ends 2*c* and 2*d* of the first axle 2*a* extend out through the lower axle holes 9*a* and 9*c* respectively as exemplarily illustrated in FIG. 2 and FIGS. 5-7. The teardrop-shaped adjustable shaft collars 16 and 18 are then pivoted about the pivot point 1502 to position them in the lower position 1501. The second axle 2*b* is inserted into the hole 17*a* of the teardrop-shaped adjustable shaft collar 17 exemplarily illustrated in FIG. 15A, then through the lower axle holes 9*b* and 9*d*, and then the second axle 2*b* exits out of hole 18*a* of the teardrop-shaped adjustable shaft collar 18. The second axle 2*b* rotatably engages with the arched side plates 1*a* and 1*b*. The ends 2*e* and 2*f* of the second axle 2*b* extend out through the lower axle holes 9*b* and 9*d* respectively as exemplarily illustrated in FIG. 2 and FIGS. 5-7.

Figure 7:
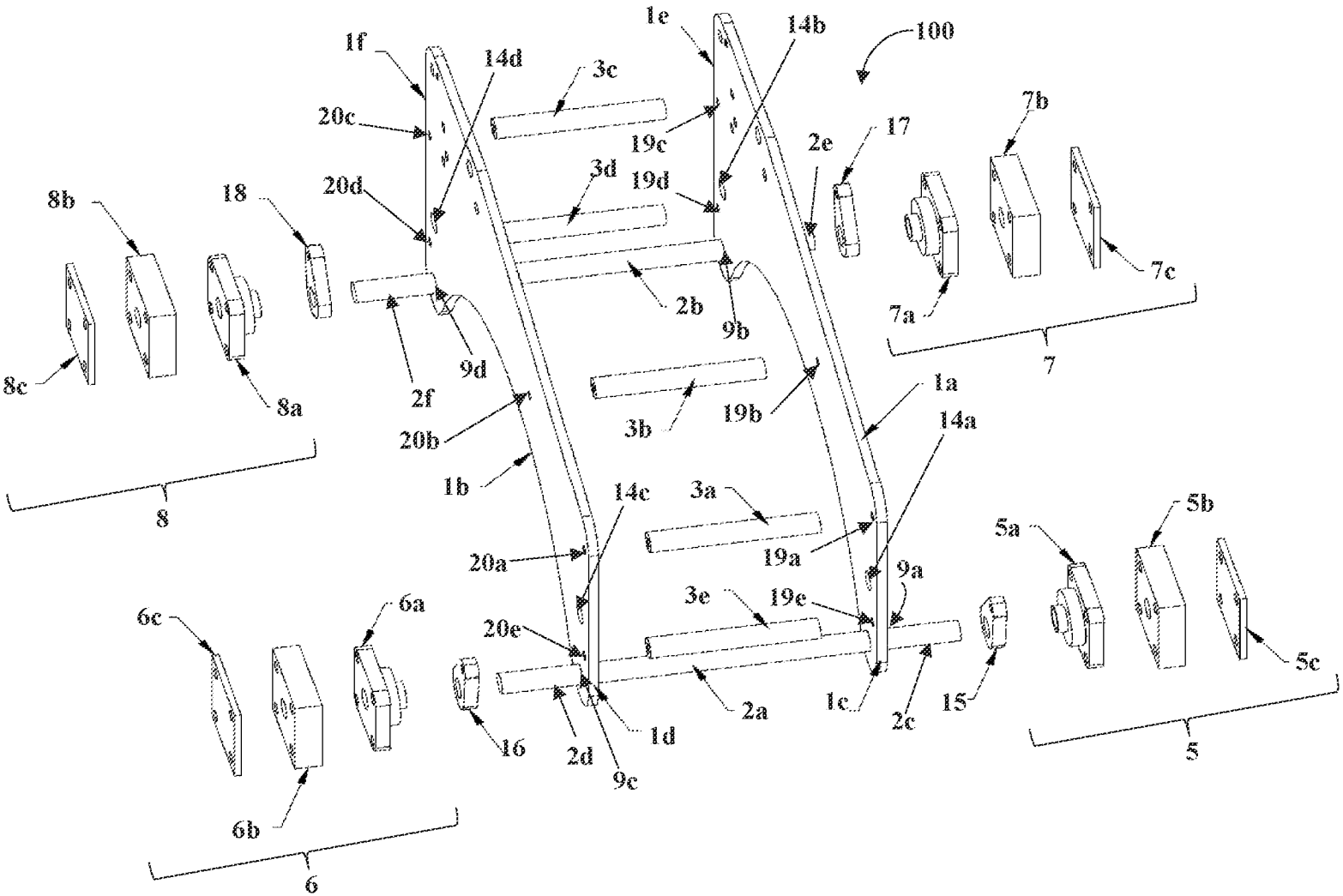
FIG. 7 exemplarily illustrates an exploded view of the frame of the floor jack, according to the first embodiment herein.

FIG. 7 exemplarily illustrates an exploded view of the frame 100 of the floor jack 1000 shown in FIGS. 10A-10B and FIG. 11, according to the first embodiment herein. In this view, the parts of the frame 100 of the floor jack 1000 are disassembled and positioned proximal to each other. Also illustrated in FIG. 7, are the various holes configured in the frame 100, for example, the upper axle holes 14*a*, 14*b*, 14*c*, and 14*d* used for configuring the frame 100 in the upper position as disclosed in the detailed description of FIG. 5; the lower axle holes 9*a*, 9*b*, 9*c*, and 9*d* used for configuring the frame 100 in the lower position as disclosed in the detailed description of FIG. 6, and the through holes 19*a*, 19*b*, 19*c*, 19*d*, 19*e* and 20*a*, 20*b*, 20*c*, 20*d*, 20*e* used for connecting the spreader bars 3*a*, 3*b*, 3*c*, 3*d*, and 3*e* between the arched side plates 1*a* and 1*b* as disclosed in the detailed description of FIG. 2. Also illustrated in FIG. 7, are the parts of the hubs 5, 6, 7, and 8, namely, the four-bolt flange bearings 5*a*, 6*a*, 7*a*, and 8*a*, the spacer plates 5*b*, 6*b*, 7*b*, and 8*b*, and the end plates 5*c*, 6*c*, 7*c*, and 8*c*.

Figure 8A:
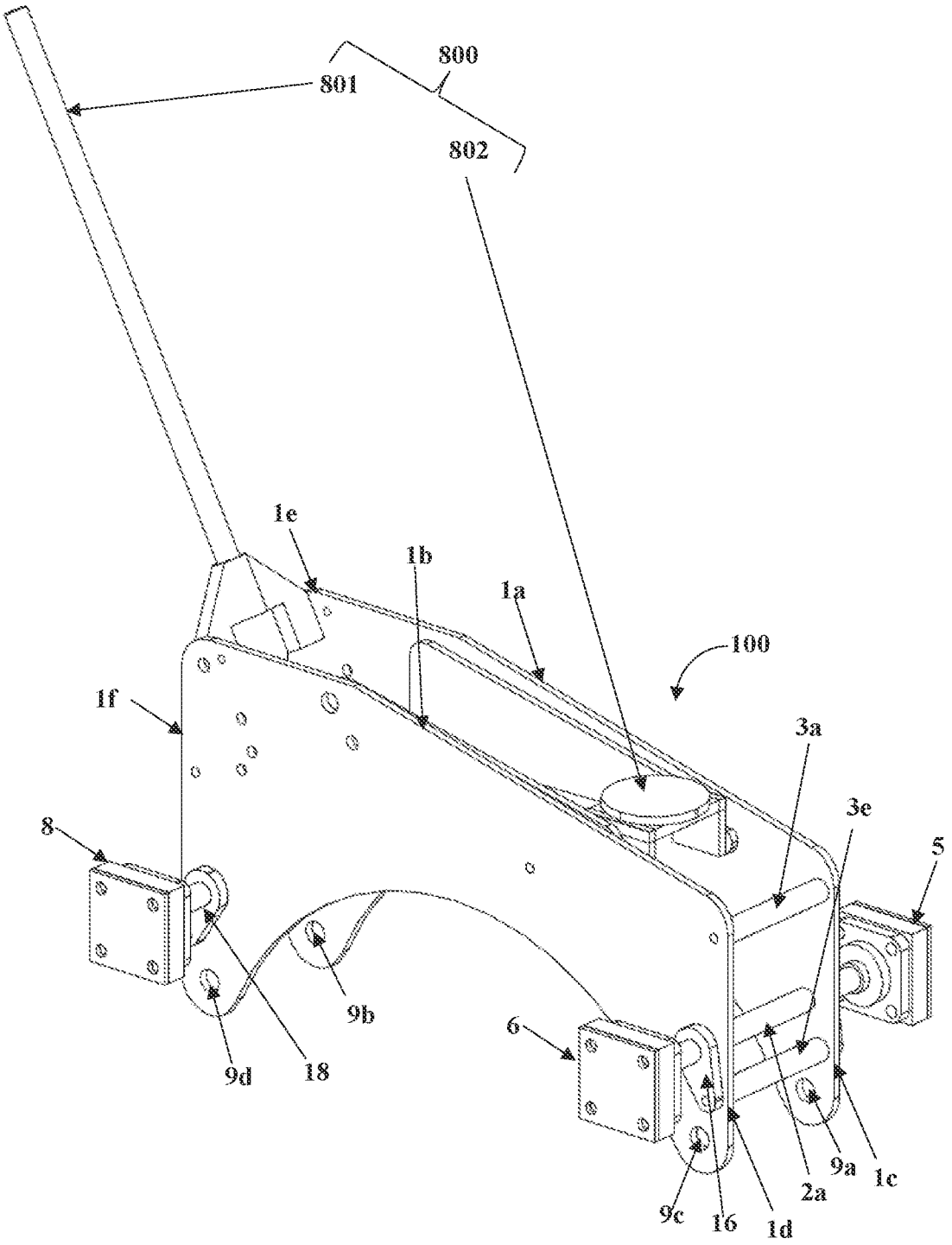
FIG. 8A exemplarily illustrates a perspective view of the frame of the floor jack in the upper position, showing a lifting mechanism of the floor jack, according to the first embodiment herein.

FIG. 8A exemplarily illustrates a perspective view of the frame 100 of the floor jack 1000 shown in FIGS. 10A-10B and FIG. 11, in the upper position, showing a lifting mechanism 800 of the floor jack 1000, according to the first embodiment herein. The lifting mechanism 800 comprises a handle 801 and a lifting pad 802 positioned between the pair of arched side plates 1*a* and 1*b*. In an embodiment, the lifting mechanism 800 is a hydraulic lifting mechanism. The handle 801 is operably connected to the pair of arched side plates 1*a* and 1*b* as exemplarily illustrated in FIG. 11, and is configured to raise the lifting pad 802 to an extended position or lower the lifting pad 802 to a lowered position or a retracted position. In FIG. 8A, the elevation of the frame 100 of the floor jack 1000 is shown in the upper position and the lifting pad 802 is shown in a retracted position. The elevation of the lifting pad 802 is adjusted using the handle 801.

Figure 8B:
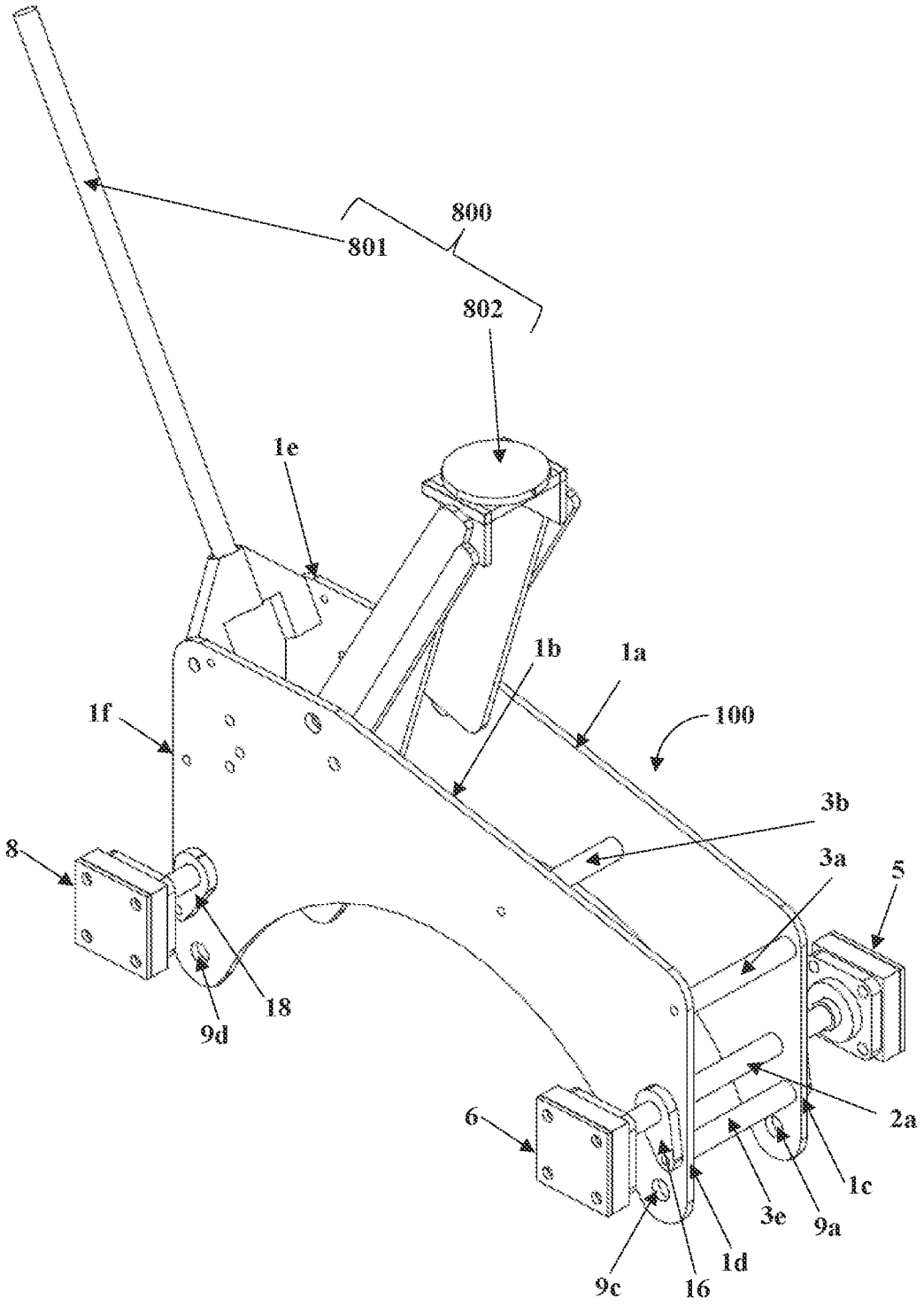
FIG. 8B exemplarily illustrates a perspective view of the frame of the floor jack shown in FIG. 8A, showing the lifting mechanism in an extended position, according to the first embodiment herein.

FIG. 8B exemplarily illustrates a perspective view of the frame 100 of the floor jack 1000 shown in FIG. 8A, showing the lifting mechanism 800 in an extended position, according to the first embodiment herein. In FIG. 8B, the elevation of the frame 100 of the floor jack 1000 is shown in the upper position, and the lifting pad 802 of the lifting mechanism 800 is shown in the extended position.

FIG. 9A exemplarily illustrates a perspective view of the frame 100 of the floor jack 1000 shown in FIGS. 10A-10B and FIG. 11, in the lower position, showing the lifting mechanism 800, according to the first embodiment herein. In FIG. 9A, the elevation of the frame 100 of the floor jack 1000 is shown in the lower position and the lifting pad 802 of the lifting mechanism 800 is shown in a lowered position or a retracted position. The handle 801 of the lifting mechanism 800 is used to adjust the elevation of the lifting pad 802 from an extended position to the retracted position exemplarily illustrated in FIG. 9A.

FIG. 9B exemplarily illustrates a perspective view of the frame 100 of the floor jack 1000 shown in FIG. 9A, showing the lifting mechanism 800 in an extended position, according to the first embodiment herein. In FIG. 9B, the elevation of the frame 100 of the floor jack 1000 is shown in the lower position and the lifting pad 802 of the lifting mechanism 800 is shown in an extended position. The handle 801 of the lifting mechanism 800 is used to adjust the elevation of the lifting pad 802 from the retracted position exemplarily illustrated in FIG. 9A, to the extended position exemplarily illustrated in FIG. 9B.

FIG. 10A is a front perspective view of the floor jack 1000 comprising the frame 100, the lifting mechanism 800, and tire-wheel assemblies 1003, according to the first embodiment herein. As exemplarily illustrated in FIG. 10A, the floor jack 1000 comprises a set of four tire-wheel assemblies 1003. The tire-wheel assemblies 1003 are connected to the first pair of hubs 5 and 6 and the second pair of hubs 7 and 8 exemplarily illustrated in FIG. 2 and FIG. 11, to provide mobility to the floor jack 1000 when the floor jack 1000 is assembled. Each of the tire-wheel assemblies 1003 comprises a tire 1001 and a wheel 1002. In FIG. 10A, the lifting pad 802 of the lifting mechanism 800 is shown in an extended position. In an embodiment, the tires 1001 are pneumatic tires that substantially improve the stability of the floor jack 1000 and makes the floor jack 1000 more mobile in rough areas containing, for example, sand, dirt, rocks, mud, etc.

FIG. 10B exemplarily illustrates a rear perspective view of the floor jack 1000 comprising the frame 100, the lifting mechanism 800, and the tire-wheel assemblies 1003, according to the first embodiment herein. Each of the tire-wheel assemblies 1003 comprising a tire 1001 and a wheel 1002 provides mobility to the floor jack 1000 when the floor jack 1000 is assembled. In FIG. 10B, the lifting pad 802 of the lifting mechanism 800 is shown in an extended position.

FIG. 11 exemplarily illustrates an exploded view of the floor jack 1000, showing integration of the lifting mechanism 800 in the frame 100 of the floor jack 1000, according to the first embodiment herein. In an embodiment as exemplarily illustrated in FIG. 11, the lifting mechanism 800 is a hydraulic lifting mechanism comprising a pair of lifting arms 807 and 808, a working cylinder 804 with a piston 804*a*, a pump plunger 805, and a hydraulic fluid reservoir 806. The pump plunger 805 comprises a chamber 805*a* and a plunger 805*b*. In an embodiment as exemplarily illustrated in FIG. 11, each of the lifting arms 807 and 808 has a shape resembling a triangle. Each of the lifting arms 807 and 808 comprises an apex corner 807*a* and 808*a* respectively. Each of the lifting arms 807 and 808 further comprises a pair of corners 809*a* and 809*b*, and 810*a* and 810*b* adjacent to base sides 811*a* and 811*b* opposite to the apex corners 807*a* and 808*a* respectively. The lifting arms 807 and 808 are pivotably connected to the arched side plates 1*a* and 1*b* respectively, using fasteners that secure holes 24*a* and 24*b* in the arched side plates 1*a* and 1*b* with the holes 803*a* and 803*b* in the corners 809*a* and 809*b* of the lifting arms 807 and 808 respectively. Each of the lifting arms 807 and 808 further comprises a hole (not shown) at the corners 810*a* and 810*b* adjacent to the base sides 811*a* and 811*b* respectively. A bar 812 is secured between the holes on the corners 810*a* and 810*b* of the pair of lifting arms 807 and 808. The piston 804*a* is rotatably connected to a mid-section of the bar 812. In an embodiment, the hydraulic floor jack 1000 operates using an incompressible liquid, for example, oil, since oil is self-lubricating and stable. The pump plunger 805 forces the liquid into the working cylinder 804 when the handle 801 attached to the plunger 805*b* is lowered. The plunger 805*b* is pulled back by turning the handle 801 in a counterclockwise direction 5203 as exemplarily illustrated in FIG. 52B, causing the pump plunger 805 to draw the liquid out of the fluid reservoir 806 through a suction check valve (not shown) into the chamber 805*a*. When the plunger 805*b* moves into the chamber 805*a* of the pump plunger 805, the plunger 805*b* pushes the oil through a discharge check valve (not shown) into the working cylinder 804. A suction check valve ball (not shown), positioned within the chamber 805*a*, opens with each draw of the plunger 805*b*. A discharge check valve ball (not shown), positioned outside the chamber 805*a*, opens when the liquid is pushed into the working cylinder 804. At this point, the suction check valve ball (not shown) within the chamber 805*a* is forced shut and liquid pressure builds in the working cylinder 804. The piston 804*a* slowly advances out of the working cylinder 804 with each stroke of the plunger 805*b* and pushes the bar 812 at the corners 810*a* and 810*b* of the lifting arms 807 and 808 forward. The forward push of the bar 812, in turn, causes the lifting arms 807 and 808 to pivot at the corners 809*a* and 809*b* and raise or lift up the lifting pad 802. The lifting pad 802 is lowered by releasing the liquid pressure using a release valve 813. The lifting mechanism 800 allows the elevation of the lifting pad 802 to be adjusted independently from the frame 100 of the floor jack 1000.

FIG. 11 also illustrates that the curved, arched side plate 1*a* defines a first side plate lower edge 1*g* and a first side plate upper edge 1*n*. Similarly, the curved, arched side plate 1*b* defines a second side plate lower edge 1*h* and a second side plate upper edge 1*o*. In an embodiment, the curved, arched side plate 1*a* is a first side plate 1*a* and the arched side plate 1*b* is a second side plate 1*b*. In an embodiment, the second side plate 1*b* is in an opposing configuration to the first side plate 1*a*. In an embodiment, the first side plate 1*a* defines a first curved arch 1*k* on the lower edge 1*g* of the first side plate 1*a*. The first curved arch 1*k* extends upwards towards the first side plate upper edge 1*n*. Similarly, the second side plate 1*b* defines a second curved arch 1*m* on the lower edge 1*h* of the second side plate 1*b*. The second curved arch 1*m* extends upwards towards the second side plate upper edge 1*o*.

Each of the wheels 1002 is rotatable about one of four axes of rotation 1004 illustrated in FIG. 11. The four axes of rotation 1004 are coincident with and define a mathematical plane 1005. The four wheels 1002 are configured to engage a surface, for example, the horizontal surface and to support the opposing first side plate 1*a* and second side plate 1*b* above the surface. Also, as illustrated in FIG. 11, a first mathematical line 1*i* tangent to the first curved arch 1*k* and parallel to the mathematical plane 1005 is disposed above the mathematical plane 1005 when the four wheels 1002 engage the surface and support the first side plate 1*a* and the second side plate 1*b* above the surface. A second mathematical line 1*j* tangent to the second curved arch 1*m* and parallel to the mathematical plane 1005 is disposed above the mathematical plane 1005 when the four wheels 1002 engage the surface and support the first side plate 1*a* and the second side plate 1*b* above the surface. The lifting pad 802, as illustrated in FIG. 11 is supported by the opposing first side plate 1*a* and the second side plate 1*b*. The lifting pad 802 has a configuration to selectably lift a load above the surface, for example, the horizontal surface when the four wheels engage the surface.

Figure 12:
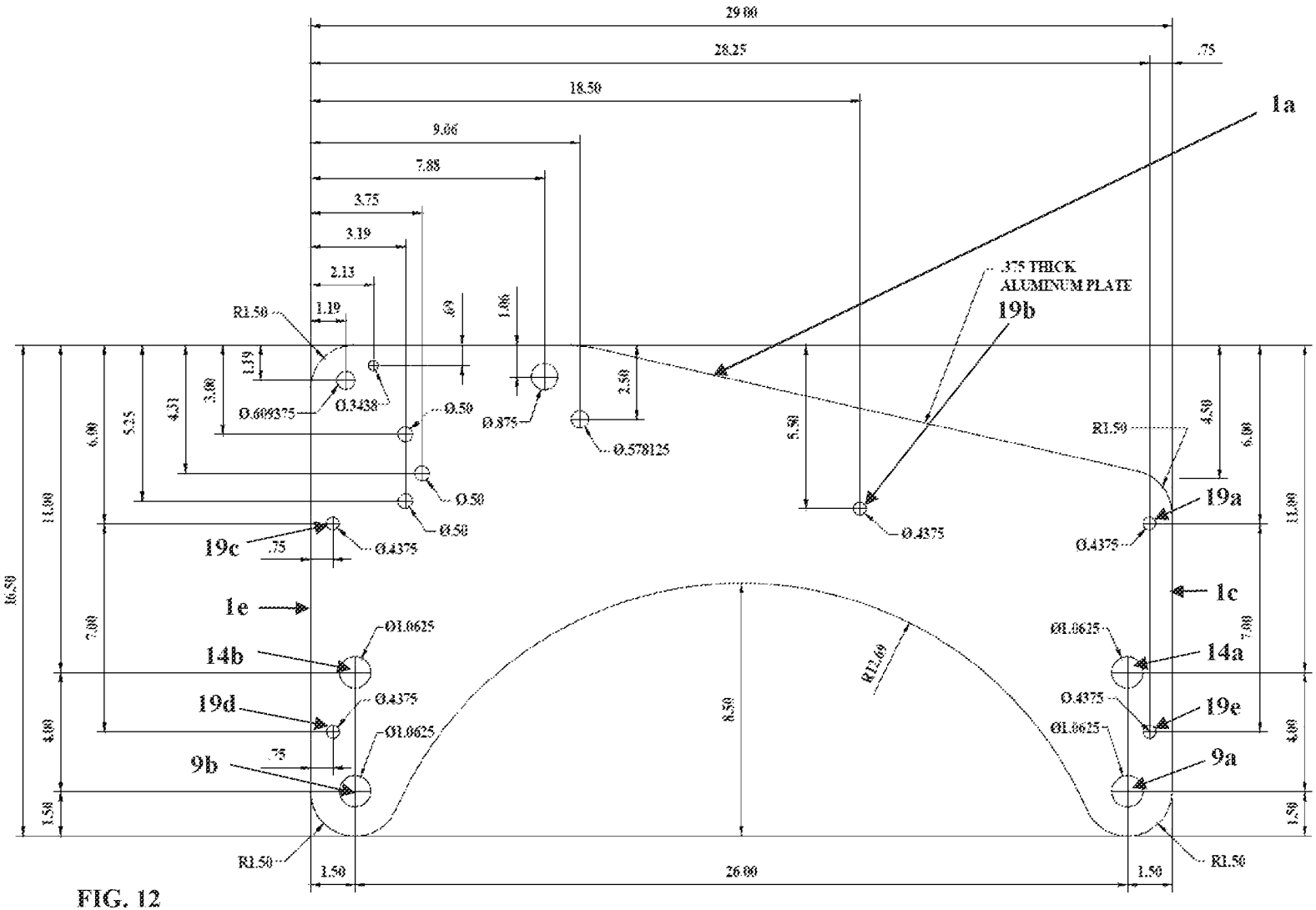
FIG. 12 exemplarily illustrates a dimensional drawing of an arched side plate of the frame of the floor jack, according to the first embodiment herein.

FIG. 12 exemplarily illustrates a dimensional drawing of the arched side plate 1*a* of the frame 100 of the floor jack 1000 shown in FIGS. 10A-10B and FIG. 11, according to the first embodiment herein. The frame 100 of the floor jack 1000 comprises a pair of arched side plates 1*a* and 1*b*. The arched side plate 1*b* is a replica of the arched side plate 1*a* exemplarily illustrated in FIG. 12. The arched side plate 1*b* is illustrated in FIGS. 5-7. Each of the arched side plates 1*a* and 1*b* is, for example, about 29 inches long. The width of the arched side plate 1*a* at the front end 1*c* is, for example, about 12 inches. The width of the arched side plate 1*a* at the rear end 1*e* is, for example, about 16.5 inches. As exemplarily illustrated in FIG. 12, the arched side plate 1*a* comprises a lower axle hole 9*a* and an upper axle hole 14*a* at the front end 1*c* of the arched side plate 1*a*, and a lower axle hole 9*b* and an upper axle hole 14*b* at the rear end 1*e* of the arched side plate 1*a*. The arched side plate 1*b* comprises a lower axle hole 9*c* and an upper axle hole 14*c* at the front end 1*d* of the arched side plate 1*b* as exemplarily illustrated in FIGS. 6-7 and FIG. 8A. The arched side plate 1*b* comprises a lower axle hole 9*d* and an upper axle hole 14*d* at the rear end 1*f* of the arched side plate 1*b* as exemplarily illustrated in FIGS. 6-7 and FIG. 8A. The elevation of the lifting pad 802 of the floor jack 1000, above a substantially horizontal surface on which the floor jack 1000 is positioned, is adjustable and configured to be set between an upper position 1503 and a lower position 1501 as exemplarily illustrated in FIG. 15B, by adjusting the position of the teardrop-shaped adjustable shaft collars 15, 16, 17, and 18 to the upper position 1503 or the lower position 1501, with the teardrop-shaped adjustable shaft collars 15, 16, 17, and 18 coinciding with the upper axle holes 14*a*, 14*c*, 14*b*, and 14*d* exemplarily illustrated in FIGS. 6-7 and FIG. 15B, or the lower axle holes 9*a*, 9*c*, 9*b*, and 9*d* exemplarily illustrated in FIG. 5, FIG. 7, and FIG. 8A respectively. The upper axle holes 14*a*, 14*b*, 14*c*, and 14*d* are used for configuring the floor jack 1000 as a mega floor jack. The frame 300 for the mega floor jack is disclosed in the detailed descriptions of FIGS. 33-45. The lower axle holes 9*a*, 9*b*, 9*c*, and 9*d* are used for configuring the frame 100 of the floor jack 1000 with the elevation of the lifting pad 802 as disclosed in the detailed description of FIG. 6 and FIGS. 9A-9B. In an example, the diameter of each of the upper axle holes 14*a*, 14*b*, 14*c*, and 14*d* and each of the lower axle holes 9*a*, 9*b*, 9*c*, and 9*d* is about 1.0625 inches. FIG. 12 also exemplarily illustrates the through holes 19*a*, 19*b*, 19*c*, 19*d*, and 19*e* of the arched side plate 1*a* used for securing the spreader bars 3*a*, 3*b*, 3*c*, 3*d*, and 3*e* exemplarily illustrated in FIG. 7, to the arched side plate 1*a* using the fasteners 11 exemplarily illustrated in FIG. 3. The arched side plate 1*b* comprises the through holes 20*a*, 20*b*, 20*c*, 20*d*, and 20*e* used for securing the spreader bars 3*a*, 3*b*, 3*c*, 3*d*, and 3*e* to the arched side plate 1*b* using the fasteners 11 as exemplarily illustrated in FIG. 3. In an example, the diameter of each of the through holes 19*a*, 19*b*, 19*c*, 19*d*, and 19*e* of the arched side plate 1*a* and each of the through holes 20*a*, 20*b*, 20*c*, 20*d*, and 20*e* of the arched side plate 1*b* is about 0.4375 inches. Exemplary dimensions of the spacings between various holes configured in the arched side plate 1*a* and other exemplary dimensions are illustrated in FIG. 12.

Figure 13:
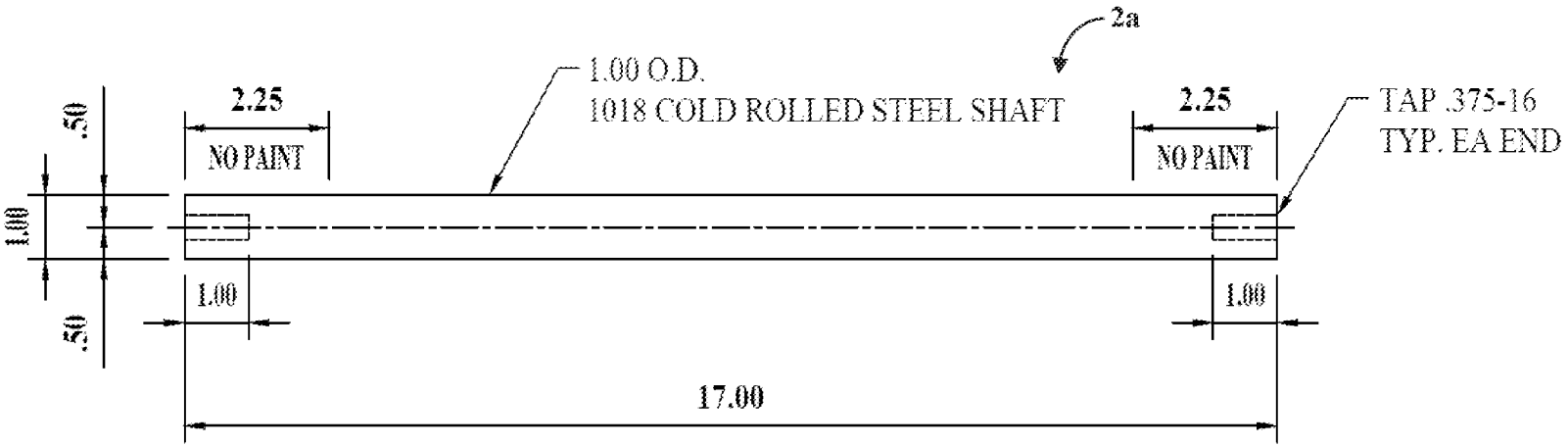
FIG. 13 exemplarily illustrates a dimensional drawing of an axle of the frame of the floor jack, according to the first embodiment herein.

FIG. 13 exemplarily illustrates a dimensional drawing of an axle, that is, the first axle 2*a*, of the frame 100 of the floor jack 1000 shown in FIGS. 10A-10B and FIG. 11, according to the first embodiment herein. The frame 100 of the floor jack 1000 comprises two axles, that is, the first axle 2*a* and the second axle 2*b* as exemplarily illustrated in FIG. 2. The first axle 2*a* is located proximal to the front ends 1*c* and 1*d* of the arched side plates 1*a* and 1*b*, and the second axle 2*b* is located proximal to the rear ends 1*e* and 1*f* of the arched side plates 1*a* and 1*b*. In an embodiment, each of the axles 2*a* and 2*b* is a cold rolled metal shaft. For example, each of the axles 2*a* and 2*b* is a cold rolled steel shaft. Each of the axles 2*a* and 2*b* is, for example, about 17 inches long, having a diameter of about 1 inch. In another embodiment, the length of each of the axles 22*a* and 22*b* is, for example, about 15.75 inches. Other exemplary dimensions of the first axle 2*a*, and in turn, the second axle 2*b* are illustrated in FIG. 13. As exemplarily illustrated in FIG. 7, the two axles 2*a* and 2*b* are located proximal to a lower section of the frame 100. The two axles 2*a* and 2*b* are aligned parallel to each other when the elevation of the frame 100 of the floor jack 1000 is configured to be in either the upper position or in the lower position as exemplarily illustrated in FIGS. 5-6.

FIG. 14 exemplarily illustrates a dimensional drawing of a spreader bar 3*a* of the frame 100 of the floor jack 1000 shown in FIGS. 10A-10B and FIG. 11, according to the first embodiment herein. The spreader bar 3*a* is configured to separate the two arched side plates 1*a* and 1*b* along the length of the arched side plates 1*a* and 1*b* as exemplarily illustrated in FIG. 2, wherein the length of the arched side plates 1*a* and 1*b* is, for example, about 29 inches. In an embodiment, the frame 100 of the floor jack 1000 comprises about five spreader bars 3*a*, 3*b*, 3*c*, 3*d*, and 3*e* as exemplarily illustrated in FIG. 7. In an embodiment, the spreader bars 3*a*, 3*b*, 3*c*, 3*d*, and 3*e* are configured as metal bars, for example, aluminum bars. In an example, each of the spreader bars 3*a*, 3*b*, 3*c*, 3*d*, and 3*e* is about 6.3125 inches long, having an outer diameter of about 1 inch. Other exemplary dimensions of the spreader bar 3*a*, and in turn, each of the other spreader bars 3*b*, 3*c*, 3*d*, and 3*e* are illustrated in FIG. 14. Two of the spreader bars 3*a* and 3*e* are located proximal to the front ends 1*c* and 1*d* of the arched side plates 1*a* and 1*b*, where the spreader bar 3*a* is positioned above the spreader bar 3*e* as exemplarily illustrated in FIG. 7. Another two of the spreader bars 3*c* and 3*d* are located proximal to the rear ends 1*e* and 1*f* of the arched side plates 1*a* and 1*b*, where the spreader bar 3*c* is positioned above the spreader bar 3*d* as exemplarily illustrated in FIG. 7. The spreader bar 3*b* is located between a mid-section of the frame 100 and the front ends 1*c* and 1*d* of the arched side plates 1*a* and 1*b* as exemplarily illustrated in FIGS. 5-6. The positions and the number of the spreader bars 3*a*, 3*b*, 3*c*, 3*d*, and 3*e* are a design choice. In an embodiment, the spreader bars 3*a*, 3*b*, 3*c*, 3*d*, and 3*e* are positioned anywhere between the arched side plates 1*a* and 1*b* based on the design of the lifting mechanism 800 exemplarily illustrated in FIGS. 8A-8B and FIGS. 9A-9B.

Figure 15A:
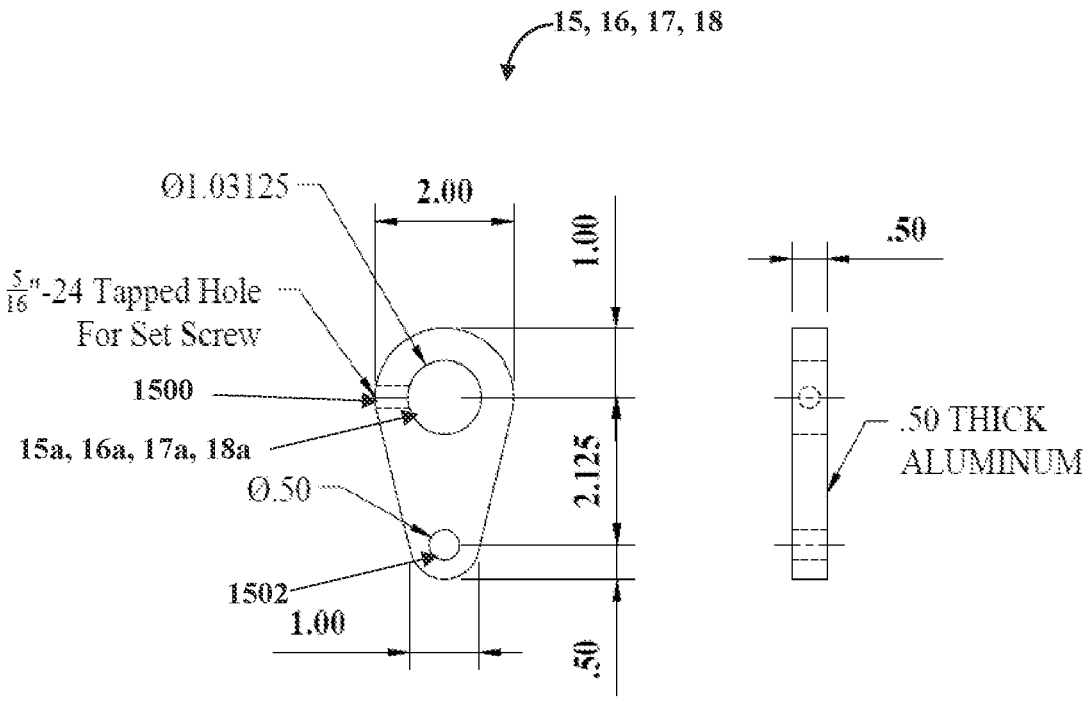
FIG. 15A exemplarily illustrates a dimensional drawing of an adjustable collar of the frame of the floor jack, according to the first embodiment herein.

FIG. 15A exemplarily illustrates a dimensional drawing of an adjustable collar, for example, a teardrop-shaped adjustable shaft collar 15, 16, 17, 18 of the frame 100 of the floor jack 1000 shown in FIGS. 10A-10B and FIG. 11, according to the first embodiment herein. The teardrop-shaped adjustable shaft collars 15, 16, 17, and 18 secure the arched side plates 1*a* and 1*b* of the frame 100 to the axles 2*a* and 2*b* and to the hubs 5, 6, 7 and 8 as exemplarily illustrated in FIG. 2 and FIG. 7. In an example, the thickness of each of the teardrop-shaped adjustable shaft collars 15, 16, 17, and 18 is about 0.5 inches. Each of the teardrop-shaped adjustable shaft collars 15, 16, 17, and 18 is, for example, made of aluminum.

The teardrop-shaped adjustable shaft collars 15, 16, 17, and 18 comprise holes 15*a*, 16*a*, 17*a*, and 18*a* respectively, through which the first axle 2*a* and the second axle 2*b* are inserted for connection to the hubs 5, 6, 7, and 8 as exemplarily illustrated in FIG. 7. That is, the ends 2*c* and 2*d* of the first axle 2*a* are inserted through the holes 15*a* and 16*a* of the teardrop-shaped adjustable shaft collars 15 and 16 respectively, for connecting the arched side plates 1*a* and 1*b* to the first pair of hubs 5 and 6 respectively as exemplarily illustrated in FIG. 7. Similarly, the ends 2*e* and 2*f* of the second axle 2*b* are inserted through the holes 17*a* and 18*a* of the teardrop-shaped adjustable shaft collars 17 and 18 respectively, for connecting the arched side plates 1*a* and 1*b* to the second pair of hubs 7 and 8 respectively as exemplarily illustrated in FIG. 7. In an example, the diameter of each of the holes 15*a*, 16*a*, 17*a*, and 18*a* of the teardrop-shaped adjustable shaft collars 15, 16, 17, and 18 respectively, is about 1.03125 inches. Furthermore, each of the teardrop-shaped adjustable shaft collars 15, 16, 17, and 18 comprises a pivot point 1502 about which each of the teardrop-shaped adjustable shaft collars 15, 16, 17, and 18 pivot to adjust the elevation of the floor jack 1000. In an example, the diameter of the pivot point is about 0.5 inches. In an embodiment, each of the teardrop-shaped adjustable shaft collars 15, 16, 17 and 18 further comprises a tapped hole 1500 for accommodating a set screw (not shown) used for securing the teardrop-shaped adjustable shaft collars 15 and 16 against the first axle 2*a*, and to secure the teardrop-shaped adjustable shaft collars 17 and 18 against the second axle 2*b* as disclosed in the detailed description of FIG. 5. The tapped hole 1500 is, for example, a 5/16-inch tapped hole. Other exemplary dimensions of each of the teardrop-shaped adjustable shaft collars 15, 16, 17, and 18 are illustrated in FIG. 15A.

Figure 15B:
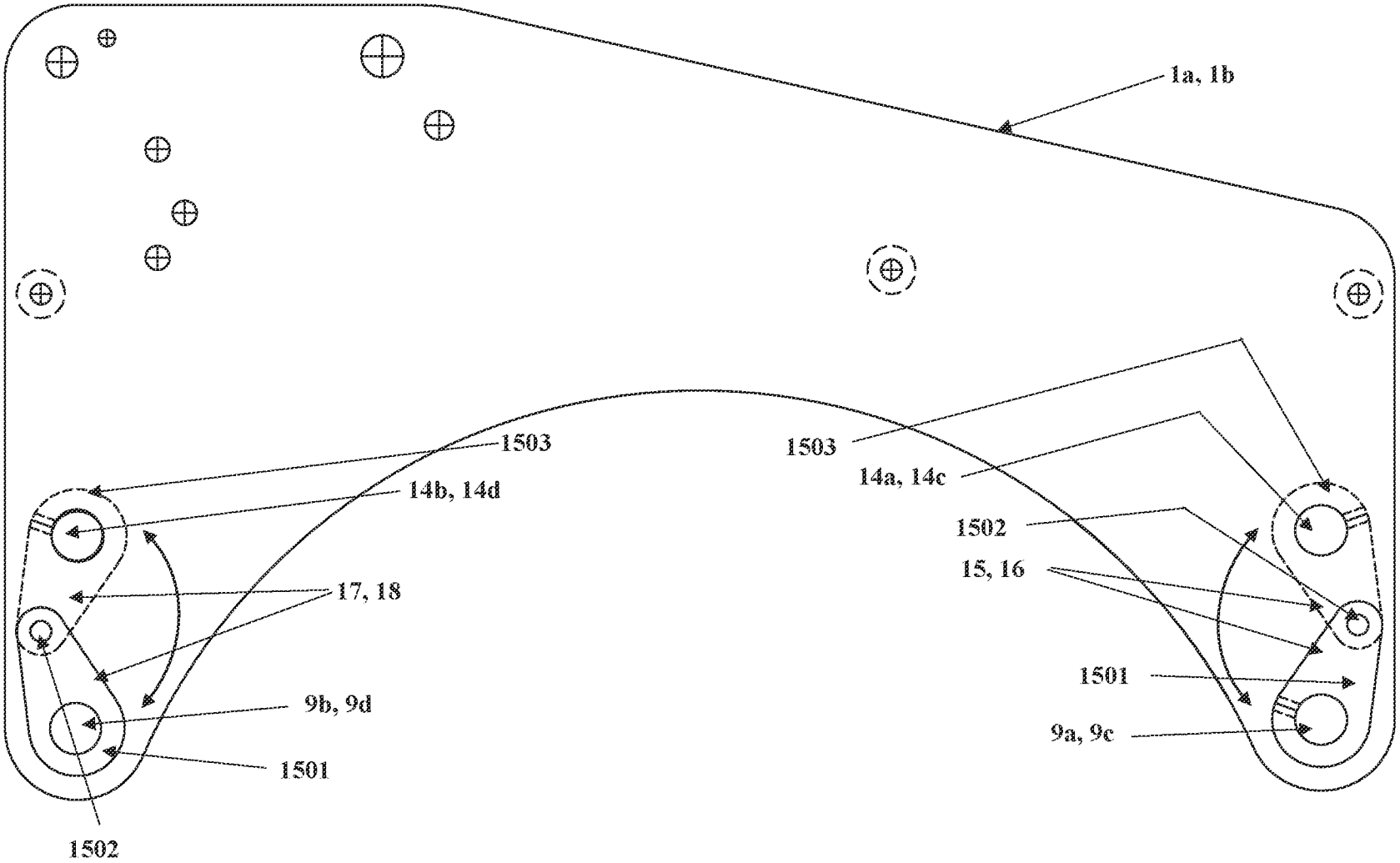
FIG. 15B exemplarily illustrates positional settings of the adjustable collar of the frame of the floor jack, according to the first embodiment herein.

FIG. 15B exemplarily illustrates positional settings of each of the adjustable collars, for example, the teardrop-shaped adjustable shaft collars 15, 16, 17, and 18 of the frame 100 of the floor jack 1000 shown in FIGS. 10A-10B and FIG. 11, according to the first embodiment herein. The upper axle holes 14*a*, 14*b*, 14*c*, and 14*d* and the lower axle holes 9*a*, 9*b*, 9*c*, and 9*d* of the arched side plates 1*a* and 1*b* corresponding to the upper position 1503 and the lower position 1501 of the teardrop-shaped adjustable shaft collars 15, 16, 17, and 18 respectively, allow adjustment of the elevation of the lifting pad 802 of the floor jack 1000 exemplarily illustrated in FIGS. 8A-8B and FIGS. 9A-9B. As exemplarily illustrated in FIG. 15B, the teardrop-shaped adjustable shaft collars 15, 16, 17, and 18 pivot on a plane of the arched side plates 1*a* and 1*b* about their pivot points 1502 to switch between a lower position 1501 and an upper position 1503 to adjust the elevation of the lifting pad 802 of the floor jack 1000.

Figure 16:
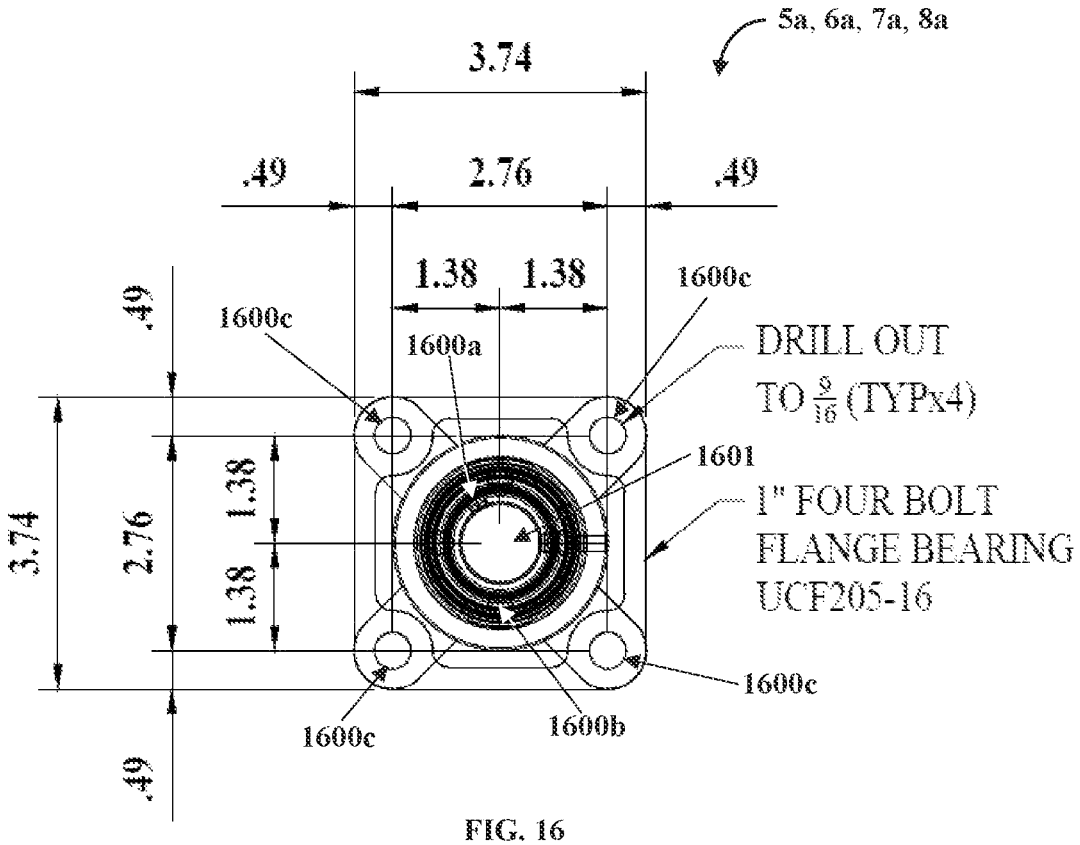
FIG. 16 exemplarily illustrates a dimensional drawing of a four-bolt flange bearing of each hub of the frame of the floor jack, according to the first embodiment herein.

FIG. 16 exemplarily illustrates a dimensional drawing of a four-bolt flange bearing 5*a*, 6*a*, 7*a*, 8*a* of each hub 5, 6, 7, 8 of the frame 100 of the floor jack 1000 shown in FIG. 7, FIGS. 10A-10B, and FIG. 11. The four-bolt flange bearings 5*a*, 6*a*, 7*a*, and 8*a* are part of their respective hubs 5, 6, 7, and 8 as exemplarily illustrated in FIG. 2 and FIG. 7. In an embodiment, each of the four-bolt flange bearings 5*a*, 6*a*, 7*a*, and 8*a* is square-shaped with each side measuring, for example, about 3.74 inches. The four hubs 5, 6, 7, and 8 are secured to the axles 2*a* and 2*b* using one or more set screws 1600*a* and 1600*b*, each inserted into an individual tapped hole (not shown) in each of the four-bolt flange bearings 5*a*, 6*a*, 7*a*, and 8*a* of the four hubs 5, 6, 7, and 8 respectively. Each of the four-bolt flange bearings 5*a*, 6*a*, 7*a*, and 8*a* further comprises drill holes 1600*c* drilled out, for example, to about 9/16 inches, for securing the four-bolt flange bearings 5*a*, 6*a*, 7*a*, and 8*a* to the respective spacer plates 5*b*, 6*b*, 7*b*, and 8*b* and end plates 5*c*, 6*c*, 7*c*, and 8*c* of their respective hubs 5, 6, 7, and 8 using fasteners (not shown) as exemplarily illustrated in FIG. 7. The four-bolt flange bearings 5*a*, 6*a*, 7*a*, and 8*a* further comprise center holes 1601 coaxial to the holes 15*a*, 16*a*, 17*a*, and 18*a* of the teardrop-shaped adjustable shaft collars 15, 16, 17, and 18 respectively, exemplarily illustrated in FIG. 15A. The center holes 1601 of the four-bolt flange bearings 5*a*, 6*a*, 7*a*, and 8*a* allow connection of the ends 2*c*, 2*d*, and 2*e*, 2*f* of the axles 2*a* and 2*b* respectively, to the respective hubs 5, 6, 7, and 8 as exemplarily illustrated in FIG. 7. Other exemplary dimensions of each of the four-bolt flange bearings 5*a*, 6*a*, 7*a*, and 8*a* are illustrated in FIG. 16.

Figure 17:
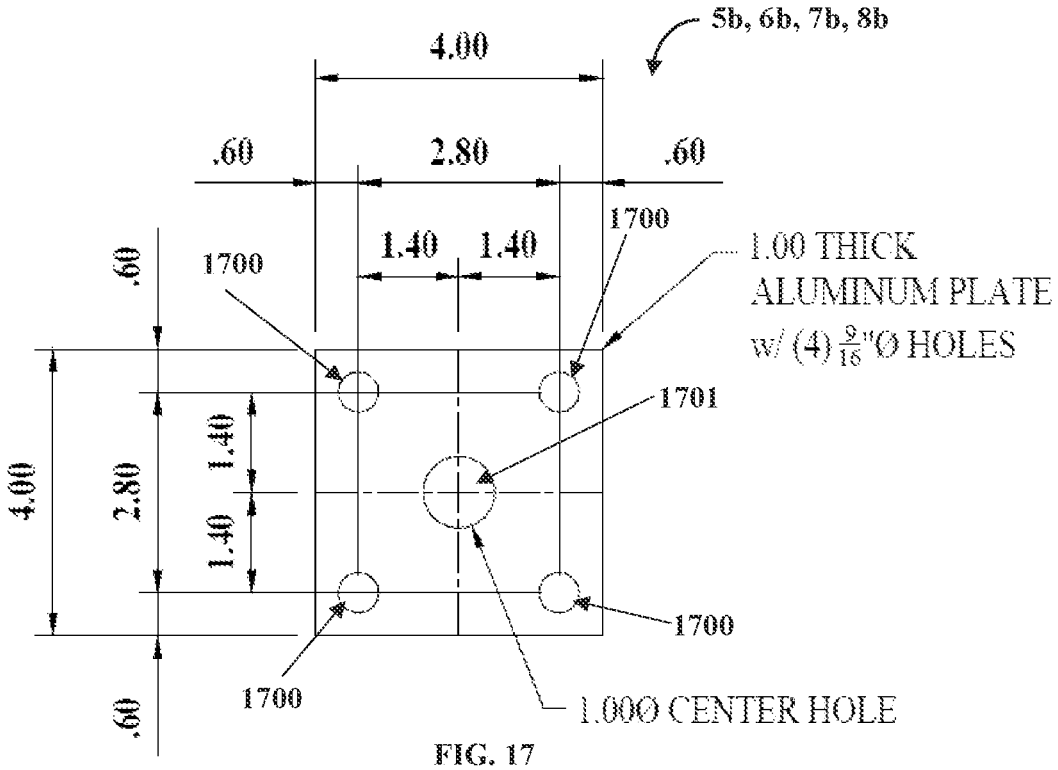
FIG. 17 exemplarily illustrates a dimensional drawing of a spacer plate of each hub of the frame of the floor jack, according to the first embodiment herein.

FIG. 17 exemplarily illustrates a dimensional drawing of a spacer plate 5*b*, 6*b*, 7*b*, 8*b* of each hub 5, 6, 7, 8 of the frame 100 of the floor jack 1000 shown in FIG. 7, FIGS. 10A-10B, and FIG. 11, according to the first embodiment herein. The spacer plates 5*b*, 6*b*, 7*b*, and 8*b* are part of their respective hubs 5, 6, 7, and 8 as exemplarily illustrated in FIG. 2 and FIG. 7. The spacer plates 5*b*, 6*b*, 7*b*, and 8*b* are thick metal spacer plates, for example, made of aluminum. In an embodiment, each of the thick metal spacer plates 5*b*, 6*b*, 7*b*, and 8*b* is square-shaped, with each side measuring, for example, about 4 inches in width and about 1.25 inches in thickness. Each of the thick metal spacer plates 5*b*, 6*b*, 7*b*, and 8*b* comprises four holes 1700 corresponding to the holes 1600*c* of each of the four-bolt flange bearings 5*a*, 6*a*, 7*a*, and 8*a*. In an example, the diameter of each of the holes 1700 is 9/16 inches. A thick metal spacer plate, for example, 5*b*, of the hub 5 is secured to the four-bolt flange bearing 5*a* of the hub 5 by using nuts and bolts inserted into the four holes 1700 of the thick metal spacer plate 5*b* and the corresponding four holes 1600*c* of the four-bolt flange bearing 5*a*. Similarly, the thick metal spacer plates 6*b*, 7*b*, and 8*b* of the hubs 6, 7, and 8 respectively, are secured to the respective four-bolt flange bearings 6*a*, 7*a*, and 8*a* of their respective hubs 6, 7, and 8 by using nuts and bolts inserted into the four holes 1700 of the thick metal spacer plates 6*b*, 7*b*, and 8*b* and the corresponding four holes 1600*c* of the four-bolt flange bearings 6*a*, 7*a*, and 8*a*. The spacer plates 5*b*, 6*b*, 7*b*, and 8*b* further comprise center holes 1701 coaxial to the holes 15*a*, 16*a*, 17*a*, and 18*a* of the teardrop-shaped adjustable shaft collars 15, 16, 17, and 18 respectively, exemplarily illustrated in FIG. 15A, and to the center holes 1601 of the four-bolt flange bearings 5*a*, 6*a*, 7*a*, and 8*a* respectively, exemplarily illustrated in FIG. 16. The center holes 1701 of the spacer plates 5*b*, 6*b*, 7*b*, and 8*b* allow connection of the ends 2*c*, 2*d*, and 2*e*, 2*f* of the axles 2*a* and 2*b* respectively, to the respective hubs 5, 6, 7, and 8 as exemplarily illustrated in FIG. 7. In an example, the diameter of the center hole 1701 of each of the spacer plates 5*b*, 6*b*, 7*b*, and 8*b* is about 1 inch. Other exemplary dimensions of each of the spacer plates 5*b*, 6*b*, 7*b*, and 8*b* are illustrated in FIG. 17.

FIG. 18 exemplarily illustrates a dimensional drawing of an end plate 5*c*, 6*c*, 7*c*, 8*c* of each hub 5, 6, 7, 8 of the frame 100 of the floor jack 1000 shown in FIG. 7, FIGS. 10A-10B, and FIG. 11, according to the first embodiment herein. The end plates 5*c*, 6*c*, 7*c*, and 8*c* are part of their respective hubs 5, 6, 7, and 8 as exemplarily illustrated in FIG. 2 and FIG. 7. The end plates 5*c*, 6*c*, 7*c*, and 8*c* are thick metal end plates, for example, made of aluminum. In an embodiment, each of the thick metal end plates 5*c*, 6*c*, 7*c*, and 8*c* is square-shaped with each side measuring, for example, about 4 inches. Furthermore, each of the thick metal end plates 5*c*, 6*c*, 7*c*, and 8*c* is, for example, about 0.25 inches thick and comprises holes 1800, each with a diameter of, for example, about 9/16 inches. The holes 1800 of each of the thick metal end plates 5*c*, 6*c*, 7*c*, and 8*c* are coaxial to the holes 1600*c* of the respective four-bolt flange bearings 5*a*, 6*a*, 7*a*, and 8*a* exemplarily illustrated in FIG. 16 and to the holes 1700 of the respective spacer plates 5*b*, 6*b*, 7*b*, and 8*b* exemplarily illustrated in FIG. 17. The hubs 5, 6, 7, and 8 exemplarily illustrated in FIGS. 6-7 are formed by inserting fasteners (not shown), for example, bolts, through the holes 1600*c* of each of the four-bolt flange bearings 5*a*, 6*a*, 7*a*, and 8*a*, the holes 1700 of the respective spacer plates 5*b*, 6*b*, 7*b*, and 8*b*, and the holes 1800 of the respective thick metal end plates 5*c*, 6*c*, 7*c*, and 8*c*. The axles 2*a* and 2*b* connect the arched side plates 1*a* and 1*b* to the hubs 5, 6, 7, and 8 as exemplarily illustrated in FIGS. 6-7 and as disclosed in the detailed descriptions of FIG. 15A and FIGS. 16-17. Other exemplary dimensions of each of the thick metal end plates 5*c*, 6*c*, 7*c*, and 8*c* are illustrated in FIG. 18.

FIG. 19 indicates exemplary sizes of a tire-wheel assembly 1003 of the frame 100 of the floor jack 1000 shown in FIGS. 10A-10B and FIG. 11, according to the first embodiment herein. The tire-wheel assembly 1003 comprises a tire 1001 and a wheel/rim 1002 as exemplarily illustrated in FIGS. 10A-10B and FIG. 11. In an example, the width of the tire 1001 is about 4 inches and aspect ratio of the tire 1001 is about 4 inches. In an example, the tire-wheel assembly 1003 has a lime squeeze powder coating finish. The frame 100 of the floor jack 1000 of the first embodiment is used with a tire 1001 and wheel/rim 1002 combination in a range of, for example, about 3½-inch diameters up to 25½-inch diameters. The minimum height of the lifting pad 802 exemplarily illustrated in FIGS. 10A-10B and FIG. 11, above a substantially horizontal surface on which the floor jack 1000 is positioned, with a 3½-inch diameter wheel/rim 1002 is, for example, about 14¼ inches, and the maximum height of the lifting pad 802 above the substantially horizontal surface on which the floor jack 1000 is positioned is, for example, about 29¾ inches. With a 25½-inch diameter wheel/rim 1002, the minimum height of the lifting pad 802 above the substantially horizontal surface on which the floor jack 1000 is positioned is, for example, about 25¼ inches, and the maximum height of the lifting pad 802 above the substantially horizontal surface on which the floor jack 1000 is positioned is, for example, about 40¾ inches.

FIGS. 20-32 exemplarily illustrate a second embodiment of a frame 200 for a floor jack 1000 shown in FIGS. 10A-10B and FIG. 11. In the second embodiment, the frame 200 is configured for a fixed height floor jack. In the second embodiment, the frame 200 comprises non-adjustable shaft collars 25, 26, 27, and 28 in lieu of the teardrop-shaped adjustable shaft collars 15, 16, 17, and 18 of the frame 100 exemplarily illustrated in FIG. 2 and FIG. 7. The set of parts in the second embodiment of the frame 200 is the same as the parts of the first embodiment of the frame 100 except that the teardrop-shaped adjustable shaft collars 15, 16, 17, and 18 of the frame 100 are replaced with fixed or non-adjustable shaft collars 25, 26, 27, and 28 in the frame 200. FIG. 20 is a tabulation of different parts of the frame 200 of the floor jack 1000, according to the second embodiment herein.

Figure 21:
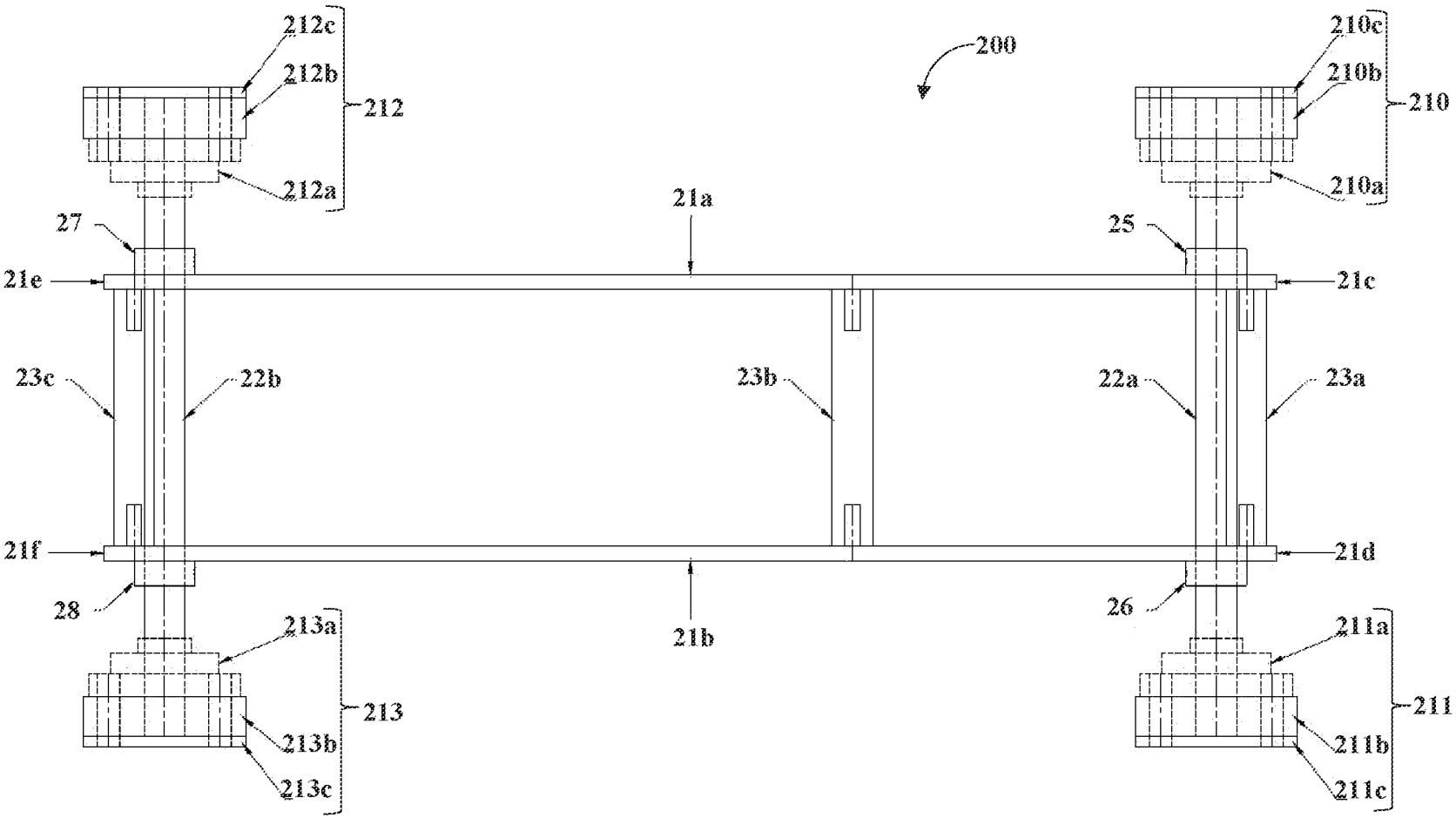
FIG. 21 exemplarily illustrates a top view of the frame of the floor jack, according to the second embodiment herein.

FIG. 21 exemplarily illustrates a top view of the frame 200 of the floor jack 1000 shown in FIGS. 10A-10B and FIG. 11, according to the second embodiment herein. The frame 200 comprises the following parts: a pair of arched side plates 21*a* and 21*b*, a first pair of hubs 210 and 211, a second pair of hubs 212 and 213, a first axle 22*a*, a second axle 22*b*, non-adjustable shaft collars 25, 26, 27, and 28, and a set of spreader bars 23*a*, 23*b*, and 23*c* as exemplarily illustrated in FIGS. 21-24. In an embodiment, the pair of arched side plates 21*a* and 21*b* is made of thick metal and is powder coated. The structure and function of the parts of the frame 200 of the second embodiment are similar to the structure and function of the corresponding parts of the frame 100 of the first embodiment as disclosed in the detailed description of FIG. 2.

The first axle 22*a* connects the pair of arched side plates 21*a* and 21*b* to the first pair of hubs 210 and 211 at the front ends 21*c* and 21*d* respectively, using a first pair of non-adjustable collars 25 and 26. The second axle 22*b* connects the pair of arched side plates 21*a* and 21*b* to the second pair of hubs 212 and 213 at the rear ends 21*e* and 21*f* respectively, using a second pair of non-adjustable collars 27 and 28. In an embodiment, the first pair of non-adjustable collars 25 and 26 and the second pair of non-adjustable collars 27 and 28 are fixed metal shaft collars, for example, made of aluminum. The aluminum or other metal, non-adjustable shaft collars 25, 26, 27, and 28 of the frame 200 are used to secure the arched side plates 21*a* and 21*b* to the axles 22*a* and 22*b*, and to the hubs 210, 211, 212, and 213 at the front ends 21*c* and 21*d* and the rear ends 21*e* and 21*f* of the arched side plates 21*a* and 21*b*. In an example, each of the non-adjustable shaft collars 25, 26, 27, and 28 is about 1 inch in diameter. In an embodiment, each of the non-adjustable shaft collars 25, 26, 27, and 28 is powder coated. An example of the non-adjustable shaft collars 25, 26, 27, and 28 used in the frame 200 is McMaster-Carr® Part #9946K24 of McMaster-Carr Supply Company. In the second embodiment, the axles 22*a* and 22*b* of the frame 200 for the fixed height floor jack are lowered, for example, by about 6 inches. The frame 200 spreads the center to the center of the axles 22*a* and 22*b*, for example, by about 5½ inches compared to conventional floor jacks in the market.

The frame 200 further comprises a set of tire-wheel assemblies (not shown) similar to the tire-wheel assemblies 1003 exemplarily illustrated in FIGS. 10A-10B and FIG. 11. The tire-wheel assemblies are connected to the hubs 210, 211, 212, and 213 to provide mobility to the floor jack 1000 when the floor jack 1000 is assembled. When the frame 200 for the floor jack 1000 is used, for example, with a 5.70-inch to 8-inch tire 1001 and 8 inches—4 on 4-inch wheel/rim 1002, the top of the lifting pad 802 of the floor jack 1000 exemplarily illustrated in FIGS. 10A-10B and FIG. 11, above a substantially horizontal surface on which the floor jack 1000 is positioned, will be at a height of, for example, about 32.5 inches. With reference to the 5.70-inch to 8-inch tire 1001 disclosed above, 5.70 inches is the width of the tire 1001 and 8 inches is the diameter of both the tire 1001 and the wheel/rim 1002. Each of the hubs 210, 211, 212, and 213 comprises a set of parts. That is, the hubs 210, 211, 212, and 213 comprise four-bolt flange bearing 210*a*, 211*a*, 212*a*, and 213*a*, thick metal spacer plates 210*b*, 211*b*, 212*b*, and 213*b*, and thick metal end plates 210*c*, 211*c*, 212*c*, and 213*c* respectively, as exemplarily illustrated in FIG. 21. The hubs 210, 211, 212, and 213 further comprise fasteners (not shown). In the second embodiment, the frame 200 comprises about three spreader bars 23*a*, 23*b*, and 23*c*. The structure and the placement of the spreader bars 23*a*, 23*b*, and 23*c* of the frame 200 in the second embodiment are similar to the structure and the placement of the spreader bars 3*a*, 3*b*, and 3*c* of the frame 100 in the first embodiment as exemplarily illustrated in FIG. 2 and FIGS. 5-7.

Figure 22:
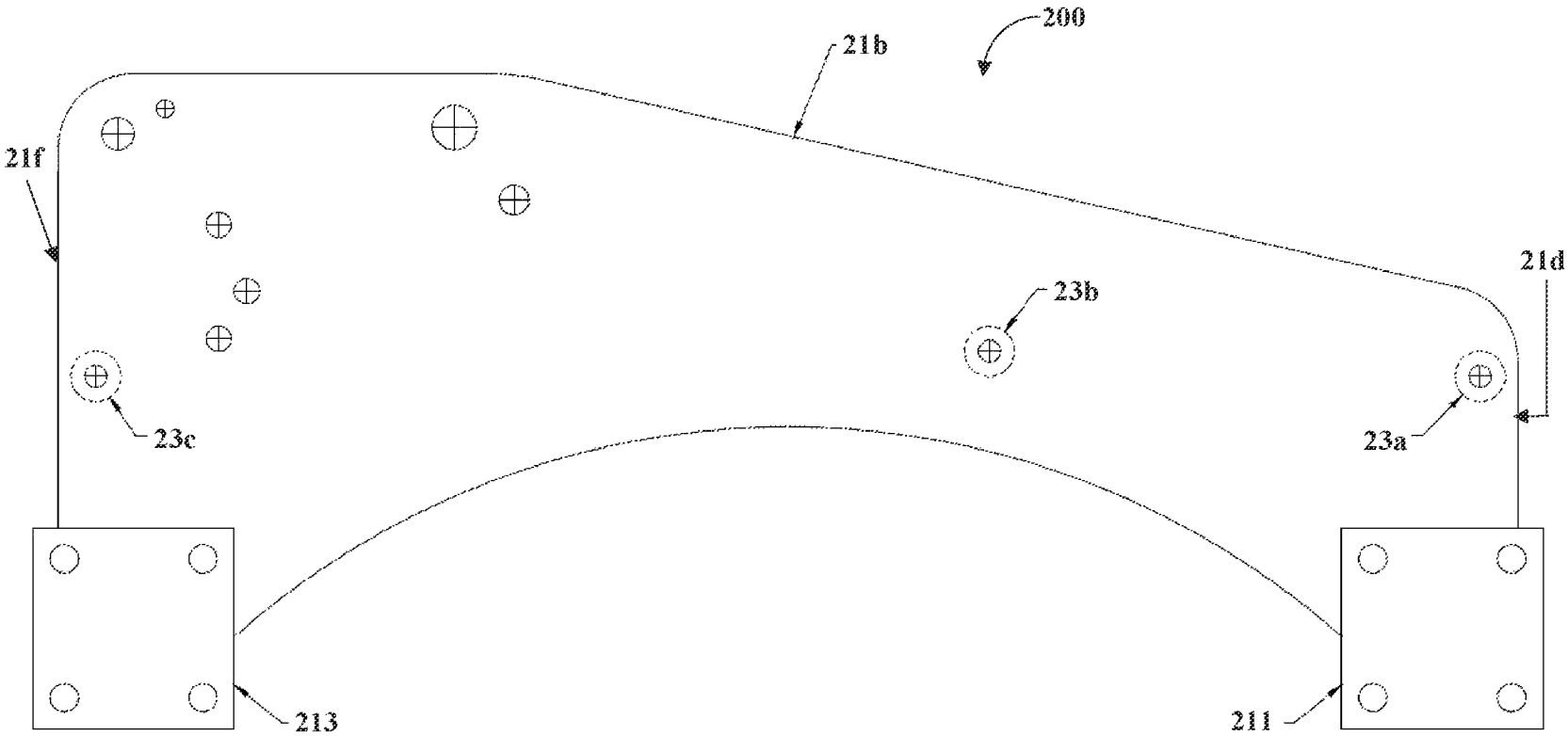
FIG. 22 exemplarily illustrates a side view of the frame of the floor jack, according to the second embodiment herein.

FIG. 22 exemplarily illustrates a side view of the frame 200 of the floor jack 1000 shown in FIGS. 10A-10B and FIG. 11, according to the second embodiment herein. The structure and the function of the parts of the frame 200, for example, the hubs 211 and 213, the spreader bars 23*a*, 23*b*, and 23*c*, etc., shown in FIG. 22 are similar to the structure and the function of the corresponding parts of the frame 100 disclosed in the detailed description of FIG. 3.

Figure 23:
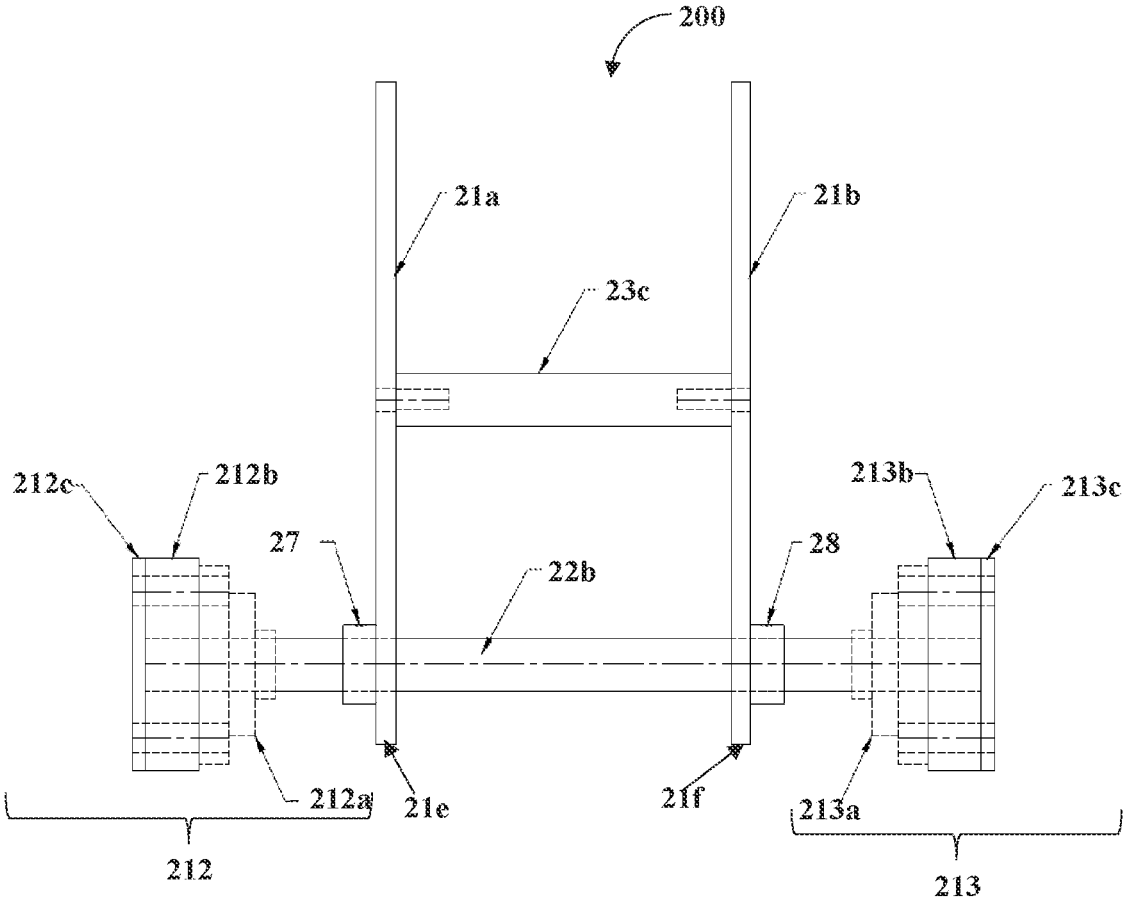
FIG. 23 exemplarily illustrates a rear view of the frame of the floor jack, according to the second embodiment herein.

FIG. 23 exemplarily illustrates a rear view of the frame 200 of the floor jack 1000 shown in FIGS. 10A-10B and FIG. 11, according to the second embodiment herein. The structure and the function of the parts of the frame 200, for example, the arched side plates 21*a* and 21*b*, the second axle 22*b*, the hubs 212 and 213, the spreader bar 23*c*, etc., shown in FIG. 23 are similar to the structure and the function of the corresponding parts of the frame 100 disclosed in the detailed description of FIG. 4.

Figure 24:
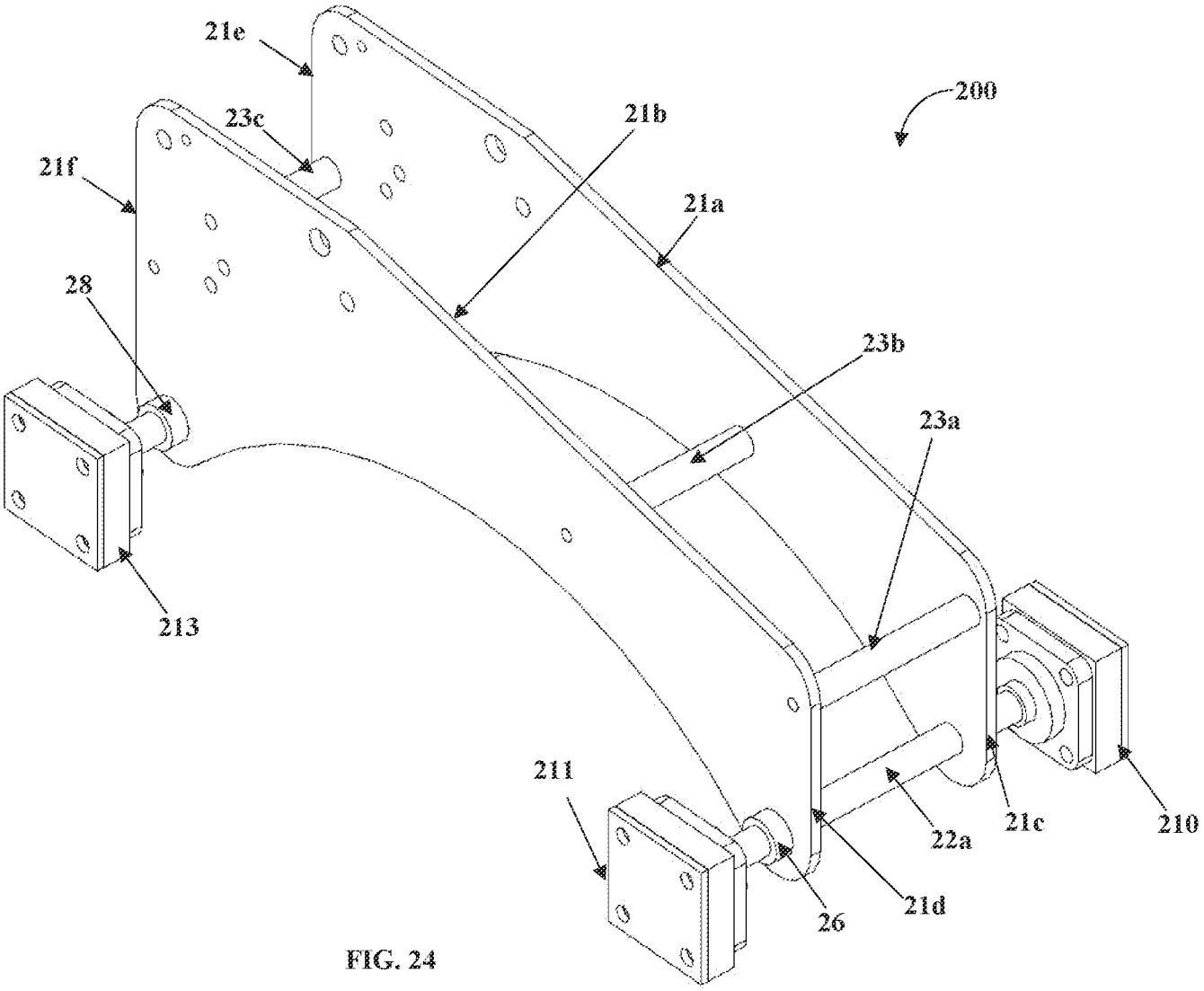
FIG. 24 exemplarily illustrates a perspective view of the frame of the floor jack, according to the second embodiment herein.

FIG. 24 exemplarily illustrates a perspective view of the frame 200 of the floor jack 1000 shown in FIGS. 10A-10B and FIG. 11, according to the second embodiment herein. The structure and the function of the parts of the frame 200 shown in FIG. 24 are similar to the structure and the function of the corresponding parts of the frame 100 disclosed in the detailed description of FIG. 6.

Figure 25:
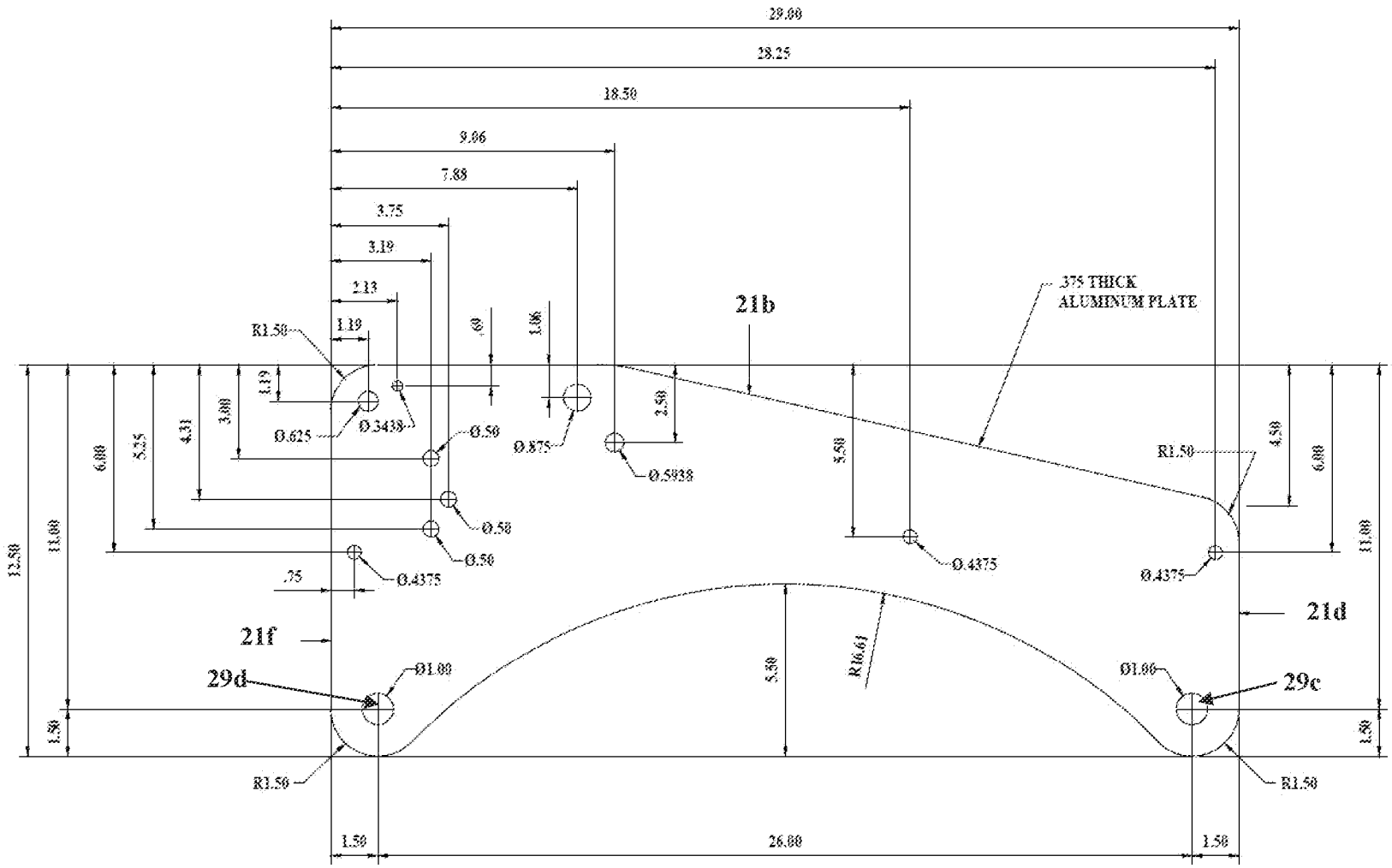
FIG. 25 exemplarily illustrates a dimensional drawing of an arched side plate of the frame of the floor jack, according to the second embodiment herein.

FIG. 25 exemplarily illustrates a dimensional drawing of the arched side plate 21*b* of the frame 200 of the floor jack 1000 shown in FIGS. 10A-10B and FIG. 11, according to the second embodiment herein. The arched side plate 21*b* is a replica of the arched side plate 21*a* exemplarily illustrated in FIG. 24. The structure and the function of the arched side plates 21*a* and 21*b* of the frame 200 are similar to the structure and the function of the corresponding parts of the frame 100 disclosed in the detailed description of FIG. 12. As exemplarily illustrated in FIG. 25, the arched side plate 21*b* comprises lower axle holes 29*c* and 29*d*. The arched side plate 21*a* also comprises lower axle holes (not shown). The width of the arched side plate 21*b* at the front end 21*d* is, for example, about 8 inches. The width of the arched side plate 21*b* at the rear end 21*f* is, for example, about 12.5 inches.

Figure 26:
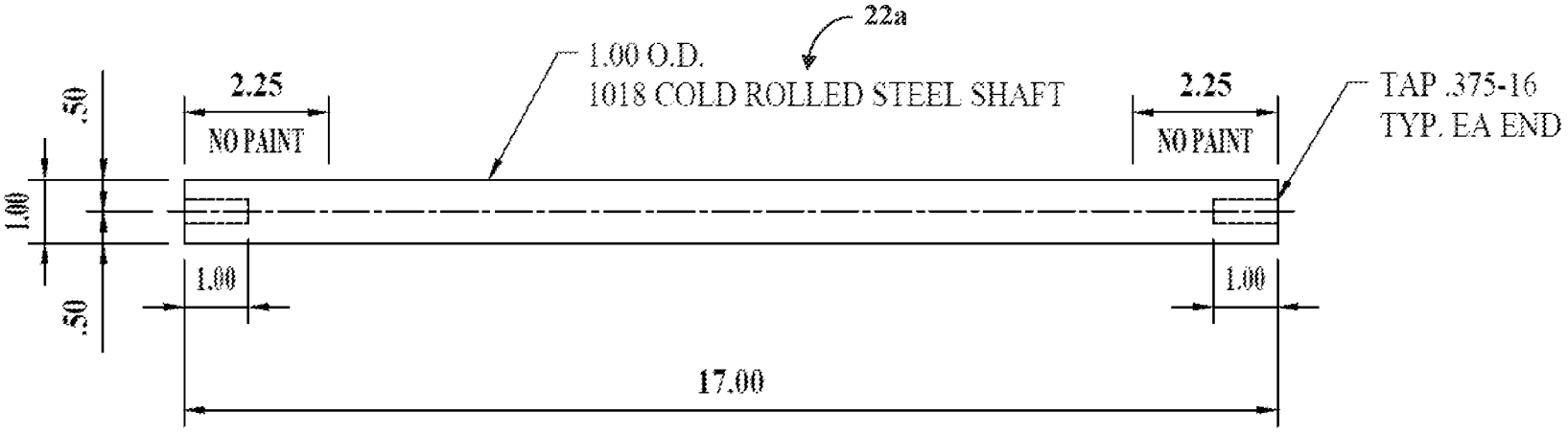
FIG. 26 exemplarily illustrates a dimensional drawing of an axle of the frame of the floor jack, according to the second embodiment herein.

FIG. 26 exemplarily illustrates a dimensional drawing of the axle 22*a* of the frame 200 of the floor jack 1000 shown in FIGS. 10A-10B and FIG. 11, according to the second embodiment herein. The axle 22*b* is a replica of the axle 22*a* exemplarily illustrated in FIG. 21 and FIG. 23. The structure and the function of the axles 22*a* and 22*b* of the frame 200 are similar to the structure and the function of the axles 2*a* and 2*b* of the frame 100 disclosed in the detailed description of FIG. 13. The length of each of the axles 22*a* and 22*b* is, for example, about 17 inches. In an embodiment, the length of each of the axles 22*a* and 22*b* is, for example, about 15.75 inches.

Figure 27:
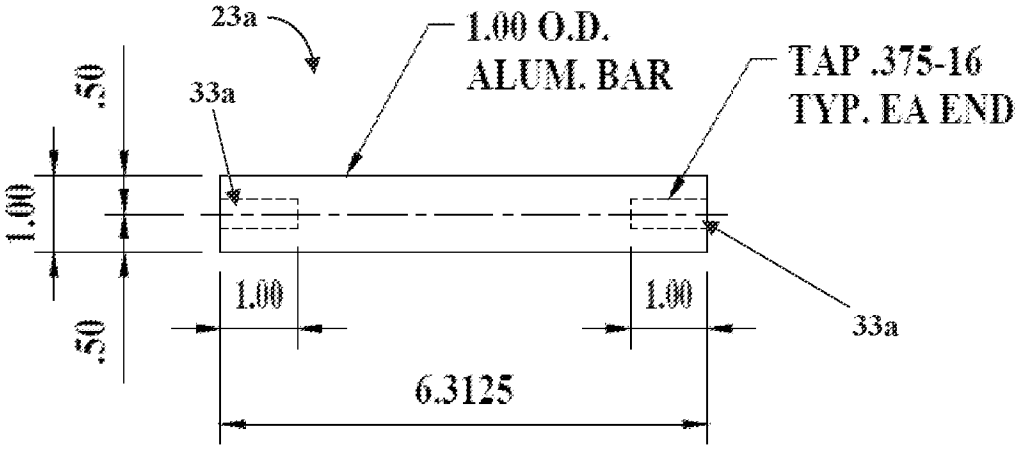
FIG. 27 exemplarily illustrates a dimensional drawing of a spreader bar of the frame of the floor jack, according to the second embodiment herein.

FIG. 27 exemplarily illustrates a dimensional drawing of the spreader bar 23*a* of the frame 200 of the floor jack 1000 shown in FIGS. 10A-10B and FIG. 11, according to the second embodiment herein. The spreader bars 23*b* and 23*c* are replicas of the spreader bar 23*a*. The structure and the function of the spreader bars 23*a*, 23*b*, and 23*c* of the frame 200 are similar to the structure and the function of the spreader bars 3*a*, 3*b*, 3*c*, 3*d*, and 3*e* of the frame 100 disclosed in the detailed description of FIG. 14. As exemplarily illustrated in FIG. 27, the spreader bar 23*a* of the frame 200 comprises threaded holes 33*a* on both ends thereof corresponding to the threaded holes 13*a* on the ends of the spreader bar 2*a* of the frame 100 exemplarily illustrated in FIG. 14.

Figure 28:
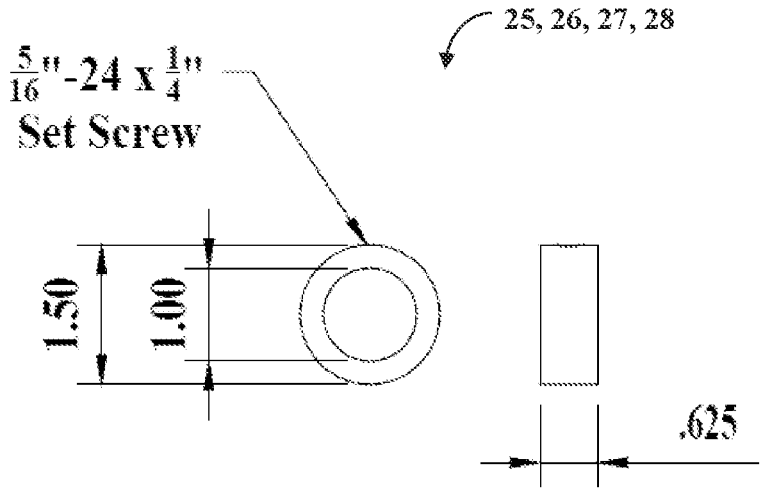
FIG. 28 exemplarily illustrates a dimensional drawing of a non-adjustable collar of the frame of the floor jack, according to the second embodiment herein.

FIG. 28 exemplarily illustrates a dimensional drawing of a non-adjustable collar 25, 26, 27, 28 of the frame 200 of the floor jack 1000 shown in FIGS. 10A-10B and FIG. 11, according to the second embodiment herein. The non-adjustable collars 25, 26, 27, and 28 are fixed shaft collars that secure the arched side plates 21*a* and 21*b* to the axles 22*a* and 22*b*, and to the hubs 210, 211, 212, and 213 at the front ends 21*c* and 21*d* and the rear ends 21*e* and 21*f* of the arched side plates 21*a* and 21*b* as exemplarily illustrated in FIG. 21. In an embodiment, the fixed shaft collars 25, 26, 27, and 28 are generally circular shaped. In an example, the inner diameter and the outer diameter of each of the four fixed shaft collars 25, 26, 27, and 28 are about 1 inch and about 1.5 inches respectively. The fixed shaft collars 25, 26, 27, and 28 have a thickness of about 0.625 inches.

Figure 29:
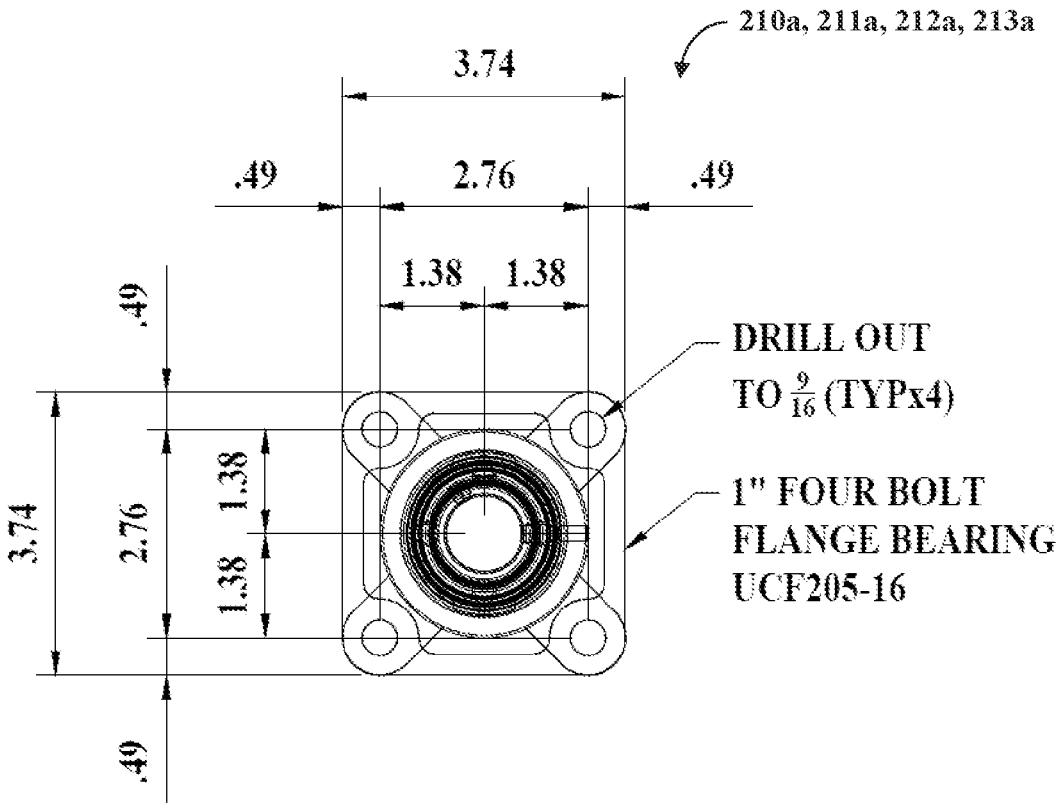
FIG. 29 exemplarily illustrates a dimensional drawing of a four-bolt flange bearing of each hub of the frame of the floor jack, according to the second embodiment herein.

FIG. 29 exemplarily illustrates a dimensional drawing of the four-bolt flange bearing 210*a*, 211*a*, 212*a*, 213*a* of each hub 210, 211, 212, 213 respectively, of the frame 200 of the floor jack 1000 shown in FIGS. 10A-10B and FIG. 11, according to the second embodiment herein. The structure and the function of the four-bolt flange bearings 210*a*, 211*a*, 212*a*, and 213*a* of the hubs 210, 211, 212, and 213 respectively, of the frame 200 are similar to the structure and the function of the four-bolt flange bearings 5*a*, 6*a*, 7*a*, and 8*a* of their respective hubs 5, 6, 7, and 8 of the frame 100 disclosed in the detailed description of FIG. 16.

Figure 30:
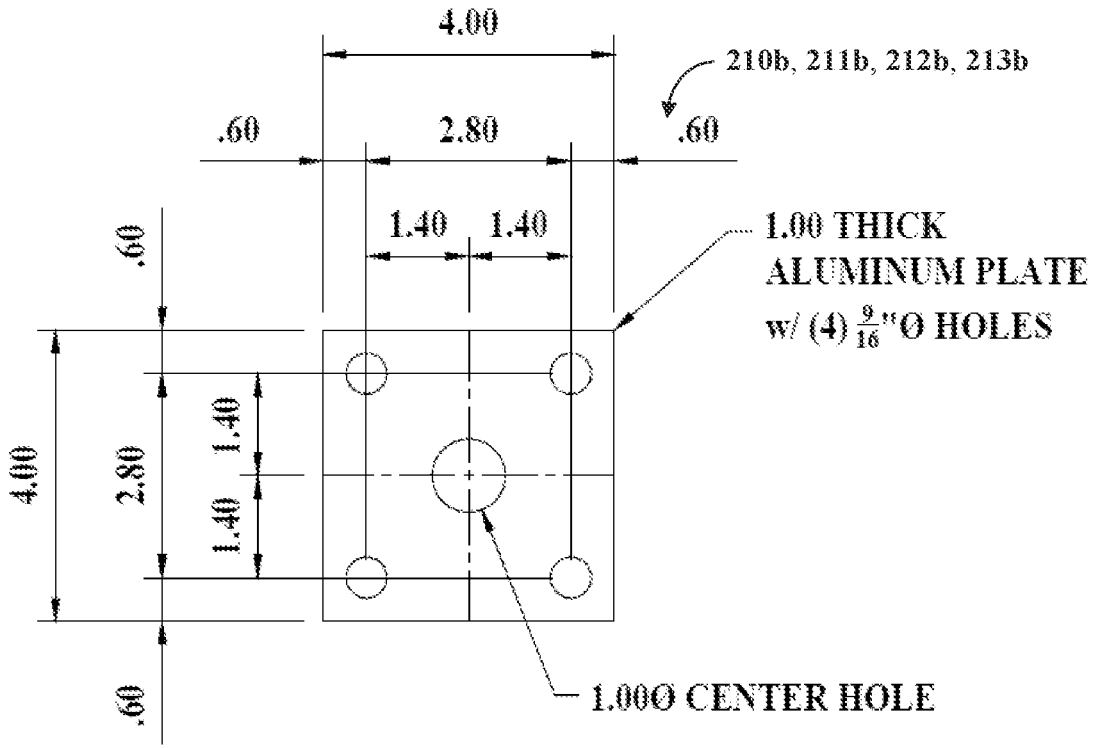
FIG. 30 exemplarily illustrates a dimensional drawing of a spacer plate of each hub of the frame of the floor jack, according to the second embodiment herein.

FIG. 30 exemplarily illustrates a dimensional drawing of the spacer plate 210*b*, 211*b*, 212*b*, 213*b* of each hub 210, 211, 212, 213 respectively, of the frame 200 of the floor jack 1000 shown in FIGS. 10A-10B and FIG. 11, according to the second embodiment herein. In an embodiment, the spacer plates 210*b*, 211*b*, 212*b*, and 213*b* of the hubs 210, 211, 212, and 213 respectively, are thick metal spacer plates. The structure and the function of the spacer plates 210*b*, 211*b*, 212*b*, and 213*b* of the hubs 210, 211, 212, and 213 respectively of the frame 200 are similar to the structure and the function of the spacer plates 5*b*, 6*b*, 7*b*, and 8*b* of their respective hubs 5, 6, 7, and 8 of the frame 100 disclosed in the detailed description of FIG. 17.

Figure 31:
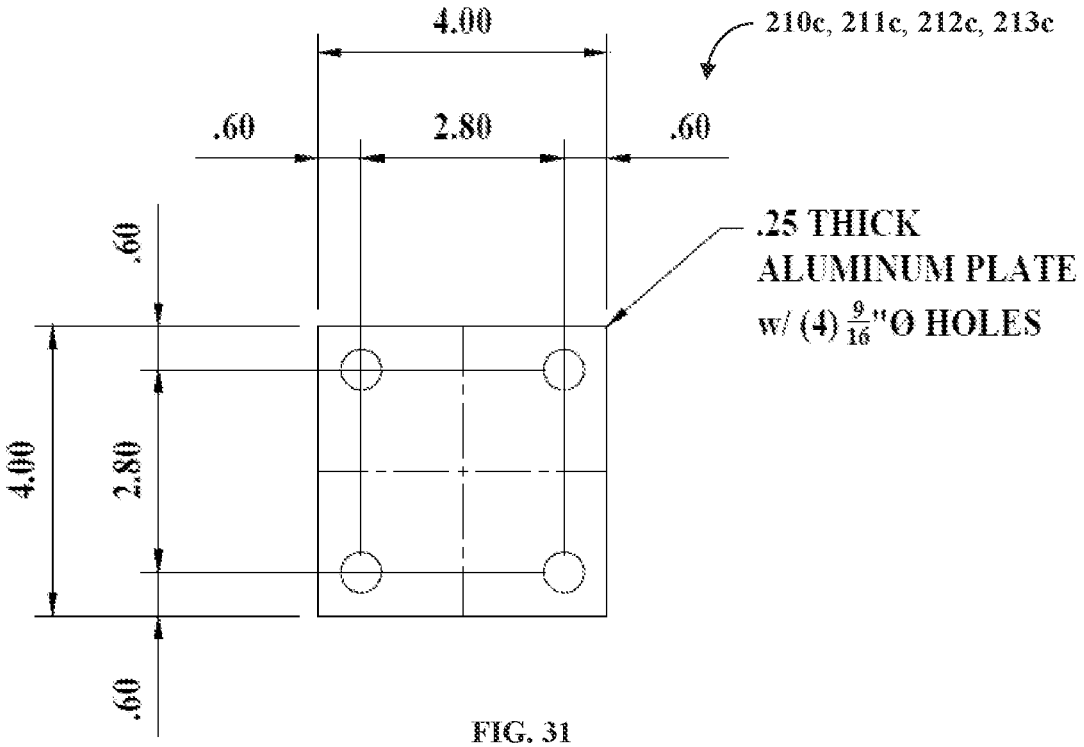
FIG. 31 exemplarily illustrates a dimensional drawing of an end plate of each hub of the frame of the floor jack, according to the second embodiment herein.

FIG. 31 exemplarily illustrates a dimensional drawing of the end plate 210*c*, 211*c*, 212*c*, 213*c* of each hub 210, 211, 212, 213 respectively, of the frame 200 of the floor jack 1000 shown in FIGS. 10A-10B and FIG. 11, according to the second embodiment herein. The end plates 210*c*, 211*c*, 212*c*, and 213*c* are thick metal end plates made, for example, of aluminum. The structure and the function of the end plates 210*c*, 211*c*, 212*c*, and 213*c* of the hubs 210, 211, 212, and 213 respectively of the frame 200 are similar to the structure and the function of the end plates 5*c*, 6*c*, 7*c*, and 8*c* of their respective hubs 5, 6, 7, and 8 of the frame 100 disclosed in the detailed description of FIG. 18.

FIG. 32 indicates exemplary sizes of the tire-wheel assembly 1003 of the frame 200 of the floor jack 1000 shown in FIGS. 10A-10B and FIG. 11, according to the second embodiment herein. The tire-wheel assembly 1003 comprises a tire 1001 and a wheel/rim 1002 as exemplarily illustrated in FIGS. 10A-10B and FIG. 11. The tire size and wheel size of the tire-wheel assembly 1003 are exemplarily illustrated in FIG. 32. In an example, the tire-wheel assembly 1003 has a lime squeeze powder coating finish.

Figure 34:
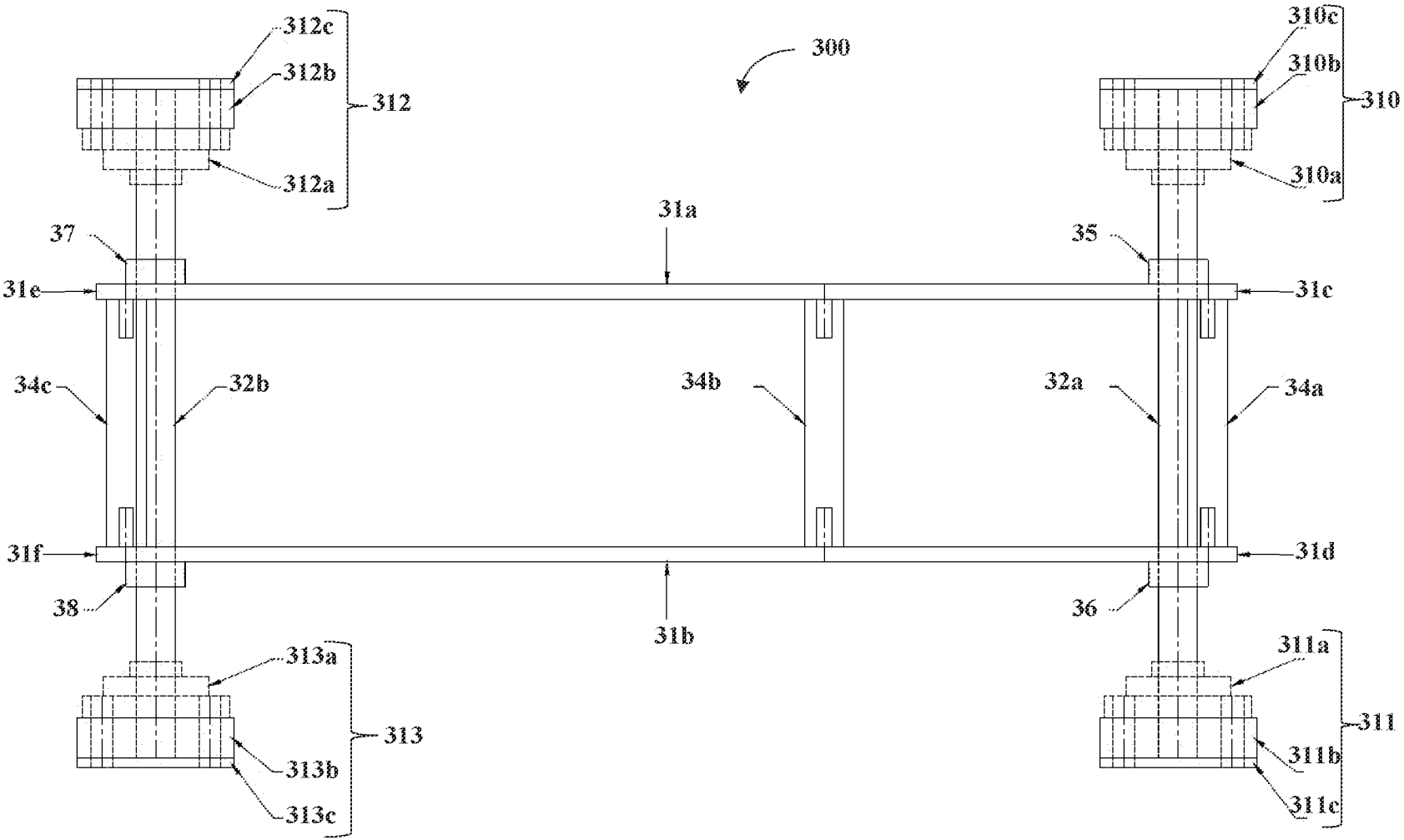
FIG. 34 exemplarily illustrates a top view of the frame of the floor jack, according to the third embodiment herein.

FIGS. 33-45 exemplarily illustrate a third embodiment of the frame 300 for a floor jack 1000 shown in FIGS. 10A-10B and FIG. 11. The third embodiment of the frame 300 is functionally the same as the second embodiment of the frame 200 of the floor jack 1000 exemplarily illustrated in FIGS. 20-24, with some of the components of the frame 300 being of a larger size than those of the frame 200 as disclosed in the detailed descriptions of FIGS. 38-45. FIG. 33 is a tabulation of the different parts of the frame 300 of the floor jack 1000, according to the third embodiment herein. The parts of the frame 300 of the third embodiment are structurally and functionally the same as the parts of the frame 200 of the second embodiment, with the dimensions of some of the parts of the frame 300 being larger than those of the frame 200. For example, while the width of each of the arched side plates 21*a* and 21*b* of the frame 200 of the second embodiment is about 12.5 inches at each of the rear ends 21*e* and 21*f* and tapers down to about 8 inches at each of the front ends 21*c* and 21*d* as exemplarily illustrated in FIG. 25, the width of each of the arched side plates 31*a* and 31*b* of the frame 300 of the third embodiment, is about 16.5 inches at the rear ends 31*e* and 31*f* and tapers down to about 12 inches at the front ends 31*c* and 31*d* as exemplarily illustrated in FIG. 38. Similarly, while the axles 22*a* and 22*b* of the frame 200 of the second embodiment are, in an embodiment, about 15.75 inches long as exemplarily illustrated in FIG. 26, the axles 32*a* and 32*b* of the frame 300 of the third embodiment are about 17 inches long as exemplarily illustrated in FIG. 39. In an example, because of the longer axles 32*a* and 32*b* in the third embodiment of the frame 300, the end-to-end distance between the hubs 310 and 311 at the front ends 31*c* and 31*d* of the arched side plates 31*a* and 31*b* of the frame 300, and the end-to-end distance between the hubs 312 and 313 at the rear ends 31*e* and 31*f* of the arched side plates 31*a* and 31*b* of the frame 300 exemplarily illustrated in FIG. 34, are equal to about 17.5 inches. In an example, the end-to-end distance between the hubs 210 and 211 at the front ends 21*c* and 21*d* of the arched side plates 21*a* and 21*b* of the frame 200, and the end-to-end distance between the hubs 212 and 213 at the rear ends 21*e* and 21*f* of the arched side plates 21*a* and 21*b* of the frame 200 exemplarily illustrated in FIG. 21, are equal to about 16.25 inches. When the frame 200 of the second embodiment exemplarily illustrated in FIG. 21 is used with a tire-wheel assembly 1003 comprising a 5.70-8-inch tire 1001 and an 8-inch—4 on 4-inch wheel/rim 1002 shown in FIGS. 10A-10B and FIG. 11, the top of the lifting pad 802 of the floor jack 1000 will be at an elevation of, for example, about 32.5 inches above a substantially horizontal surface on which the floor jack 1000 is positioned. When the frame 300 of the third embodiment is used with a tire-wheel assembly 1003 comprising a 175/80-13-inch tire 1001 and 8-inch—4 on 4-inch wheel/rim 1002, the top of the lifting pad 802 of the floor jack 1000 will be at an elevation of, for example, about 40 inches above the substantially horizontal surface on which the floor jack 1000 is positioned.

In the third embodiment, the frame 300 is configured for a mega floor jack with mega arched side plates 31*a* and 31*b* that lowers the axles 32*a* and 32*b*, for example, by about 10 inches and spreads the center to the center of the axles 32*a* and 32*b*, for example, by about 5½ inches. When the frame 300 of the third embodiment is used with a 175/80-13-inch tire 1001 and a 13-inch—4 on 4-inch wheel/rim 1002, the top of the lifting pad 802 of the mega floor jack will be at an elevation of, for example, about 40 inches. In this configuration, the lifting pad 802 is in a retracted position.

FIG. 34 exemplarily illustrates a top view of the frame 300 of the floor jack 1000 shown in FIGS. 10A-10B and FIG. 11, according to the third embodiment herein. The frame 300 comprises the following parts: a pair of arched side plates 31*a* and 31*b*, a first pair of hubs 310 and 311, a second pair of hubs 312 and 313, a first axle 32*a*, a second axle 32*b*, and a set of spreader bars 34*a*, 34*b*, 34*c*, 34*d*, and 34*e* as exemplarily illustrated in FIGS. 34-37. The structure and function of the parts of the frame 300 of the third embodiment are similar to the structure and function of the corresponding parts of the frame 100 of the first embodiment as disclosed in the detailed description of FIG. 2. The frame 300 further comprises non-adjustable shaft collars 35, 36, 37, and 38, the structure and the function of which are disclosed in the detailed description of FIG. 21.

Figure 35:
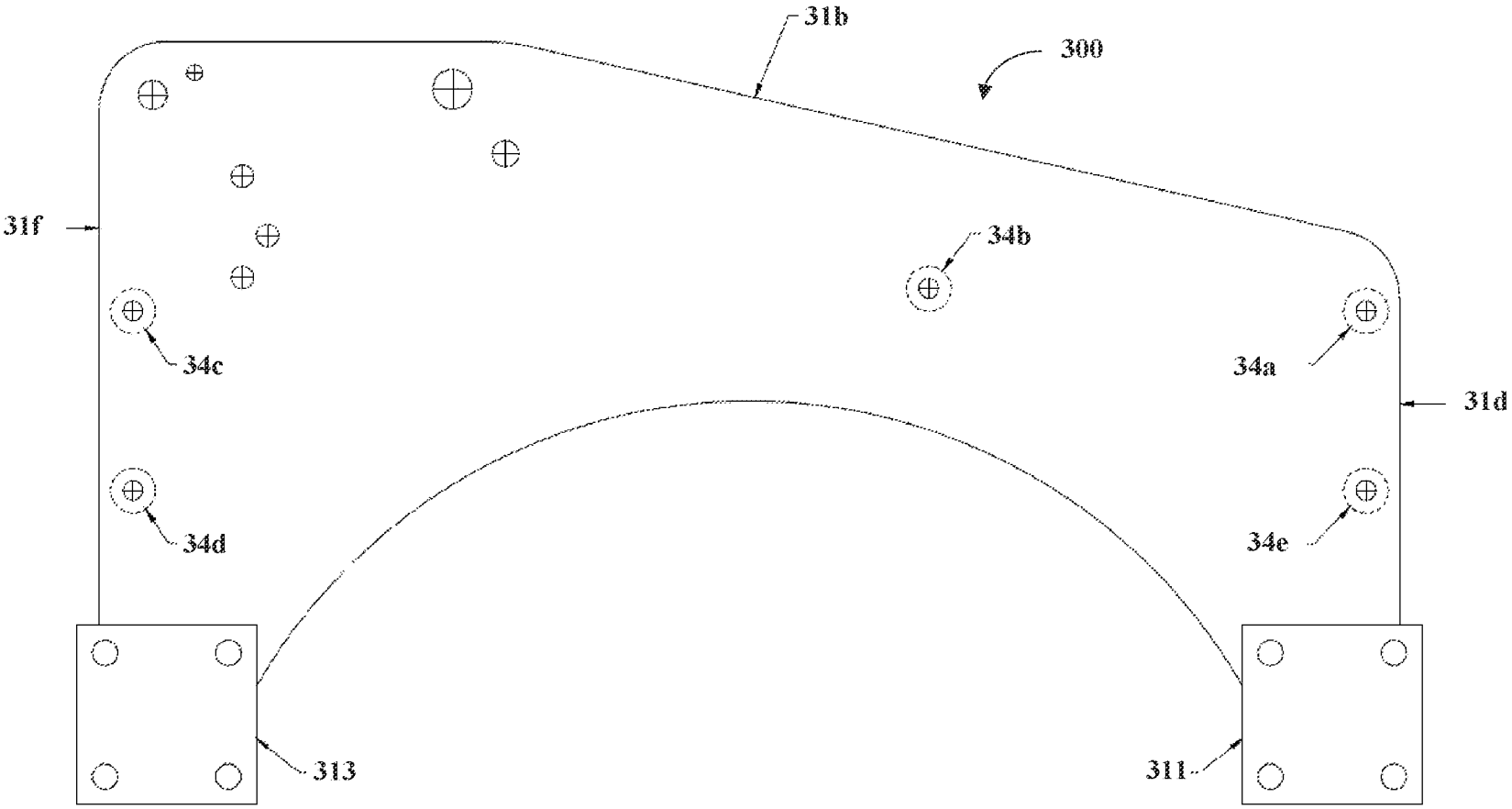
FIG. 35 exemplarily illustrates a side view of the frame of the floor jack, according to the third embodiment herein.

FIG. 35 exemplarily illustrates a side view of the frame 300 of the floor jack 1000 shown in FIGS. 10A-10B and FIG. 11, according to the third embodiment herein. The description for FIG. 35 is similar to the description for FIG. 3. The structure and the function of the parts of the frame 300, for example, the hubs 311 and 313, the spreader bars 34*a*, 34*b*, 34*c*, 34*d*, and 34*e*, etc., shown in FIG. 35 are similar to the structure and the function of the corresponding parts of the frame 100 disclosed in the detailed description of FIG. 3.

Figure 36:
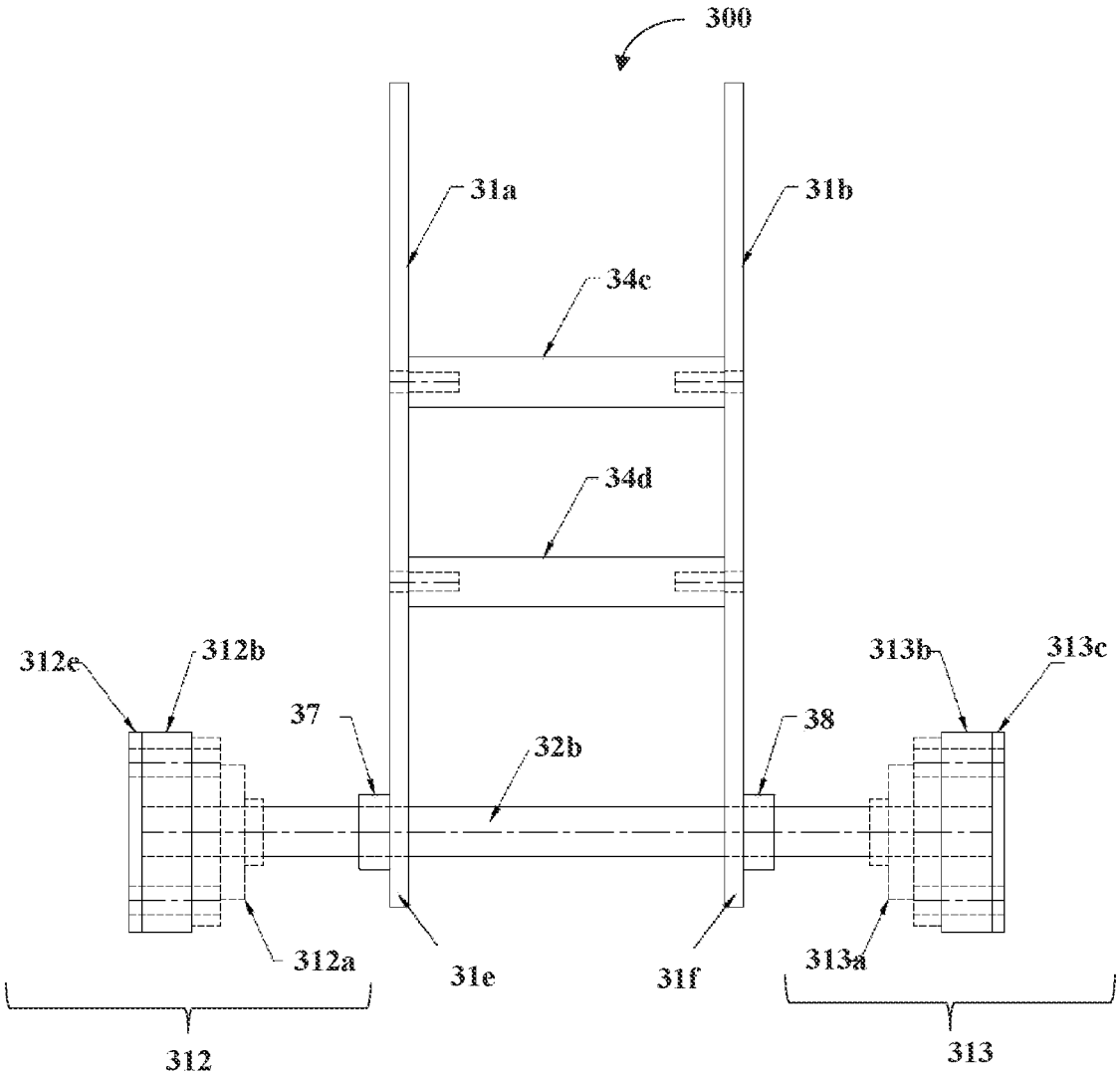
FIG. 36 exemplarily illustrates a rear view of the frame of the floor jack, according to the third embodiment herein.

FIG. 36 exemplarily illustrates a rear view of the frame 300 of the floor jack 1000 shown in FIGS. 10A-10B and FIG. 11, according to the third embodiment herein. The structure and the function of the parts of the frame 300, for example, the arched side plates 31*a* and 31*b*, the second axle 32*b*, the hubs 312 and 313, the spreader bars 34*c*, 34*d*, etc., shown in FIG. 36 are similar to the structure and the function of the corresponding parts of the frame 100 disclosed in the detailed description of FIG. 4.

Figure 37:
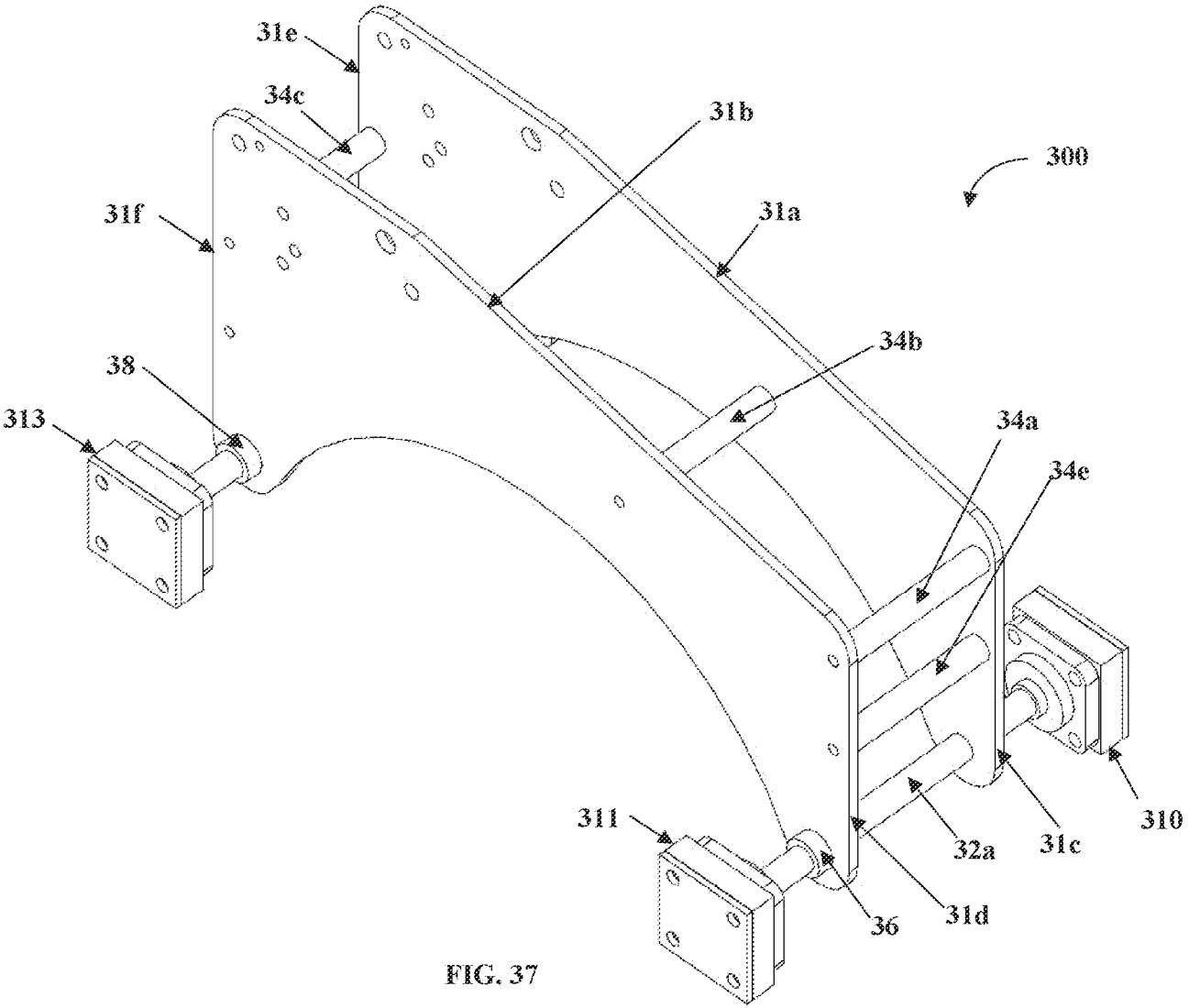
FIG. 37 exemplarily illustrates a perspective view of the frame of the floor jack, according to the third embodiment herein.

FIG. 37 exemplarily illustrates a perspective view of the frame 300 of the floor jack 1000 shown in FIGS. 10A-10B and FIG. 11, according to the third embodiment herein. The structure and the function of the parts of the frame 300 shown in FIG. 37 are similar to the structure and the function of the corresponding parts of the frame 100 disclosed in the detailed description of FIG. 5.

Figure 38:
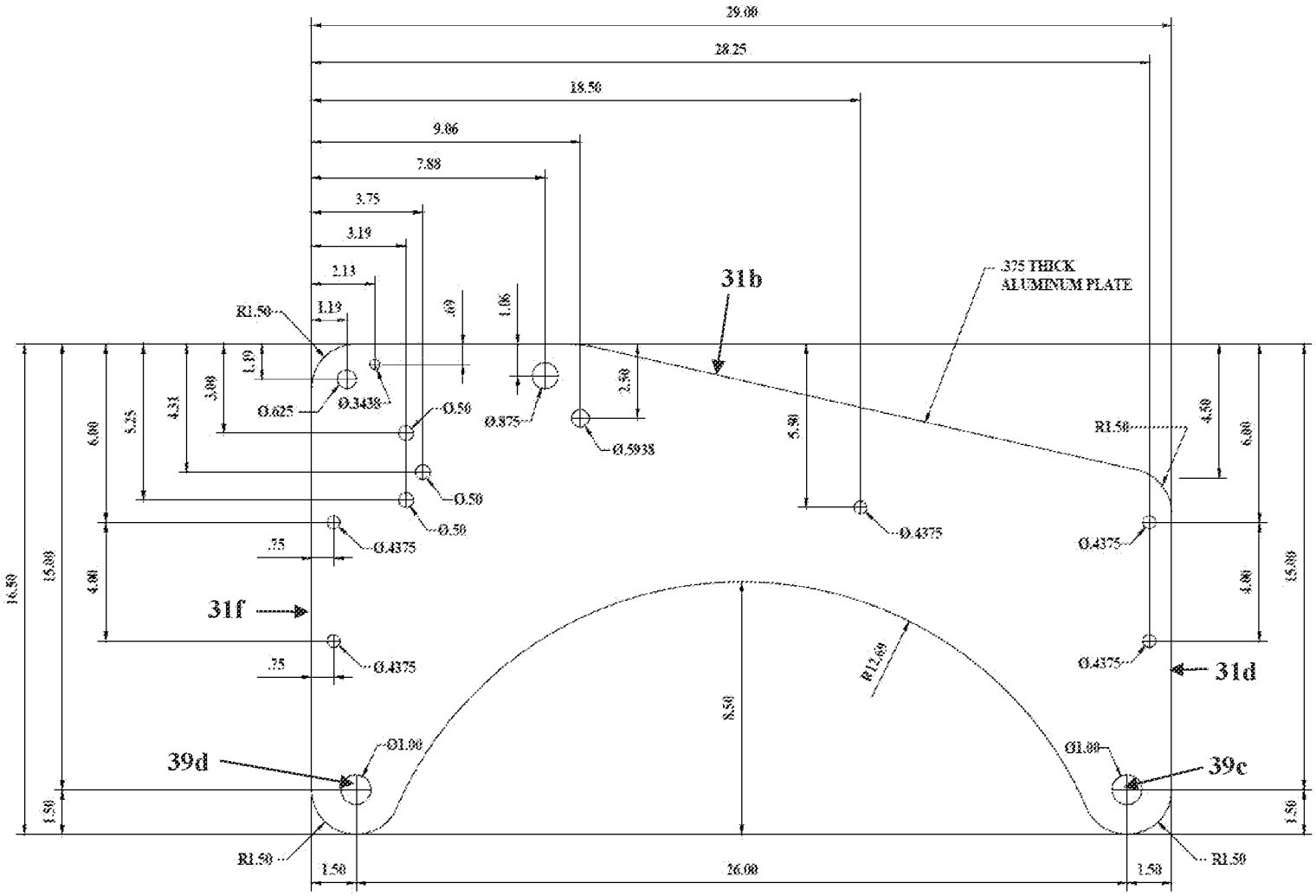
FIG. 38 exemplarily illustrates a dimensional drawing of an arched side plate of the frame of the floor jack, according to the third embodiment herein.

FIG. 38 exemplarily illustrates a dimensional drawing of the arched side plate 31*b* of the frame 300 of the floor jack 1000 shown in FIGS. 10A-10B and FIG. 11, according to the third embodiment herein. The arched side plate 31*b* is a replica of the arched side plate 31*a* exemplarily illustrated in FIG. 37. The structure and the function of the arched side plates 31*a* and 31*b* of the frame 300 are similar to the structure and the function of the corresponding parts of the frame 100 disclosed in the detailed description of FIG. 12. As exemplarily illustrated in FIG. 38, the arched side plate 31*b* comprises lower axle holes 39*c* and 39*d*. The arched side plate 31*a* also comprises lower axle holes (not shown). The width of the arched side plate 31*b* at the front end 31*d* is, for example, about 12 inches. The width of the arched side plate 31*b* at the rear end 31*f* is, for example, about 16.5 inches.

Figure 39:
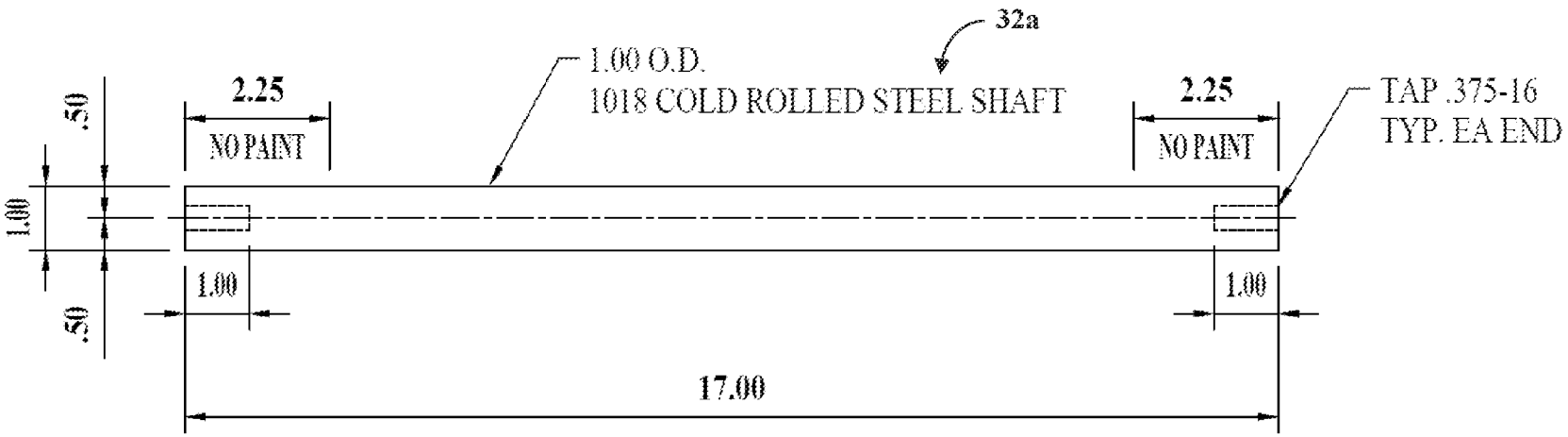
FIG. 39 exemplarily illustrates a dimensional drawing of an axle of the frame of the floor jack, according to the third embodiment herein.

FIG. 39 is a dimensional drawing of the axle 32*a* of the frame 300 of the floor jack 1000 shown in FIGS. 10A-10B and FIG. 11, according to the third embodiment herein. The axle 32*b* is a replica of the axle 32*a* exemplarily illustrated in FIG. 34 and FIG. 37. The structure and the function of the axles 32*a* and 32*b* of the frame 300 are similar to the structure and the function of the axles 2*a* and 2*b* of the frame 100 disclosed in the detailed description of FIG. 13. The length of each of the axles 32*a* and 32*b* is, for example, about 17 inches.

Figure 40:
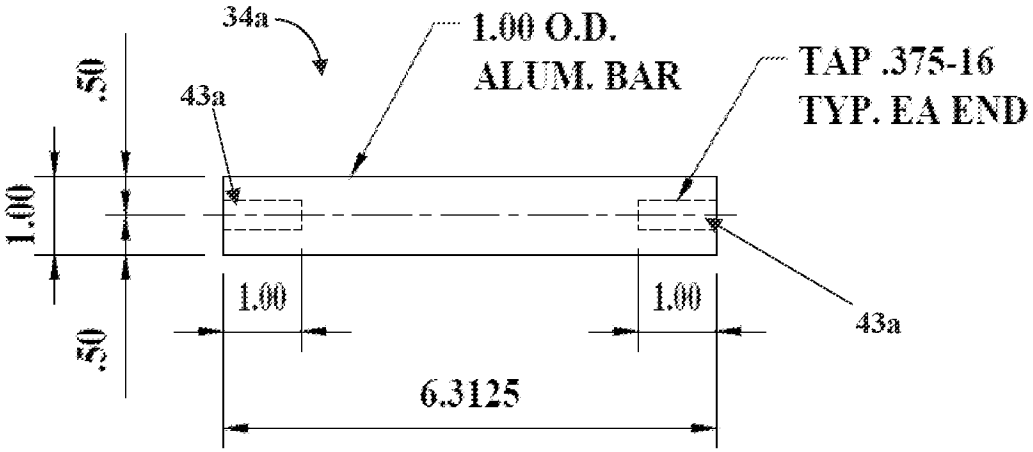
FIG. 40 exemplarily illustrates a dimensional drawing of a spreader bar of the frame of the floor jack, according to the third embodiment herein.

FIG. 40 exemplarily illustrates a dimensional drawing of the spreader bar 34*a* of the frame 300 of the floor jack 1000 shown in FIGS. 10A-10B and FIG. 11, according to the third embodiment herein. The spreader bars 34*b*, 34*c*, 34*d*, and 34*e* are replicas of the spreader bar 34*a*. The structure and the function of the spreader bars 34*a*, 34*b*, 34*c*, 34*d*, and 34*e* of the frame 300 are similar to the structure and the function of the spreader bars 3*a*, 3*b*, 3*c*, 3*d*, and 3*e* of the frame 100 disclosed in the detailed description of FIG. 14. As exemplarily illustrated in FIG. 40, the spreader bar 34*a* of the frame 300 comprises threaded holes 43*a* on both ends thereof corresponding to the threaded holes 33*a* on the ends of the spreader bar 23*a* of the frame 200 exemplarily illustrated in FIG. 27.

Figure 41:
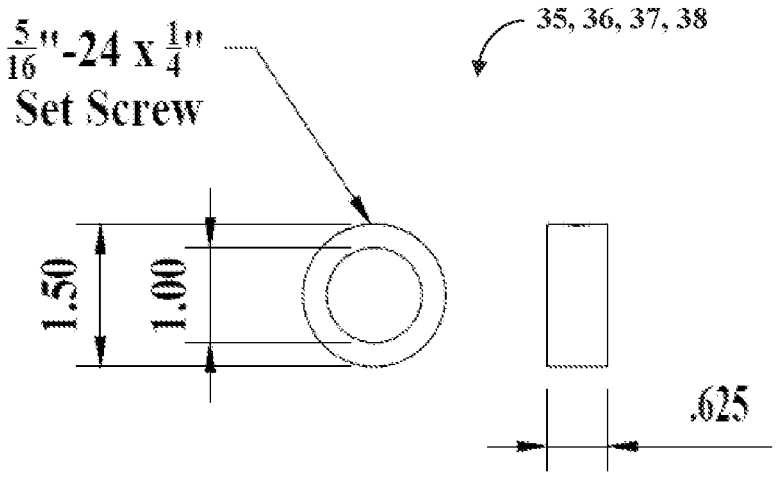
FIG. 41 exemplarily illustrates a dimensional drawing of a non-adjustable collar of the frame of the floor jack, according to the third embodiment herein.

FIG. 41 exemplarily illustrates a dimensional drawing of the non-adjustable collar 35, 36, 37, 38 of the frame 300 of the floor jack 1000 shown in FIGS. 10A-10B and FIG. 11, according to the third embodiment herein. The structure and the function of the non-adjustable collars 35, 36, 37, and 38 of the frame 300 are similar to the structure and the function of the non-adjustable collars 25, 26, 27, and 28 of the frame 200 disclosed in the detailed description of FIG. 28.

Figure 42:
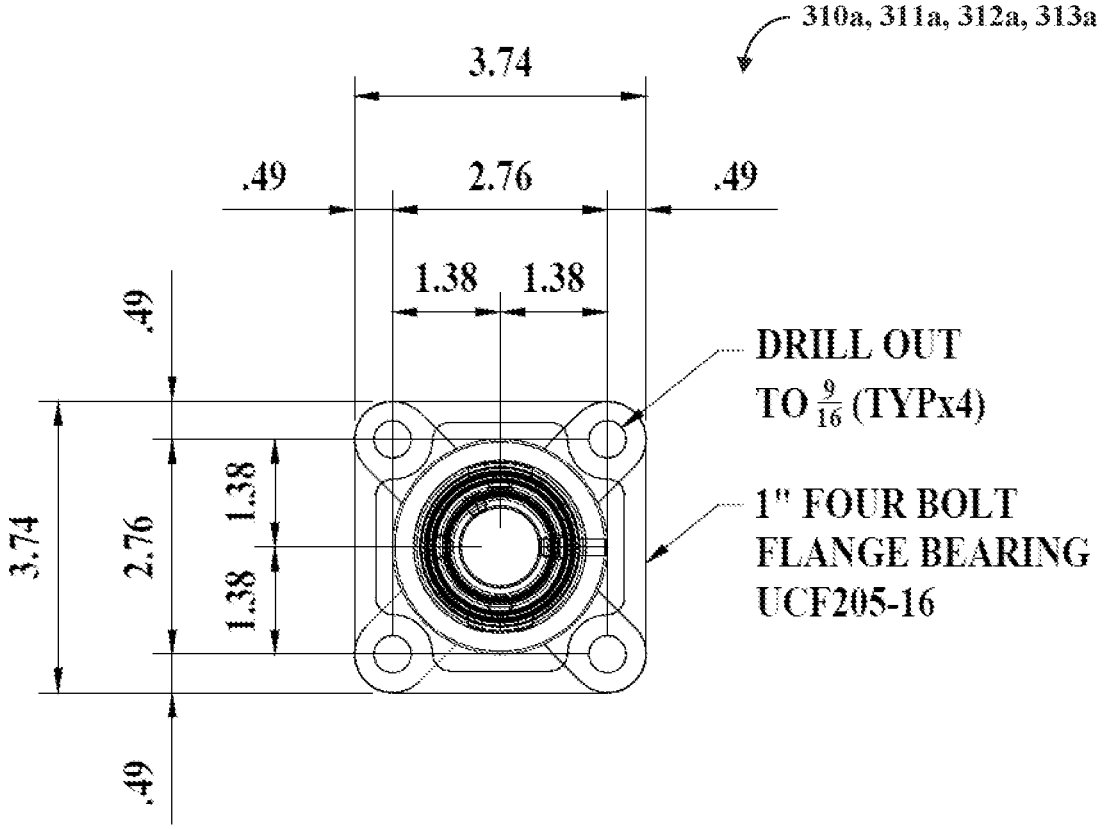
FIG. 42 exemplarily illustrates a dimensional drawing of a four-bolt flange bearing of each hub of the frame of the floor jack, according to the third embodiment herein.

FIG. 42 exemplarily illustrates a dimensional drawing of the four-bolt flange bearing 310*a*, 311*a*, 312*a*, 313*a* of each hub 310, 311, 312, 313 of the frame 300 of the floor jack 1000 shown in FIGS. 10A-10B and FIG. 11, according to the third embodiment herein. The structure and the function of the four-bolt flange bearings 310*a*, 311*a*, 312*a*, and 313*a* of the hubs 310, 311, 312, and 313 respectively of the frame 300 are similar to the structure and the function of the four-bolt flange bearings 5*a*, 6*a*, 7*a*, and 8*a* of their respective hubs 5, 6, 7, and 8 of the frame 100 disclosed in the detailed description of FIG. 16.

Figure 43:
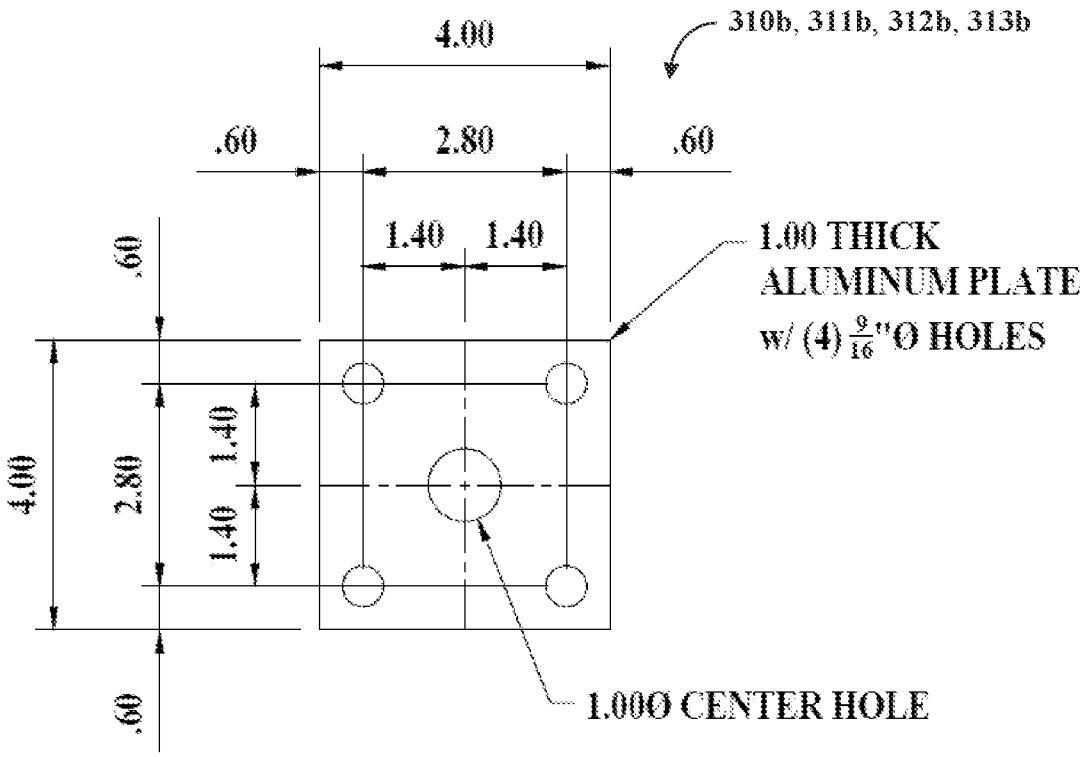
FIG. 43 exemplarily illustrates a dimensional drawing of a spacer plate of each hub of the frame of the floor jack, according to the third embodiment herein.

FIG. 43 exemplarily illustrates a dimensional drawing of the spacer plate 310*b*, 311*b*, 312*b*, and 313*b* of each hub 310, 311, 312, 313 of the frame 300 of the floor jack 1000 shown in FIGS. 10A-10B and FIG. 11, according to the third embodiment herein. In an embodiment, the spacer plates 310*b*, 311*b*, 312*b*, and 313*b* of the hubs 310, 311, 312, and 313 respectively, are thick metal spacer plates. The structure and the function of the spacer plates 310*b*, 311*b*, 312*b*, and 313*b* of the hubs 310, 311, 312, and 313 respectively of the frame 300 are similar to the structure and the function of the spacer plates 5*b*, 6*b*, 7*b*, and 8*b* of their respective hubs 5, 6, 7, and 8 of the frame 100 disclosed in the detailed description of FIG. 17.

Figure 44:
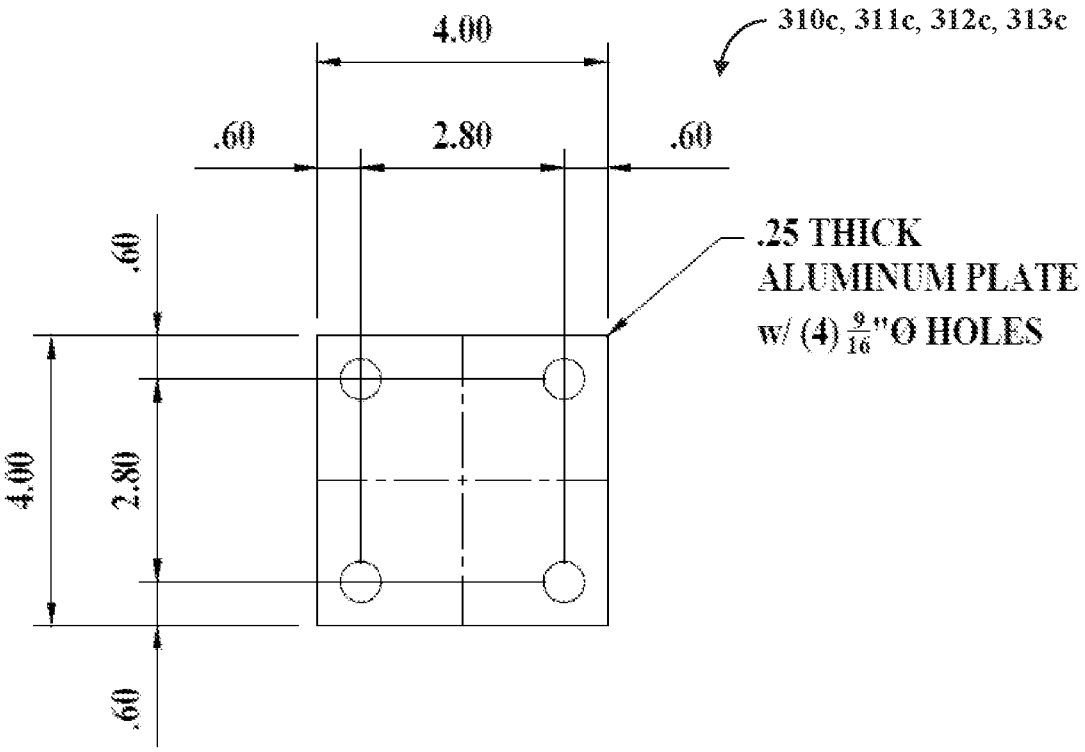
FIG. 44 exemplarily illustrates a dimensional drawing of an end plate of each hub of the frame of the floor jack, according to the third embodiment herein.

FIG. 44 exemplarily illustrates a dimensional drawing of the end plate 310*c*, 311*c*, 312*c*, and 313*c* of each hub 310, 311, 312, 313 of the frame 300 of the floor jack 1000 shown in FIGS. 10A-10B and FIG. 11, according to the third embodiment herein. The end plates 310*c*, 311*c*, 312*c*, and 313*c* are thick metal end plates made, for example, of aluminum. The structure and the function of the end plates 310*c*, 311*c*, 312*c*, and 313*c* of the hubs 310, 311, 312, and 313 respectively of the frame 300 are similar to the structure and the function of the end plates 5*c*, 6*c*, 7*c*, and 8*c* of their respective hubs 5, 6, 7, and 8 of the frame 100 disclosed in the detailed description of FIG. 18.

FIG. 45 indicates exemplary sizes of a tire-wheel assembly 1003 of the frame 300 of the floor jack 1000 shown in FIGS. 10A-10B and FIG. 11, according to the third embodiment herein. The tire-wheel assembly 1003 comprises a tire 1001 and a wheel/rim 1002 as exemplarily illustrated in FIGS. 10A-10B and FIG. 11. The tire size and wheel size of the tire-wheel assembly 1003 are exemplarily illustrated in FIG. 45. In an example, the tire-wheel assembly 1003 has a lime squeeze powder coating finish. All the three embodiments of the frame 100, 200, and 300 shown in FIG. 2, FIG. 21, and FIG. 34 respectively, are configured for 3-ton factory floor jacks that have a vertical stroke of, for example, about 16 inches for the lifting pad 802 exemplarily illustrated in FIGS. 10A-10B and FIG. 11.

The teardrop-shaped adjustable shaft collars 15, 16, 17, and 18 of the frame 100 of the first embodiment, provide benefits of both the frame 200 of the second embodiment and the frame 300 of the third embodiment for the floor jack 1000. In the first embodiment exemplarily illustrated in FIG. 2 and FIG. 7, when the axles 2*a* and 2*b* are positioned in the lower axle holes 9*a*, 9*c* and 9*b*, 9*d*, respectively, of the arched side plates 1*a* and 1*b*, and the teardrop-shaped adjustable shaft collars 15, 16, 17, and 18 are in a lower position 1501 as exemplarily illustrated in FIG. 6, FIGS. 9A-9B, and FIG. 15B, then the resulting frame forms and operates similar to the frame 200 of the second embodiment. Likewise, in the first embodiment, when the axles 2*a* and 2*b* are positioned in the upper axle holes 14*a*, 14*c* and 14*b*, 14*d*, respectively, of the arched side plates 1*a* and 1*b*, and the teardrop-shaped adjustable shaft collars 15, 16, 17, and 18 are in an upper position 1503 as exemplarily illustrated in FIG. 5, FIGS. 8A-8B, and FIG. 15B, then the resulting frame forms and operates similar to the frame 300 configured for a mega floor jack of the third embodiment.

Figure 46:
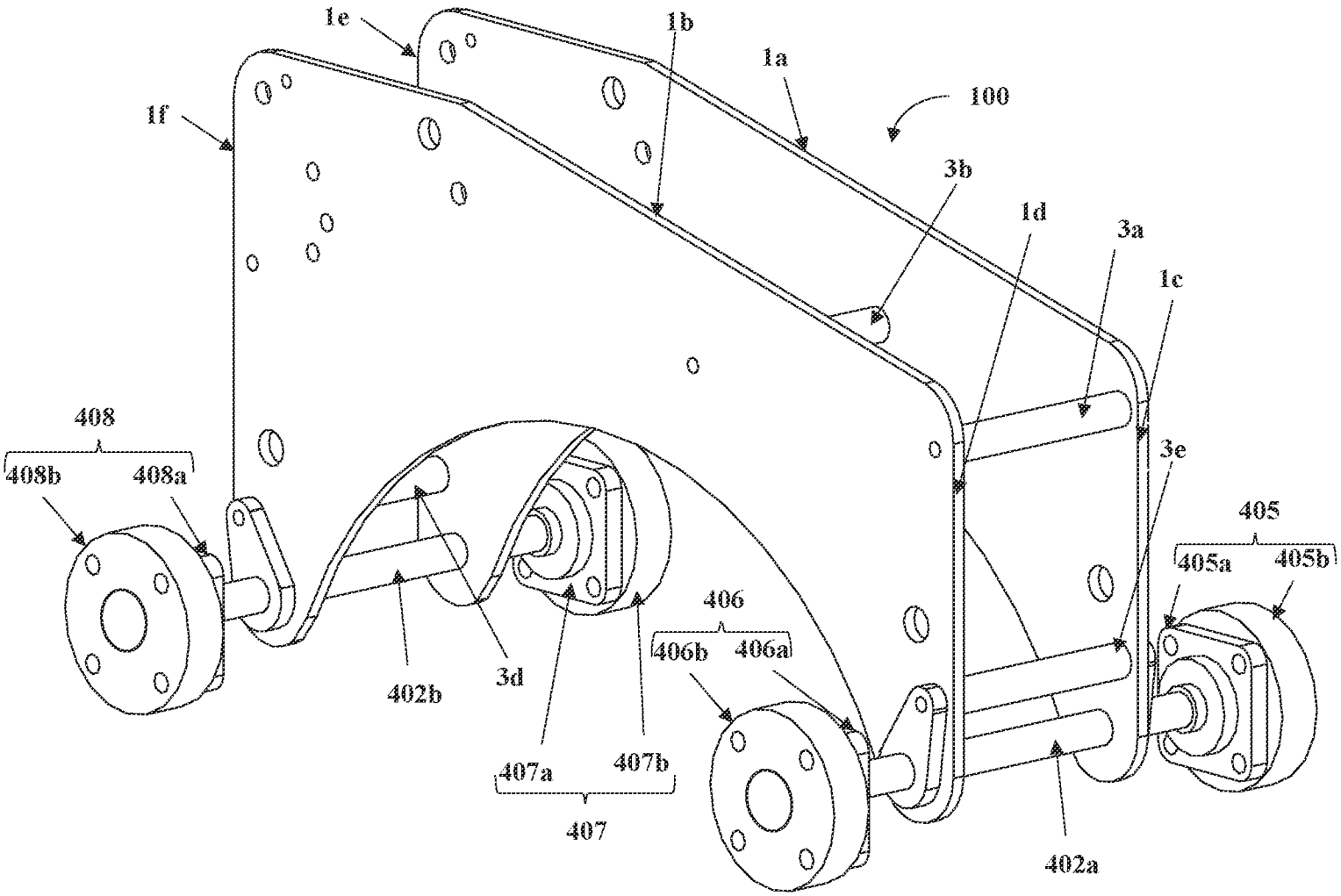
FIG. 46 exemplarily illustrates a perspective view of the frame of the floor jack, according to the first embodiment herein, showing embodiments of the four-bolt flange bearings, the spacer plates, and the axles.

FIG. 46 exemplarily illustrates a perspective view of the frame 100 of the floor jack 1000 shown in FIGS. 10A-10B and FIG. 11, according to the first embodiment herein, showing embodiments of the four-bolt flange bearings 405*a*, 406*a*, 407*a*, and 408*a*, the spacer plates 405*b*, 406*b*, 407*b*, and 408*b*, and the axles 402*a* and 402*b*. The frame 100 exemplarily illustrated in FIG. 46, comprise different embodiments of the hubs 405, 406, 407, and 408 and the axles 402*a* and 402*b*. In an embodiment, the four-bolt flange bearings 405*a*, 406*a*, 407*a*, and 408*a* are, for example, UCF205-14, ⅞-inch four-bolt flange bearings as exemplarily illustrated in FIG. 50. In an embodiment, the thick metal spacer plates 405*b*, 406*b*, 407*b*, and 408*b* of the respective hubs 405, 406, 407, and 408 of the frame 100 exemplarily illustrated in FIG. 46, are circular in shape as opposed to the square-shaped thick metal spacer plates 5*b*, 6*b*, 7*b*, and 8*b* exemplarily illustrated in FIGS. 2-9B, FIG. 11, and FIG. 17. The hubs 405 and 406 comprising the thick metal spacer plates 405*b* and 406*b* respectively, and the four-bolt flange bearings 405*a* and 406*a* respectively, are secured to the first axle 402*a* using one or more set screws 5000 exemplarily illustrated in FIG. 50. The hubs 407 and 408 comprising the thick metal spacer plates 407*b* and 408*b* respectively, and the four-bolt flange bearings 407*a* and 408*a* respectively, are secured to the second axle 402*b* using one or more set screws 5000.

Figure 47:
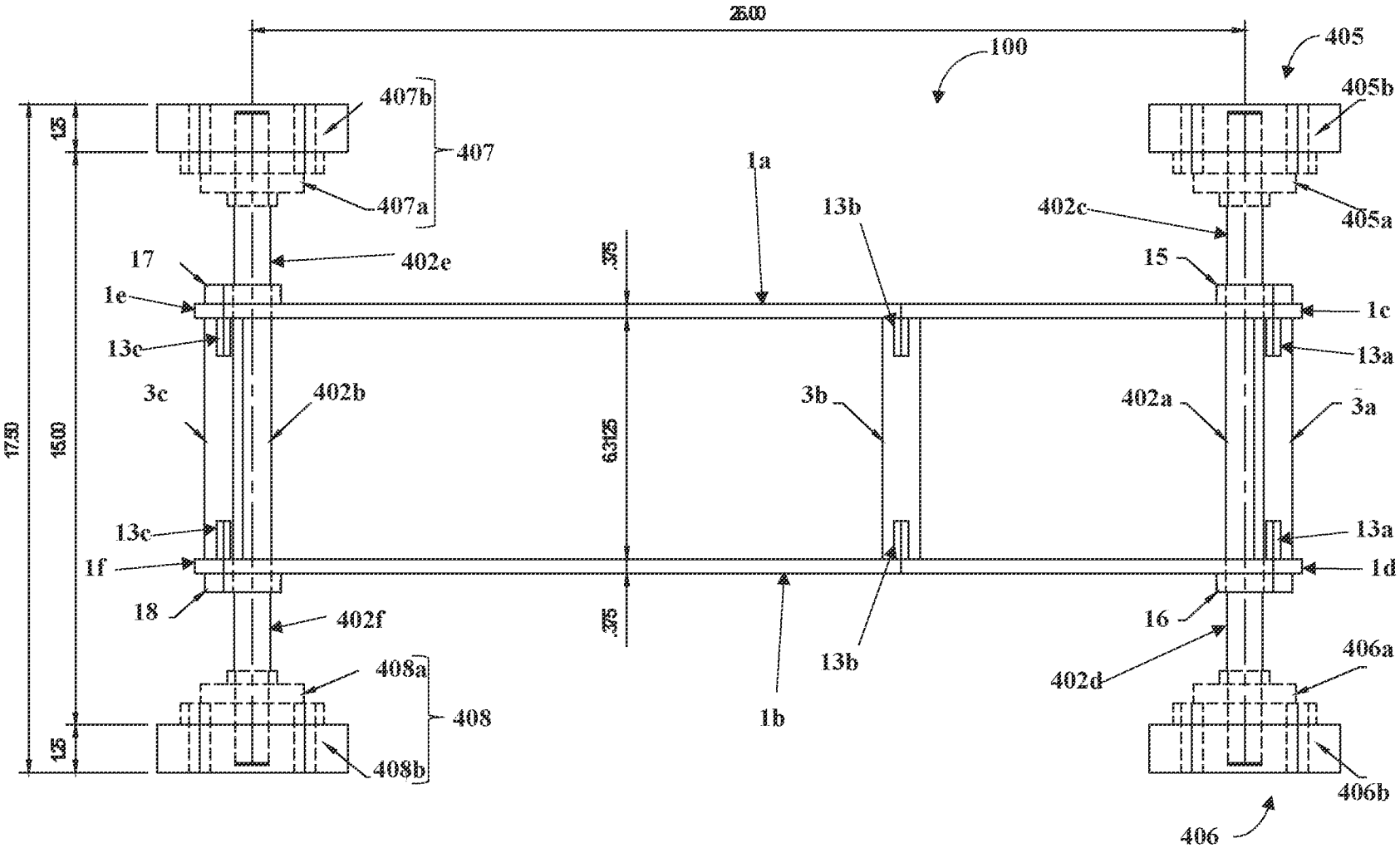
FIG. 47 exemplarily illustrates a top view of the frame of the floor jack shown in FIG. 46.

FIG. 47 exemplarily illustrates a top view of the frame 100 of the floor jack shown in FIG. 46. The frame 100 comprises a pair of arched side plates 1*a* and 1*b*, adjustable collars 15, 16, 17, and 18, and a set of spreader bars 3*a*, 3*b*, 3*c*, 3*d*, and 3*e* as disclosed in the detailed descriptions of FIGS. 2-3, FIG. 12, FIG. 14, and FIGS. 15A-15B. The frame 100 further comprises different embodiments of the first pair of hubs 405 and 406, the second pair of hubs 407 and 408, the first axle 402*a*, and the second axle 402*b* as disclosed in the detailed description of FIG. 46. The distance between the arched side plates 1*a* and 1*b* is, for example, about 6.3125 inches. The end-to-end distance between the first pair of hubs 405 and 406 is, for example, about 17.5 inches. The end-to-end distance between the second pair of hubs 407 and 408 is, for example, about 17.5 inches. Other exemplary dimensions are exemplarily illustrated in FIG. 47.

Figure 48:
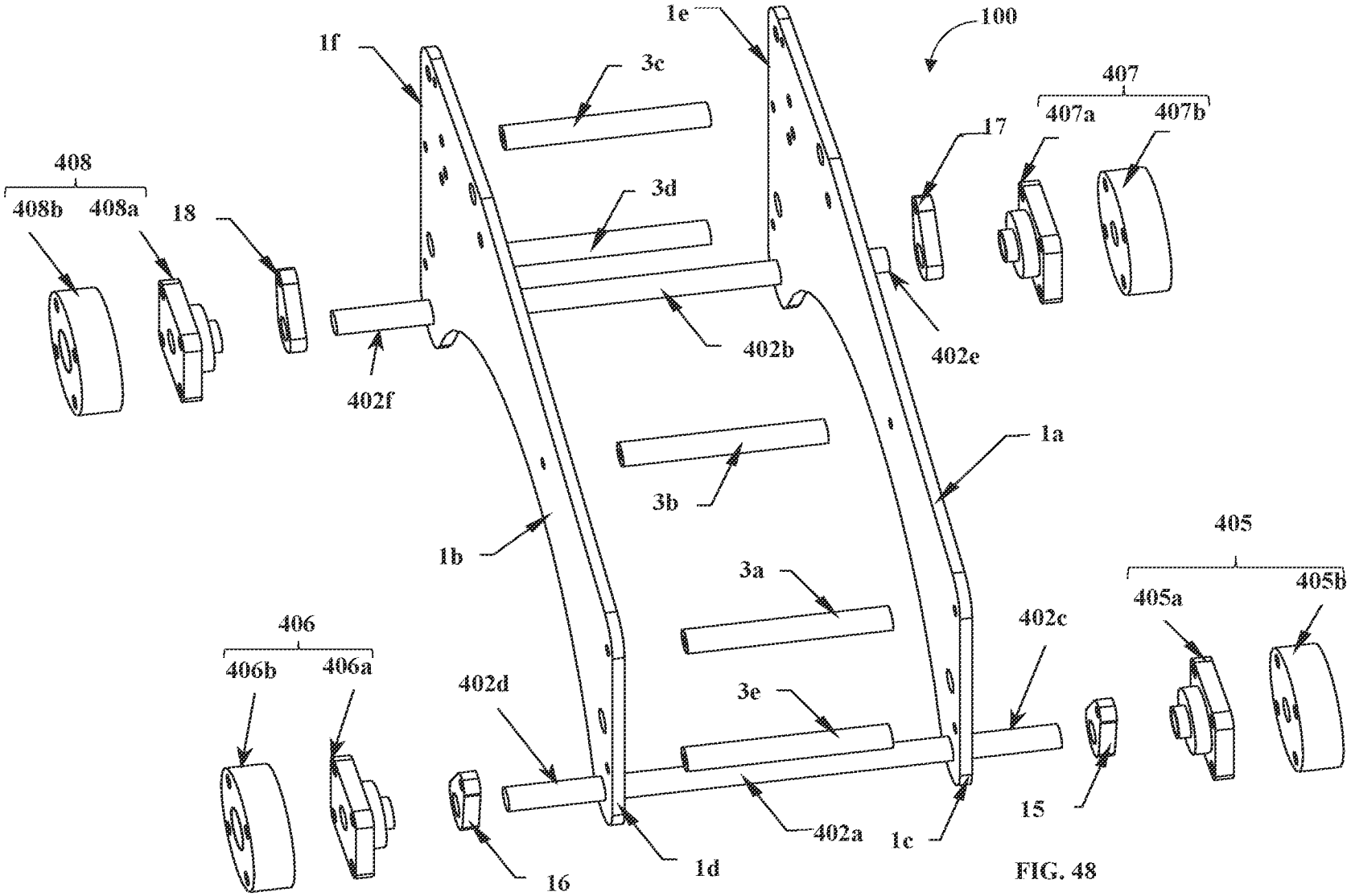
FIG. 48 exemplarily illustrates an exploded view of the frame of the floor jack shown in FIG. 46.

FIG. 48 exemplarily illustrates an exploded view of the frame 100 of the floor jack shown in FIG. 46. FIG. 48 exemplarily illustrates the positions of the spreader bars 3*a*, 3*b*, 3*c*, 3*d*, and 3*e* between the arched side plates 1*a* and 1*b*, the axles 402*a* and 402*b*, and the constituents, namely, the four-bolt flange bearings 405*a*, 406*a*, 407*a*, and 408*a* and the spacer plates 405*b*, 406*b*, 407*b*, and 408*b* of the respective hubs 405, 406, 407, and 408.

Figure 49:
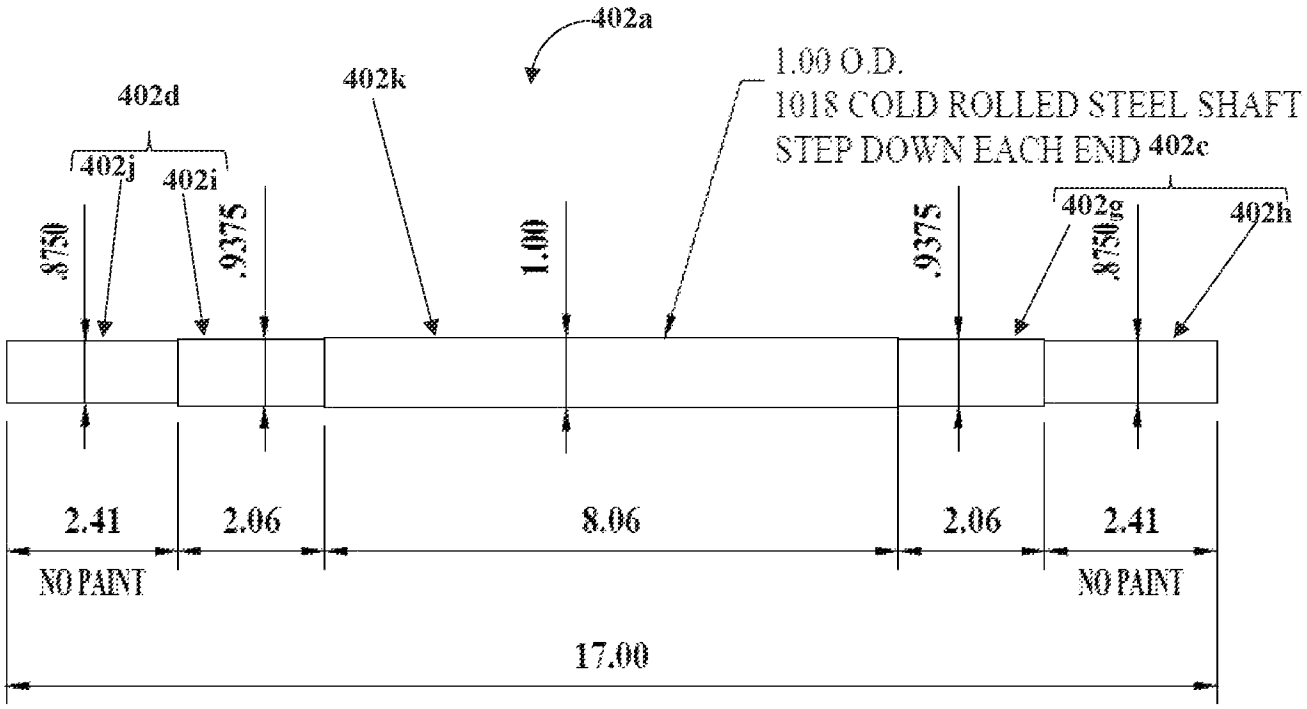
FIG. 49 exemplarily illustrates a dimensional drawing of an axle of the frame of the floor jack shown in FIG. 46, according to an embodiment herein.

FIG. 49 exemplarily illustrates a dimensional drawing of an axle, that is, the first axle 402*a* of the frame 100 of the floor jack shown in FIG. 46, according to an embodiment herein. As exemplarily illustrated in FIG. 49, the ends 402*c* and 402*d* of the first axle 402*a* comprise stepped outer sections 402*h* and 402*j* respectively, and stepped inner sections 402*g* and 402*i* respectively. As exemplarily illustrated in FIG. 49, the diameters of the stepped outer sections 402*h* and 402*j* are lesser than the diameters of the stepped inner sections 402*g* and 402*i*. Furthermore, the diameter of a mid-section 402*k* of the first axle 402*a* is greater than the diameters of the stepped outer sections 402*h* and 402*j* and the stepped inner sections 402*g* and 402*i*. The structure of the second axle 402*b* exemplarily illustrated in FIGS. 46-48, is the same as the structure of the first axle 402*a*. The ends 402*e* and 402*f* of the second axle 402*b* also comprise stepped outer sections and stepped inner sections, similar to the stepped outer sections 402*h* and 402*j* and the stepped inner sections 402*g* and 402*i* on the ends 402*c* and 402*d* of the first axle 402*a* respectively. In an embodiment, the stepped inner sections 402*g* and 402*i* of the first axle 402*a* accommodate the teardrop-shaped adjustable shaft collars 15 and 16 exemplarily illustrated in FIGS. 46-48. The stepped outer sections 402*h* and 402*j* accommodate the hubs 405 and 406 respectively. Similarly, the stepped inner sections of the second axle 402*b* accommodate the teardrop-shaped adjustable shaft collars 17 and 18 exemplarily illustrated in FIGS. 46-48, and the stepped outer sections of the second axle 402*b* accommodate the hubs 407 and 408. The length of each of the axles 402*a* and 402*b* is, for example, about 17 inches. The diameter of each of the axles 402*a* and 402*b* is, for example, about 1 inch. Other exemplary dimensions of the stepped inner sections 402*g* and 402*i*, the stepped outer sections 402*h* and 402*j*, and the mid-section 402*k* of the first axle 402*a* are exemplarily illustrated in FIG. 49. Each of the axles 402*a* and 402*b* is configured, for example, as a 1018 cold rolled steel shaft.

Figure 50:
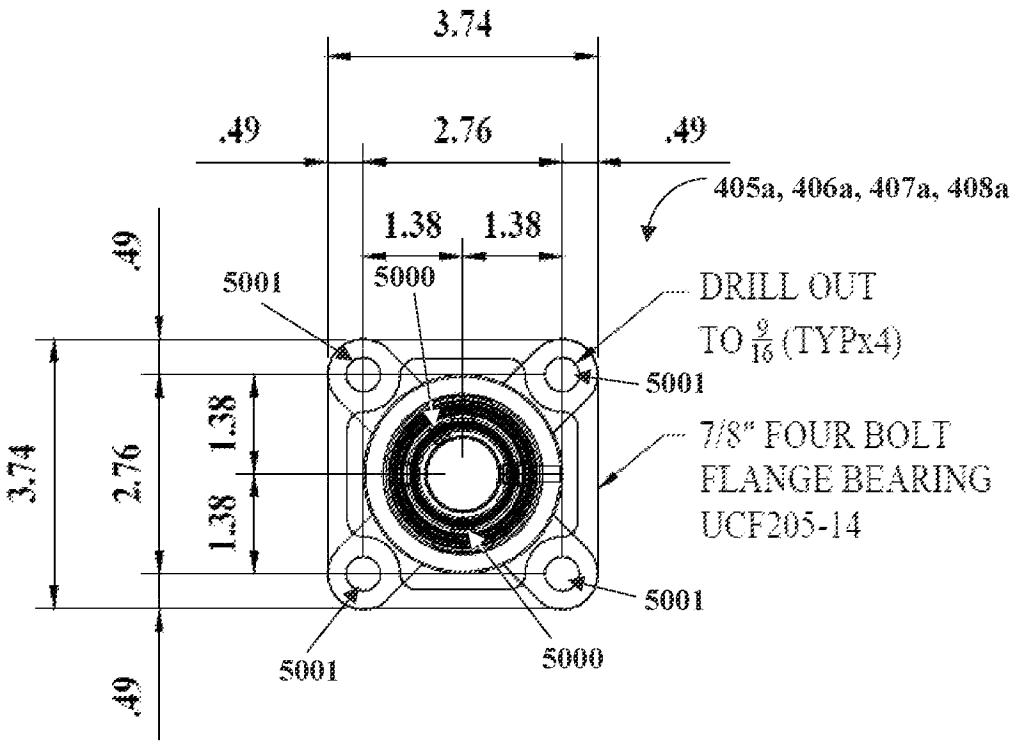
FIG. 50 exemplarily illustrates a dimensional drawing of a thick metal spacer plate of each hub of the frame of the floor jack shown in FIG. 46, according to an embodiment herein.

FIG. 50 exemplarily illustrates a dimensional drawing of a four-bolt flange bearing 405*a*, 406*a*, 407*a*, 408*a* of each hub 405, 406, 407, 408 of the frame 100 of the floor jack shown in FIG. 46, according to an embodiment herein. The structure and the function of the four-bolt flange bearings 405*a*, 406*a*, 407*a*, and 408*a* of the hubs 405, 406, 407, and 408 respectively, of the frame 100 are similar to the structure and the function of the four-bolt flange bearings 5*a*, 6*a*, 7*a*, and 8*a* of their respective hubs 5, 6, 7, and 8 of the frame 100 disclosed in the detailed description of FIG. 16. Each of the four-bolt flange bearings 405*a*, 406*a*, 407*a*, and 408*a* is, for example, a UCF205-14, ⅞-inch four-bolt flange bearing comprising set screws 5000 as disclosed in the detailed description of FIG. 46. Each of the four-bolt flange bearings 405*a*, 406*a*, 407*a*, and 408*a* further comprises drill holes 5001 drilled out, for example, to about 9/16 inches, as disclosed in the detailed description of FIG. 16.

Figure 51:
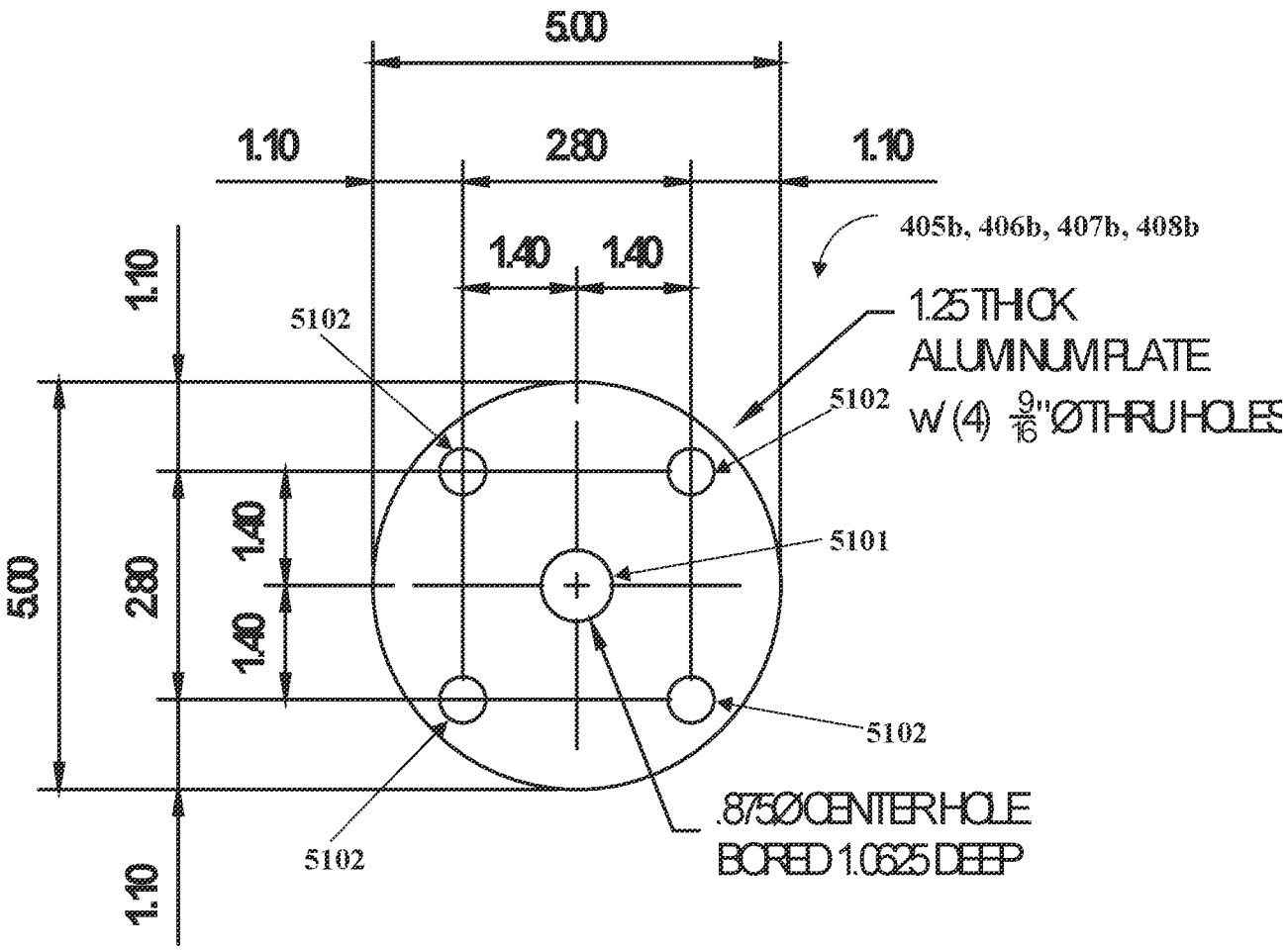
FIG. 51 exemplarily illustrates a dimensional drawing of a four-bolt flange bearing of each hub of the frame of the floor jack shown in FIG. 46, according to an embodiment herein.

FIG. 51 exemplarily illustrates a dimensional drawing of a thick metal spacer plate 405*b*, 406*b*, 407*b*, 408*b* of each hub 405, 406, 407, 408 of the frame 100 of the floor jack shown in FIG. 46, according to an embodiment herein. As exemplarily illustrated in FIG. 51, the thick metal spacer plates 405*b*, 406*b*, 407*b*, and 408*b* of the respective hubs 405, 406, 407, and 408 exemplarily illustrated in FIGS. 46-48, are of a generally circular shape. The thickness of each of the thick metal spacer plates 405*b*, 406*b*, 407*b*, and 408*b* is, for example, about 1.25 inches. Each of the thick metal spacer plates 405*b*, 406*b*, 407*b*, and 408*b* comprises a center hole 5101 through which an end of a corresponding axle is connected. For example, the ends 402*c* and 402*d* of the first axle 402*a* exemplarily illustrated in FIGS. 47-48, are inserted through the center holes 5101 of the respective spacer plates 405*b* and 406*b* via the respective four-bolt flange bearings 405*a* and 406*a* to connect the first axle 402*a* to the hubs 405 and 406. Similarly, the ends 402*e* and 402*f* of the second axle 402*b* exemplarily illustrated in FIGS. 47-48, are inserted through the center holes 5101 of the respective spacer plates 407*b* and 408*b* via the four-bolt flange bearings 407*a* and 408*a* to connect the second axle 402*b* to the hubs 407 and 408. The diameter of the center hole 5101 is, for example, about 0.875 inches. In an embodiment, the center hole 5101 is bored, for example, to about 1.0625 inches deep. In an embodiment, each of the thick metal spacer plates 405*b*, 406*b*, 407*b*, and 408*b* further comprises four through holes 5102 having, for example, about 9/16-inch diameters. The through holes 5102 of each of the thick metal spacer plates 405*b*, 406*b*, 407*b*, and 408*b* are aligned coaxial to the drill holes 5001 of the four-bolt flange bearings 405*a*, 406*a*, 407*a*, and 408*a* respectively, exemplarily illustrated in FIG. 50. Fasteners (not shown) are inserted through the drill holes 5001 of the four-bolt flange bearings 405*a*, 406*a*, 407*a*, and 408*a* and the through holes 5102 of the thick metal spacer plates 405*b*, 406*b*, 407*b*, and 408*b* for fastening the four-bolt flange bearings 405*a*, 406*a*, 407*a*, and 408*a* exemplarily illustrated in FIG. 48, to the thick metal spacer plates 405*b*, 406*b*, 407*b*, and 408*b* respectively, in their respective hubs 405, 406, 407, and 408.

Figure 52A:
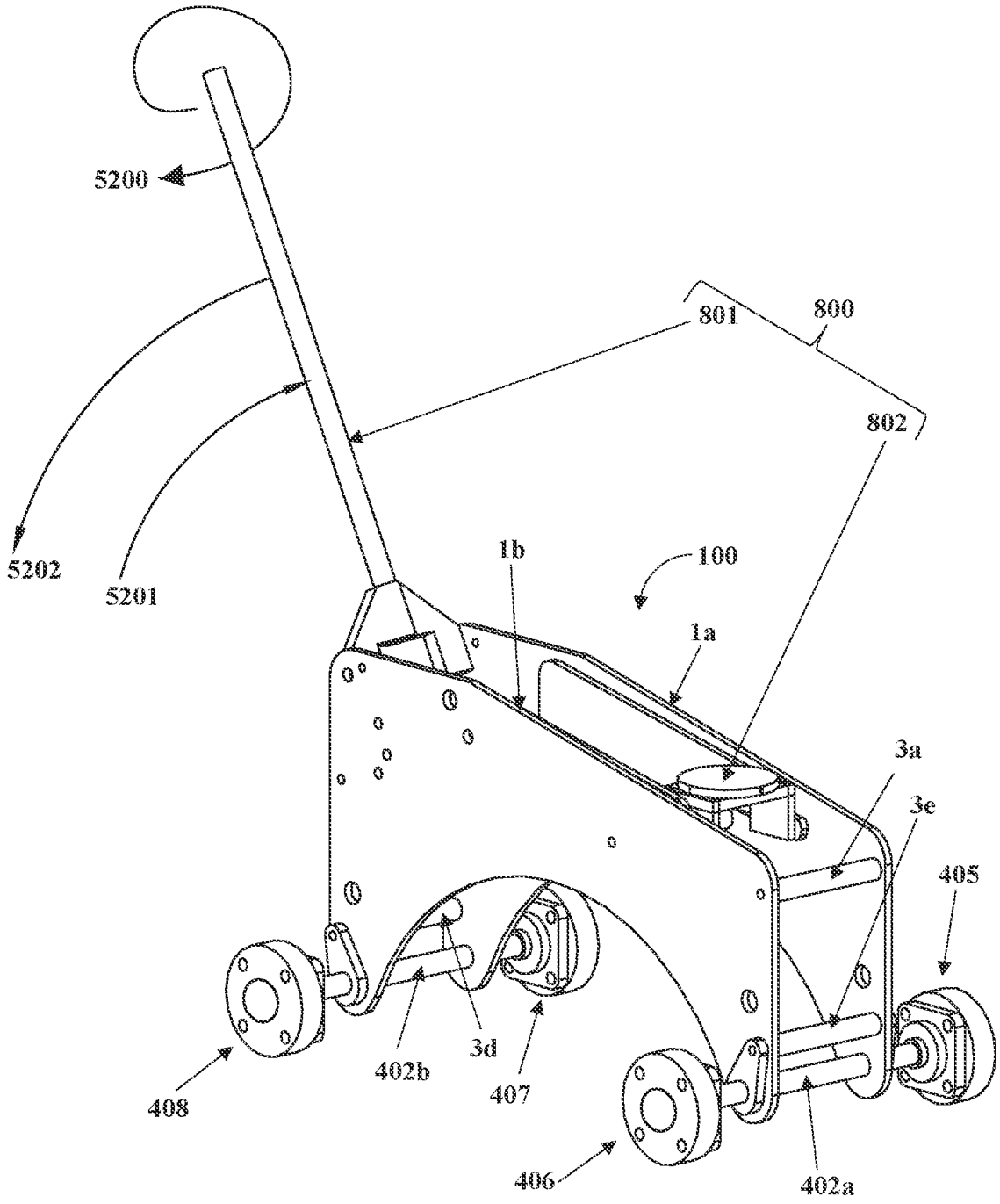
FIG. 52A exemplarily illustrates a perspective view of the frame of the floor jack shown in FIG. 46, illustrating movement of a handle of a lifting mechanism of the floor jack to raise a lifting pad of the lifting mechanism, according to an embodiment herein.

FIG. 52A exemplarily illustrates a perspective view of the frame 100 of the floor jack shown in FIG. 46, illustrating movement of a handle 801 of a lifting mechanism 800 of the floor jack 1000 shown in FIGS. 10A-10B and FIG. 11, to raise a lifting pad 802 of the lifting mechanism 800, according to an embodiment herein. In FIG. 52A, the elevation of the frame 100 of the floor jack 1000 is shown in the lower position and the lifting pad 802 of the lifting mechanism 800 is shown in a lowered position or a retracted position.

Figure 52B:
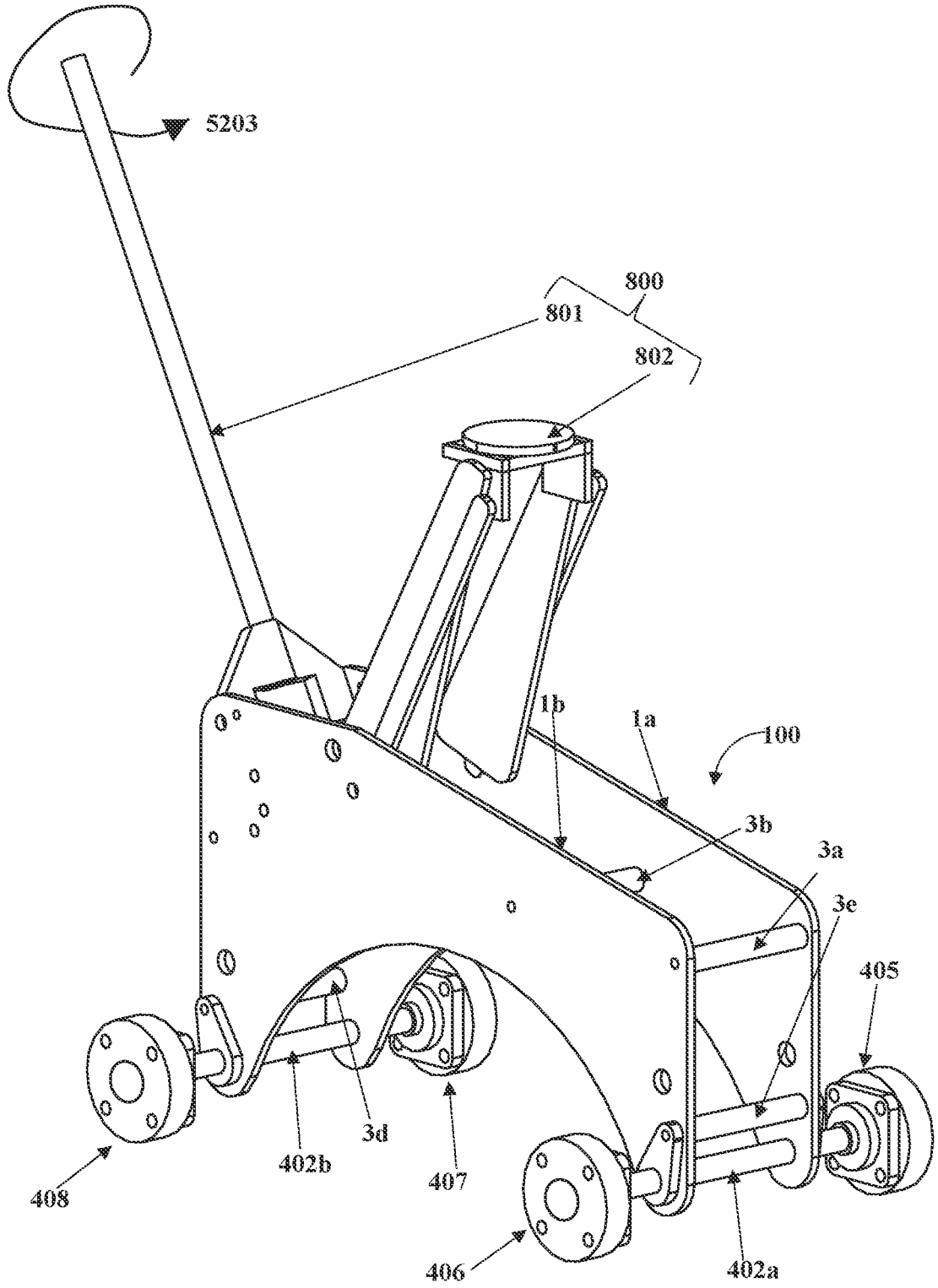
FIG. 52B exemplarily illustrates a perspective view of the frame of the floor jack shown in FIG. 46, illustrating movement of the handle of the lifting mechanism to lower the lifting pad of the lifting mechanism, according to an embodiment herein.

FIG. 52B exemplarily illustrates a perspective view of the frame 100 of the floor jack shown in FIG. 46, illustrating movement of the handle 801 of the lifting mechanism 800 to lower the lifting pad 802 of the lifting mechanism 800, according to an embodiment herein. In FIG. 52B, the elevation of the frame 100 of the floor jack 1000 shown in FIGS. 10A-10B and FIG. 11, is shown in the lower position and the lifting pad 802 of the lifting mechanism 800 is shown in an extended position. In an embodiment, the lifting mechanism 800 is a hydraulic lifting mechanism 800. The lifting pad 802 is raised as disclosed in the detailed description of FIG. 11. When the handle 801 is lowered in a direction 5202 and raised in a direction 5201 exemplarily illustrated in FIG. 52A, liquid is forced into the working cylinder 804 exemplarily illustrated in FIG. 11, by the pump plunger 805, causing the lifting pad 802 to rise up to the extended position as disclosed in the detailed description of FIG. 11. The lifting pad 802 is also raised by rotating the handle 801 in a clockwise direction 5200 as exemplarily illustrated FIG. 52A, until the handle 801 stops rotating. To lower the lifting pad 802, the handle 801 is rotated in counterclockwise direction 5203 as exemplarily illustrated in FIG. 52B. The handle 801 is rotated in a counterclockwise direction 5203 until the lifting pad 802 starts to lower on its own.

The foregoing examples and illustrative implementations of various embodiments of the frame 100, 200, and 300 for the floor jack 1000 have been provided merely for explanation and are in no way to be construed as limiting of the embodiments disclosed herein. Dimensions of the parts of the frames 100, 200, and 300 and the floor jack 1000 disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods, and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

I claim:

1. A frame for a floor jack, the frame comprising:

a pair of arched side plates, each of the arched side plates comprising a front end and a rear end;

a first pair of hubs positioned at front ends of the pair of arched side plates;

a second pair of hubs positioned at rear ends of the pair of arched side plates, wherein each hub of the first pair of hubs and the second pair of hubs comprises a flange bearing, a spacer plate, and an end plate coaxially positioned on either end of the first axle and the second axle respectively;

a first axle connecting the pair of arched side plates to the first pair of hubs at the front ends using a first pair of adjustable collars;

a second axle connecting the pair of arched side plates to the second pair of hubs at the rear ends using a second pair of adjustable collars; and a set of spreader bars separating the pair of arched side plates along a length of the pair of arched side plates.

2. The frame of claim 1, wherein the first pair of adjustable collars and the second pair of adjustable collars are teardrop-shaped adjustable shaft collars, and wherein the teardrop-shaped adjustable shaft collars are configured to adjust an elevation of a lifting pad of the floor jack, above a substantially horizontal surface on which the floor jack is positioned, between a lowered position and a fully extended position.

3. The frame of claim 2, wherein each of the teardrop-shaped adjustable shaft collars pivots about a pivot point to switch between a lower position and an upper position, to adjust the elevation of the lifting pad of the floor jack.

4. The frame of claim 3, wherein each of the arched side plates comprises upper axle holes and lower axle holes corresponding to the upper position and the lower position of the teardrop-shaped adjustable shaft collars respectively, to allow adjustment of the elevation of the lifting pad of the floor jack.

5. The frame of claim 1, wherein the pair of arched side plates is made of metal and is powder coated.

6. The frame of claim 1, further comprising a set of tire-wheel assemblies, wherein one of the tire-wheel assemblies is connected to each hub of the first pair of hubs and the second pair of hubs to provide mobility to the floor jack when the floor jack is assembled.

7. A frame for a fixed height floor jack, the frame comprising:

a pair of arched side plates, each of the arched side plates comprising a front end and a rear end;

a first pair of hubs positioned at front ends of the pair of arched side plates;

a second pair of hubs positioned at rear ends of the pair of arched side plates wherein each hub of the first pair of hubs and the second pair of hubs comprises a flange bearing, a spacer plate, and an end plate coaxially positioned on either end of the first axle and the second axle respectively;

a first axle connecting the pair of arched side plates to the first pair of hubs at the front ends using a first pair of non-adjustable collars;

a second axle connecting the pair of arched side plates to the second pair of hubs at the rear ends using a second pair of non-adjustable collars; and a set of spreader bars separating the pair of arched side plates along a length of the pair of arched side.

8. The frame of claim 7, wherein the first pair of non-adjustable collars and the second pair of non-adjustable collars are fixed metal shaft collars.

9. The frame of claim 7, wherein the pair of arched side plates is made of thick metal and is powder coated.

10. The frame of claim 7, further comprising a set of tire-wheel assemblies, wherein one of the tire-wheel assemblies is connected to each hub of the first pair of hubs and the second pair of hubs to provide mobility to the floor jack when the floor jack is assembled.

11. A floor jack comprising:

a pair of arched side plates, each of the arched side plates comprising a front end and a rear end;

a first pair of hubs positioned at front ends of the pair of arched side plates;

a second pair of hubs positioned at rear ends of the pair of arched side plates wherein each hub of the first pair of hubs and the second pair of hubs comprises a flange bearing and an end plate coaxially positioned on either end of the first axle and the second axle respectively;

a first axle connecting the pair of arched side plates to the first pair of hubs at the front ends using a first pair of adjustable collars;

a second axle connecting the pair of arched side plates to the second pair of hubs at the rear ends using a second pair of adjustable collars;

a set of spreader bars separating the pair of arched side plates along a length of the pair of arched side plates;

a lifting mechanism comprising a lifting pad positioned between the pair of arched side plates; and a set of tire-wheel assemblies, wherein one of the tire-wheel assemblies is connected to each hub of the first pair of hubs and the second pair of hubs to provide mobility to the floor jack when the floor jack is assembled.

12. The floor jack of claim 11, wherein the lifting mechanism further comprises a handle operably connected to the pair of arched side plates and configured to one of raise the lifting pad to an extended position and lower the lifting pad to a lowered position, wherein the lifting mechanism is a hydraulic lifting mechanism comprising a pair of lifting arms, a working cylinder with a piston, a pump plunger, and a hydraulic fluid reservoir, wherein the pump plunger comprises a chamber and a plunger, wherein each of the lifting arms has a shape resembling a triangle, wherein each of the lifting arms comprises an apex corner, wherein each of the lifting arms further comprises a pair of corners adjacent to base sides opposite to the apex corners, wherein the lifting arms are pivotably connected to the arched side plates using fasteners that secure holes in the arched side plates with the holes in the corners of the lifting arms, wherein each of the lifting arms further comprises a hole at the corners adjacent to the base sides, wherein a bar is secured between the holes on the corners of the pair of lifting arms, wherein the piston is rotatably connected to a mid-section of the bar, wherein the hydraulic floor jack operates using an incompressible liquid, wherein the pump plunger forces the liquid into the working cylinder when the handle attached to the plunger is lowered, wherein the plunger is pulled back by turning the handle in a counterclockwise direction, causing the pump plunger to draw the liquid out of the fluid reservoir through a suction check valve into the chamber, wherein when the plunger moves into the chamber of the pump plunger, the plunger pushes the oil through a discharge check valve into the working cylinder, wherein a suction check valve ball, positioned within the chamber, opens with each draw of the plunger, wherein a discharge check valve ball, positioned outside the chamber opens when the liquid is pushed into the working cylinder, wherein the suction check valve ball within the chamber is forced shut and liquid pressure builds in the working cylinder, wherein the piston slowly advances out of the working cylinder with each stroke of the plunger and pushes the bar at the corners of the lifting arms forward, wherein the forward push of the bar, in turn, causes the lifting arms to pivot at the corners and lift up the lifting pad, wherein the lifting pad is lowered by releasing the liquid pressure using a release valve, and wherein the lifting mechanism allows the elevation of the lifting pad to be adjusted independently from the frame of the floor jack.

13. The floor jack of claim 11, wherein the first pair of adjustable collars and the second pair of adjustable collars are teardrop-shaped adjustable shaft collars, and wherein the teardrop-shaped adjustable shaft collars are configured to adjust an elevation of the lifting pad of the floor jack, above a substantially horizontal surface on which the floor jack is positioned, between a lowered position and a fully extended position.

14. The floor jack of claim 13, wherein each of the teardrop-shaped adjustable shaft collars pivots about a pivot point to switch between a lower position and an upper position, to adjust the elevation of the lifting pad of the floor jack, and wherein each of the arched side plates comprises upper axle holes and lower axle holes corresponding to the upper position and the lower position of the teardrop-shaped adjustable shaft collars respectively, to allow adjustment of the elevation of the lifting pad of the floor jack.

15. A floor jack comprising:

a pair of arched side plates, each of the arched side plates comprising a front end and a rear end;

a first pair of hubs positioned at front ends of the pair of arched side plates;

a second pair of hubs positioned at rear ends of the pair of arched side plates wherein each hub of the first pair of hubs and the second pair of hubs comprises a flange bearing and an end plate coaxially positioned on either end of the first axle and the second axle respectively;

a first axle connecting the pair of arched side plates to the first pair of hubs at the front ends using a first pair of non-adjustable collars;

a second axle connecting the pair of arched side plates to the second pair of hubs at the rear ends using a second pair of non-adjustable collars;

a set of spreader bars separating the pair of arched side plates along a length of the pair of arched side plates;

a lifting mechanism comprising a lifting pad positioned between the pair of arched side plates; and a set of tire-wheel assemblies, wherein one of the tire-wheel assemblies is connected to each hub of the first pair of hubs and the second pair of hubs to provide mobility to the floor jack when the floor jack is assembled.

16. The floor jack of claim 15, wherein the lifting mechanism further comprises a handle operably connected to the pair of arched side plates and configured to one of raise the lifting pad to an extended position and lower the lifting pad to a lowered position, wherein the lifting mechanism is a hydraulic lifting mechanism comprising a pair of lifting arms, a working cylinder with a piston, a pump plunger, and a hydraulic fluid reservoir, wherein the pump plunger comprises a chamber and a plunger, wherein each of the lifting arms has a shape resembling a triangle, wherein each of the lifting arms comprises an apex corner, wherein each of the lifting arms further comprises a pair of corners adjacent to base sides opposite to the apex corners, wherein the lifting arms are pivotably connected to the arched side plates using fasteners that secure holes in the arched side plates with the holes in the corners of the lifting arms, wherein each of the lifting arms further comprises a hole at the corners adjacent to the base sides, wherein a bar is secured between the holes on the corners of the pair of lifting arms, wherein the piston is rotatably connected to a mid-section of the bar, wherein the hydraulic floor jack operates using an incompressible liquid, wherein the pump plunger forces the liquid into the working cylinder when the handle attached to the plunger is lowered, wherein the plunger is pulled back by turning the handle in a counterclockwise direction, causing the pump plunger to draw the liquid out of the fluid reservoir through a suction check valve into the chamber, wherein when the plunger moves into the chamber of the pump plunger, the plunger pushes the oil through a discharge check valve into the working cylinder, wherein a suction check valve ball, positioned within the chamber, opens with each draw of the plunger, wherein a discharge check valve ball, positioned outside the chamber opens when the liquid is pushed into the working cylinder, wherein the suction check valve ball within the chamber is forced shut and liquid pressure builds in the working cylinder, wherein the piston slowly advances out of the working cylinder with each stroke of the plunger and pushes the bar at the corners of the lifting arms forward, wherein the forward push of the bar, in turn, causes the lifting arms to pivot at the corners and lift up the lifting pad, wherein the lifting pad is lowered by releasing the liquid pressure using a release valve, and wherein the lifting mechanism allows the elevation of the lifting pad to be adjusted independently from the frame of the floor jack.

17. A frame for a floor jack, the frame comprising:

a first side plate and an opposing second side plate, the first side plate defining a first side plate lower edge and a first side plate upper edge, the second side plate defining a second side plate lower edge and a second side plate upper edge, and wherein each side plate defines an arch on a lower edge of the side plate extending upwards towards the upper edge of the first side plate and the second side plate, and wherein each side plate comprises a front end and a rear end;

a first pair of hubs positioned at front ends of the first side plate and the second side plate;

a second pair of hubs positioned at rear ends of the first side plate and the second side plate;

a first axle connecting the first side plate and the second side plate to the first pair of hubs at the front ends using a first pair of adjustable collars;

a second axle connecting the first side plate and the second side plate to the second pair of hubs at the rear ends using a second pair of adjustable collars; and each hub of the first pair of hubs and the second pair of hubs comprising an end plate coaxially positioned at either end of the first axle and the second axle respectively, wherein the adjustable collars are configured to allow tires of different diameters to be attached to the first pair of hubs and the second pair of hubs.

18. The frame of claim 17 further comprising:

a set of spreader bars separating the first side plate and the second side plate along a length of the first side plate and the second side plate.

* * * * *